US011066263B2

(12) United States Patent
Yamane et al.

(10) Patent No.: US 11,066,263 B2
(45) Date of Patent: Jul. 20, 2021

(54) SHEET CONVEYING DEVICE AND IMAGE FORMING APPARATUS INCORPORATING THE SHEET CONVEYING DEVICE

(71) Applicants: Jun Yamane, Kanagawa (JP); Hiromichi Matsuda, Kanagawa (JP); Katsuaki Miyawaki, Kanagawa (JP); Koichi Kudo, Kanagawa (JP); Tetsuo Watanabe, Kanagawa (JP); Toshihiro Okamoto, Kanagawa (JP); Hideyuki Takayama, Kanagawa (JP); Atsuyuki Oyamada, Kanagawa (JP)

(72) Inventors: Jun Yamane, Kanagawa (JP); Hiromichi Matsuda, Kanagawa (JP); Katsuaki Miyawaki, Kanagawa (JP); Koichi Kudo, Kanagawa (JP); Tetsuo Watanabe, Kanagawa (JP); Toshihiro Okamoto, Kanagawa (JP); Hideyuki Takayama, Kanagawa (JP); Atsuyuki Oyamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/451,638

(22) Filed: Jun. 25, 2019

(65) Prior Publication Data

US 2019/0315586 A1 Oct. 17, 2019

Related U.S. Application Data

(63) Continuation of application No. 15/681,550, filed on Aug. 21, 2017, now Pat. No. 10,358,311, which is a (Continued)

(30) Foreign Application Priority Data

Dec. 9, 2014 (JP) ..... 2014-249359
Mar. 19, 2015 (JP) ..... 2015-056413

(Continued)

(51) Int. Cl.
*B65H 9/00* (2006.01)
*G03G 15/00* (2006.01)

(Continued)

(52) U.S. Cl.
CPC ..... *B65H 9/20* (2013.01); *B65H 7/14* (2013.01); *B65H 9/002* (2013.01);

(Continued)

(58) Field of Classification Search
CPC .. B65H 2404/1425; B65H 2404/14212; B65H 2301/331; B65H 9/00; B65H 9/002;

(Continued)

(56) References Cited

U.S. PATENT DOCUMENTS 5,074,450 A 12/1991 Lindner et al.
5,697,609 A 12/1997 Williams et al.

(Continued)

FOREIGN PATENT DOCUMENTS

JP H6234441 A 8/1994
JP H9175694 A 7/1997

(Continued)

OTHER PUBLICATIONS

Japanese communication with the dispatch No. 264394 issued by the Japan Patent Office on Jun. 27, 2019 for Japanese Patent Application No. 2015-199443.

*Primary Examiner* — Jeremy R Severson
(74) *Attorney, Agent, or Firm* — Harness, Dickey & Pierce PLLC

(57) ABSTRACT

A sheet conveying device, which is incorporated in an image forming apparatus, includes a first detector to detect an angle (Continued)

deviation of a recording medium to a sheet conveying direction, a second detector to detect a lateral shift of the recording medium to a width direction, a third detector to detect at least one of the angle deviation and the lateral shift after correction of the angle deviation detected by the first detector and the lateral shift detected by the second detector, and a rotary body to perform a primary movement by (1) rotating in the sheet conveying direction and returning to a reference position and by (2) moving in the width direction and returning to the reference position, and a secondary movement by performing at least one of (1) and (2) after the primary movement.

44 Claims, 24 Drawing Sheets

Related U.S. Application Data continuation of application No. 14/959,780, filed on Dec. 4, 2015, now Pat. No. 9,776,819.

(30) Foreign Application Priority Data

Oct. 6, 2015 (JP) ..... 2015-198614
Oct. 7, 2015 (JP) ..... 2015-199443

(51) Int. Cl.
*B65H 9/20* (2006.01)
*B65H 7/14* (2006.01)

(52) U.S. Cl.
CPC ... *G03G 15/6561* (2013.01); *B65H 2301/331* (2013.01); *B65H 2404/1424* (2013.01); *B65H 2404/14212* (2013.01); *B65H 2553/416* (2013.01); *B65H 2601/272* (2013.01)

(58) Field of Classification Search
CPC .. B65H 9/20; B65H 7/14; B65H 2404/15212; B65H 2553/416; G03G 15/6561
See application file for complete search history.

(56) References Cited

U.S. PATENT DOCUMENTS

| | | | | |
|---|---|---|---|---|
| 6,634,521 | B1 | 10/2003 | Hwang | |
| 7,472,905 | B2 * | 1/2009 | Inoue | B65H 9/006 271/227 |
| 7,684,749 | B2 | 3/2010 | Yamane et al. | |
| 7,986,912 | B2 | 7/2011 | Maruyama | |
| 8,186,664 | B2 | 5/2012 | Yahata et al. | |
| 8,256,767 | B2 | 9/2012 | Williams et al. | |
| 9,776,819 | B2 * | 10/2017 | Yamane | B65H 9/002 |
| 10,358,311 | B2 * | 7/2019 | Yamane | B65H 9/002 |
| 2002/0060417 | A1 | 5/2002 | Hiramitsu | |
| 2002/0113357 | A1 | 8/2002 | Seto et al. | |
| 2005/0030600 | A1 | 2/2005 | Takagi et al. | |
| 2005/0035528 | A1 | 2/2005 | Suga et al. | |
| 2005/0035536 | A1 | 2/2005 | Suga et al. | |
| 2005/0035539 | A1 | 2/2005 | Hashimoto | |
| 2006/0017214 | A1 | 1/2006 | Inoue | |
| 2006/0153604 | A1 | 7/2006 | Matsuda et al. | |
| 2006/0267271 | A1 | 11/2006 | Mandel et al. | |
| 2008/0047157 | A1 | 2/2008 | Takayama et al. | |
| 2008/0232879 | A1 | 9/2008 | Shoji et al. | |
| 2008/0232880 | A1 | 9/2008 | Noguchi et al. | |
| 2008/0303202 | A1 | 12/2008 | Noguchi et al. | |
| 2009/0033029 | A1 | 2/2009 | Kinoshita et al. | |
| 2009/0057994 | A1 | 3/2009 | Kondo | |
| 2011/0058872 | A1 | 3/2011 | Ferrara et al. | |
| 2012/0169006 | A1 | 7/2012 | Matsuda | |
| 2012/0219343 | A1 | 8/2012 | Ferrara et al. | |
| 2012/0262513 | A1 | 10/2012 | Mandel et al. | |
| 2013/0223901 | A1 | 8/2013 | Minbe et al. | |
| 2013/0241141 | A1 | 9/2013 | Karikusa | |
| 2014/0145397 | A1 | 5/2014 | Aoki | |
| 2015/0102555 | A1 | 4/2015 | Deno | |

FOREIGN PATENT DOCUMENTS

| | | | |
|---|---|---|---|
| JP | H10067448 | A | 3/1998 |
| JP | H10120253 | A | 5/1998 |
| JP | 2002308501 | A | 10/2002 |
| JP | 2002311659 | A | 10/2002 |
| JP | 2002372871 | A | 12/2002 |
| JP | 2005053646 | A | 3/2005 |
| JP | 2005-162384 | A | 6/2005 |
| JP | 2005178929 | A | 7/2005 |
| JP | 2006027859 | A | 2/2006 |
| JP | 2006193247 | A | 7/2006 |
| JP | 2006195016 | A | 7/2006 |
| JP | 2006201616 | A | 8/2006 |
| JP | 2006248629 | A | 9/2006 |
| JP | 2006256803 | A | 9/2006 |
| JP | 2006347710 | A | 12/2006 |
| JP | 2007086811 | A | 4/2007 |
| JP | 2007-269421 | A | 10/2007 |
| JP | 2008137739 | A | 6/2008 |
| JP | 2008239340 | A | 10/2008 |
| JP | 2008239348 | A | 10/2008 |
| JP | 2008268851 | A | 11/2008 |
| JP | 2009015287 | A | 1/2009 |
| JP | 2009-057213 | A | 3/2009 |
| JP | 2009274866 | A | 11/2009 |
| JP | 2010115893 | A | 5/2010 |
| JP | 2010137990 | A | 6/2010 |
| JP | 2010-149377 | A | 7/2010 |
| JP | 2010149991 | A | 7/2010 |
| JP | 2010215339 | A | 9/2010 |
| JP | 2011033771 | A | 2/2011 |
| JP | 2011098790 | A | 5/2011 |
| JP | 2011126698 | A | 6/2011 |
| JP | 2012140228 | A | 7/2012 |
| JP | 2012162343 | A | 8/2012 |
| JP | 2013193815 | A | 9/2013 |
| JP | 2014058369 | A | 4/2014 |
| JP | 2014-088263 | A | 5/2014 |
| JP | 2014-193769 | A | 10/2014 |
| JP | 2015-000787 | A | 1/2015 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is a continuation of U.S. application Ser. No. 15/681,550, filed on Aug. 21, 2017, which is a continuation of U.S. application Ser. No. 14/959,780, filed on Dec. 4, 2015, which claims the benefit under U.S.C. § 119 to Japanese Patent Application Nos. 2014-249359, filed on Dec. 9, 2014, 2015-056413, filed on Mar. 19, 2015, 2015-198614, filed on Oct. 6, 2015, and 2015-199443, filed on Oct. 7, 2015, in the Japan Patent Office, the entire disclosure of each of which is hereby incorporated in its entirety by reference herein.

BACKGROUND

Technical Field

This disclosure relates to a sheet conveying device and an image forming apparatus incorporating the sheet conveying device.

Related Art

Various types of electrophotographic image forming apparatuses are known, including copiers, printers, facsimile machines, or multifunction machines having two or more functions of copying, printing, scanning, facsimile, plotter, and other capabilities. Such image forming apparatuses usually correct positional shifts with an inclination (skew) of a recording medium with respect to a sheet conveying direction in a sheet conveying path and simultaneously with a lateral shift or deviation of the recording medium in a width direction, which is a direction perpendicular to the sheet conveying direction, so as to adjust the recording medium to a normal position. (Hereinafter, the correction of the recording medium in the width direction is also referred to a "lateral shift correction".)

For example, when a recording medium is conveyed by a pair of conveying rollers in an image forming apparatus, a contact image sensor (CIS) detects a lateral shift or deviation of the recording medium in the width direction and a pair of skew detection sensors detects an inclination (skew) of the recording medium in the sheet conveying direction. A pair of sheet holding rollers is rotated about a shaft thereof and moved (shifted) in the width direction at the same time, so as to correct the positional shifts of the recording medium in these directions. After the positional shifts are corrected, the recording medium is further conveyed by a pair of timing rollers in a downstream direction for a transferring process.

SUMMARY

At least one aspect of this disclosure provides a sheet conveying device including a first detector, a second detector, a third detector, and a rotary body. The first detector detects an angle deviation of a recording medium inclined with respect to a sheet conveying direction of the recording medium during transport of the recording medium via a sheet conveying path through which the recording medium travels. The second detector detects a lateral shift of the recording medium shifted with respect to a width direction of the recording medium during transport of the recording medium via the sheet conveying path. The third detector detects at least one of the angle deviation and the lateral shift after correction of the angle deviation detected by the first detector and the lateral shift detected by the second detector. The rotary body is rotated by a driving unit and is disposed between the first detector, the second detector, and the third detector. The rotary body conveys the recording medium while holding the recording medium along the sheet conveying path. The rotary body performs a primary movement by (1) rotating obliquely in the sheet conveying direction before holding the recording medium and returning to a reference position after holding the recording medium and by (2) moving in the width direction before holding the recording medium and returning to the reference position after holding the recording medium. The rotary body performs a secondary movement by performing at least one of (1) and (2) after the primary movement.

Further, at least one aspect of this disclosure provides an image forming apparatus including the above-described sheet conveying device, and an image forming part to form an image on the recording medium while the sheet conveying device holds and conveys the recording medium.

DETAILED DESCRIPTION

Figure 1:
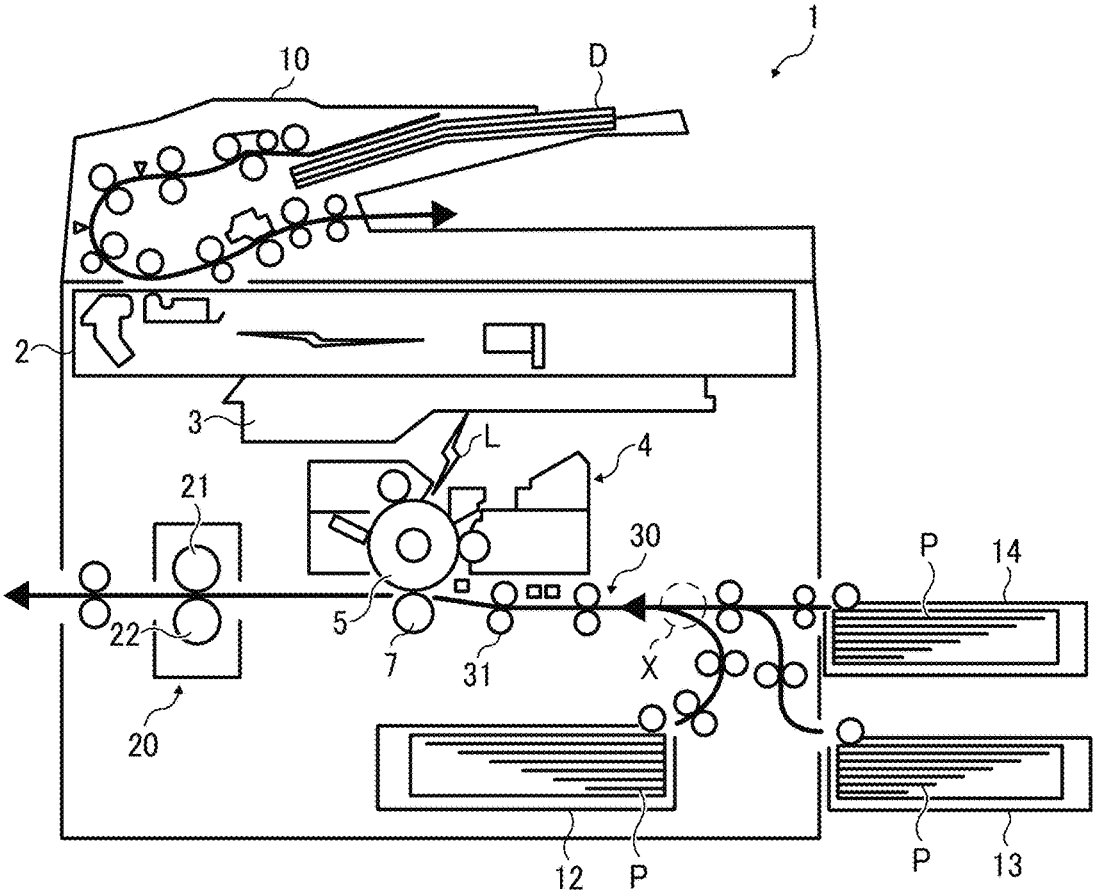
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an overall configuration and operations of an image forming apparatus 1 according to an example of this disclosure, with reference to FIG. 1.

FIG. 1 is a diagram illustrating a schematic configuration of the image forming apparatus 1 according to an example of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet P, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction; "lateral shift" indicates a shift or movement of the recording medium laterally moved from a reference position or line in the width direction; "lateral shift amount" indicates an amount of the lateral shift, that is, a distance shifted from the reference position or line in the width direction; both "inclination" and "skew" indicate a shift or movement of the recording medium inclined or obliquely moved from the reference position or line in the sheet conveying direction; and "inclination amount", "inclination angle", "skew amount", "skew angle" indicate an amount of the inclination or skew, that is, an angle inclined from the reference position or line in the sheet conveying direction.

In FIG. 1, the image forming apparatus 1 includes a document reading unit 2, an exposure unit 3, an image forming part 4, a photoconductor drum 5, a transfer roller 7, a document conveying unit 10, a first sheet feeding unit 12, a second sheet feeding unit 13, a third sheet feeding unit 14, a fixing device 20, a sheet conveying device 30, and a pair of sheet holding rollers 31.

The document reading unit 2 optically reads image data of an original document D.

The exposure unit 3 emits an exposure light L based on the image data read by the document reading unit 2 to irradiate the exposure light L on a surface of the photoconductor drum 5 that functions as an image bearer.

The image forming part 4 forms a toner image on the surface of the photoconductor drum 5. The photoconductor drum 5 that functions as an image bearer and the transfer roller 7 that functions as a transfer unit are included in the image forming part 4.

The transfer roller 7 is included in the image forming part 4 to transfer the toner image formed on the surface of the photoconductor drum 5 onto a recording medium P.

The document conveying unit 10 conveys the original document D set on a document tray or loader to the document reading unit 2.

The first sheet feeding unit 12, the second sheet feeding unit 13, and the third sheet feeding unit 14 are sheet cassettes each of which accommodates the recording medium (sheet) P such as a transfer sheet therein.

The fixing device 20 includes a fixing roller 21 and a pressure roller 22 to fix an unfixed image formed on the recording medium P to the recording medium P by application of heat and pressure.

The sheet conveying device 30 conveys the recording medium P to the sheet conveying path. The transfer roller 7 is also included in the sheet conveying device 30 as a downstream side conveying roller.

The pair of sheet holding rollers 31 functions as a rotary body (e.g., a pair of registration rollers and a pair of timing rollers) to convey the recording medium P to the transfer roller 7. The pair of sheet holding rollers 31 is also referred to as a pair of lateral shift and skew correction rollers.

Figure 2:
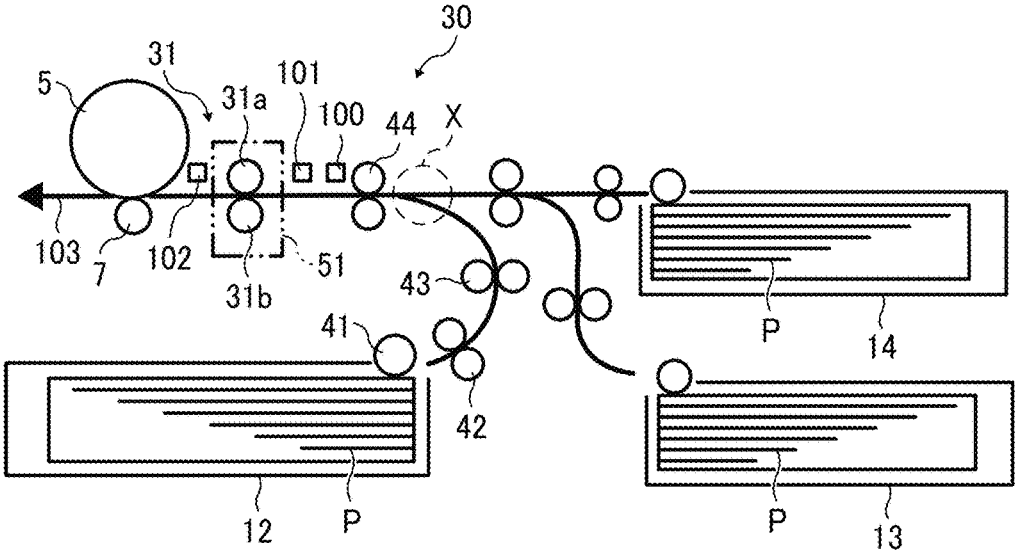
FIG. 2 is a schematic diagram illustrating a sheet conveying device according to an example of this disclosure and units disposed near the sheet conveying device included in the image forming apparatus of FIG. 1.

A description is given of regular image forming operations performed in the image forming apparatus 1 according to an example of this disclosure, with reference to FIGS. 1 and 2.

The original document D is fed from a document loading table provided to the document conveying unit 10 and conveyed by multiple pairs of sheet conveying rollers disposed in the document conveying unit 10 in a direction indicated by arrow in FIG. 1 over the document reading unit 2. At this time, the document reading unit 2 optically reads image data of the original document D passing thereover. The image data optically scanned by the document reading unit 2 is converted to electrical signals. The converted electrical signals are transmitted to the exposure unit 3. Then, the exposure unit 3 emits exposure light (laser light) L based on the image data of the electrical signals toward the surface of the photoconductor drum 5 of the image forming part 4.

By contrast, the photoconductor drum 5 of the image forming part 4 rotates in a clockwise direction in FIG. 1. After a series of given image forming processes, e.g., a charging process, an exposing process, and a developing process, a toner image corresponding to the image data is formed on the surface of the photoconductor drum 5. Thereafter, the toner image formed on the surface of the photoconductor drum 5 is transferred by the transfer roller 7, in the transfer nip in the image forming part 4 where the transfer roller 7 and the photoconductor drum 5 contact to each other, onto the recording medium P conveyed by the pair of sheet holding rollers 31 that functions as a pair of registration rollers.

The recording medium P is conveyed to the transfer roller 7 as follows.

As illustrated in FIGS. 1 and 2, one of the first sheet feeding unit 12, the second sheet feeding unit 13, and the third sheet feeding unit 14 of the image forming apparatus 1 is selected automatically or manually. It is to be noted that the first sheet feeding unit 12, the second sheet feeding unit 13, and the third sheet feeding unit 14 basically have an identical configuration to each other, except the second sheet feeding unit 13 and the third sheet feeding unit 14 disposed outside an apparatus body of the image forming apparatus 1. For example, when the first sheet feeding unit 12 of the image forming apparatus 1 is selected, an uppermost recording medium P accommodated in the first sheet feeding unit 12 is fed by a sheet feed roller 41 to a curved sheet conveying path in which a first pair of sheet conveying rollers 42 and a second pair of sheet conveying rollers 43 are disposed.

The recording medium P travels in the curved sheet conveying path toward a merging point X where the sheet conveying path of the recording medium P fed from the first sheet feeding unit 12 and respective sheet conveying paths of the recording medium P fed from the second sheet feeding unit 13 and the third sheet feeding unit 14 disposed outside an apparatus body of the image forming apparatus 1 merge.

After passing the merging point X, the uppermost recording medium P passes a straight sheet conveying path 103 in which a third pair of sheet conveying rollers 44 and a matching unit 51 are disposed, and reaches the matching unit 51. The straight sheet conveying path 103 is defined by straight conveying guide plates 114. The pair of sheet holding rollers 31, which is provided to the matching unit 51, corrects skew or inclination of the recording medium P in the sheet conveying direction and lateral shift of the recording medium P in a width direction, which is a direction perpendicular to the sheet conveying direction, so as to adjust the recording medium to a normal position. The recording medium P is then conveyed toward the transfer roller 7 in synchronization with movement of the toner image formed on the surface of the photoconductor drum 5 for positioning.

After completion of the transferring process, the recording medium P passes the transfer roller 7 and reaches the fixing device 20 via the sheet conveying path.

In the fixing device 20, the recording medium P is conveyed between the fixing roller 21 and the pressure roller 22, so that the toner image is fixed to the recording medium P by heat applied by the fixing roller 21 and pressure applied by the fixing roller 21 and the pressure roller 22. The recording medium P with the toner image fixed thereto passes a nip region formed between the fixing roller 21 and the pressure roller 22, and then exits from the image forming apparatus 1.

Accordingly, a series of image forming processes is completed.

As illustrated in FIG. 2, the image forming apparatus 1 according to the present example of this disclosure feeds the recording medium P from any selected one of the first sheet feeding unit 12, the second sheet feeding unit 13, and the third sheet feeding unit 14 toward the transfer roller 7.

Further, each of multiple pairs of conveying rollers including the first pair of sheet conveying rollers 42, the second pair of sheet conveying rollers 43, and the third pair of sheet conveying rollers 44 provided to the sheet conveying device 30 includes a driving roller and a driven roller as a pair. The driving roller is driven and rotated by a driving mechanism and a driven roller is rotated with the driving roller by a frictional resistance with the driving roller. According to this configuration, the recording medium P is conveyed while being held between these two rollers.

The transfer roller 7 contacts the photoconductor drum 5 in a transfer nip region with a given transfer bias applied thereto, rotates in a counterclockwise direction in FIG. 1, and the toner image borne on the surface of the photoconductor drum 5 is transferred onto the surface of the recording medium P while conveying the recording medium P held between the photoconductor drum 5 and the transfer roller 7.

Figure 3A:
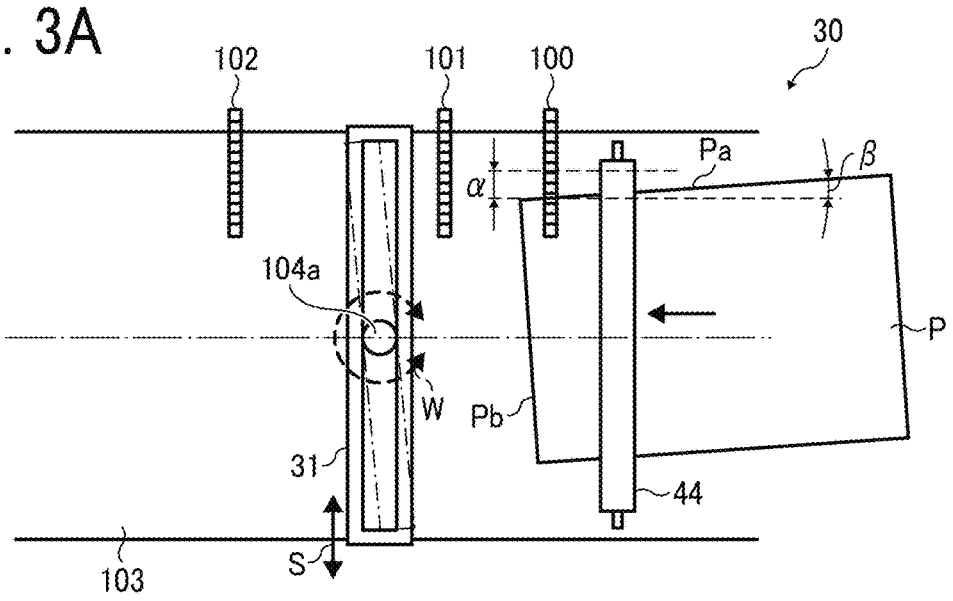
FIG. 3A is a top view illustrating the sheet conveying device and the units of FIG. 2.
Figure 3B:
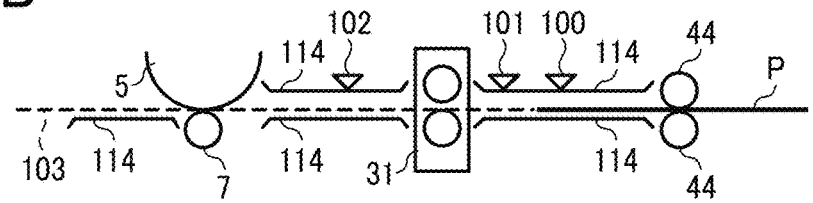
FIG. 3B is a side view illustrating the sheet conveying device and the units of FIG. 2.

As described above, the image forming apparatus 1 includes the linear conveying guide plate 103 that defines the straight sheet conveying path 103 extending substantially linearly along the sheet conveying direction of the recording medium P. The straight sheet conveying path 103 defined by the straight conveying guide plates 114 is a sheet conveying path from the merging point X, where a branched sheet conveying path from the first sheet feeding unit 12 and the other branched sheet conveying paths from the second sheet feeding unit 13 and the third sheet feeding unit 14 merge, to the transfer roller 7. As illustrated in FIGS. 3A and 3B, the straight conveying guide plates 114 hold both sides (front and back sides) of the recording medium P therebetween while the recording medium P is being conveyed. Multiple contact image sensors (hereinafter, a contact image sensor is referred to as a CIS) that are position detectors to detect the recording medium P at respective positions are disposed along the sheet conveying direction. Specifically, the third pair of sheet conveying rollers 44, a first CIS 100 that functions as a first detector, a second CIS 101 that functions as a second detector, the pair of sheet holding rollers 31, which is included in the matching unit 51 and functions as a position adjuster, and a third CIS 102 that functions as a third detector are disposed in this order to a downstream side in the sheet conveying direction.

The CIS is a linear image sensor that is recently used in order to reduce the size of an apparatus. One or more sets of light emitting diodes (LEDs) of a small size is used as a light source of the CIS. A lens provided in the CIS directs light from a surface of an original document onto a surface of the CIS so as to directly read image data of the original document.

However, the position detectors are not limited to the CIS and any sensor group can be applied to this disclosure as long as the sensor group has multiple sensors disposed along a width direction of the recording medium P and detects a side edge Pa at one end in the width direction of the recording medium P.

Each of the first CIS 100, the second CIS 101, and the third CIS 102 is disposed parallel to the width direction of the recording medium P. With respect to the sheet conveying direction of the recording medium P, the relative position of the first CIS 100, the second CIS 101, and the third CIS 102 and the positional relation thereof to adjacent parts and units such as the pair of sheet holding rollers 31 are previously determined.

Each of the third pair of sheet conveying rollers 44 and the pair of sheet holding rollers 31 is a roller pair having a driving roller and a driven roller and conveys the recording medium P while holding the recording medium P therebetween. The pair of sheet holding rollers 31 is included in the matching unit 51 to align positional shifts of the recording medium P, which are a lateral shift correction (an operation to correct a lateral shift by adjusting a lateral shift amount $\alpha$ in the width direction of the recording medium P) and a skew correction (an operation to correct skew, which is an angle deviation, by adjusting an inclination amount $\beta$ to an oblique side in the sheet conveying direction as illustrated in FIG. 3A). It is to be noted that the "lateral shift amount $\alpha$" indicates a distance (amount) of positional shift of the recording medium P shifted from a normal position thereof in the width (lateral) direction. It is also to be noted that both the "inclination amount $\beta$" and the "inclination angle $\beta$" indicate an angle (amount) inclination of positional shift of the recording medium P obliquely inclined or slanted with respect to the sheet conveying direction of the recording medium P.

Further, it is to be noted that the "positional shifts" includes the lateral shift and the angle deviation. Namely, the "lateral shift" is a shift in the width direction, i.e., a direction perpendicular to the sheet conveying direction and the "angle deviation" is a deviation in the sheet conveying direction or in a longitudinal direction that is basically perpendicular to the width (lateral) direction.

As illustrated in FIGS. 3A and 3B, the pair of sheet holding rollers 31 is a roller pair that has rollers divided in the width direction. Specifically, the pair of sheet holding rollers 31 includes a driving roller 31*a* and a driven roller 31*b*. The driving roller 31*a* is driven to rotate by a first driving motor 61 (see FIG. 4) that functions as a first driving unit. The driven roller 31*b* is rotated with the driving roller 31*a*. The pair of sheet holding rollers 31 conveys the recording medium P by rotating in a state in which the recording medium P is held between the driving roller 31*a* and the driven roller 31*b*.

As described above, the pair of sheet holding rollers 31 in the present example has rollers divided in the width direction thereof. However, the structure of a pair of sheet holding rollers is not limited thereto. For example, a pair of sheet holding rollers that is not divided in the width direction but extends over the whole width thereof can be applied to this disclosure.

In addition, the pair of sheet holding rollers 31 rotates about a shaft 104*a* in an oblique side in the sheet conveying direction W and moves in a width direction S.

Figure 4:
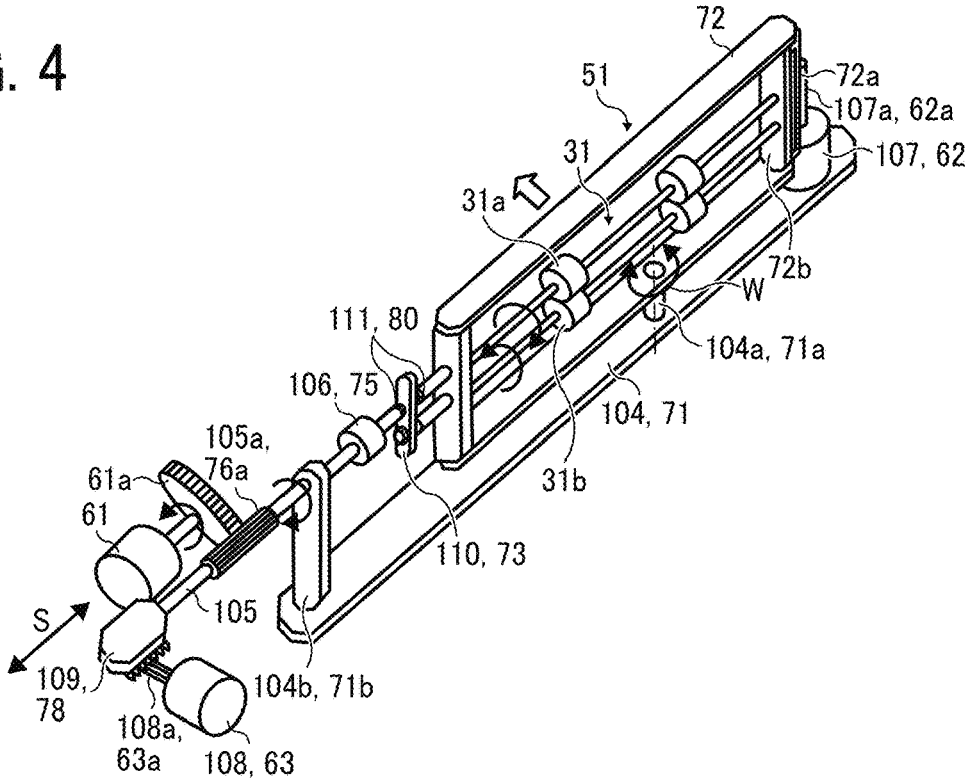
FIG. 4 is a perspective view illustrating a pair of sheet holding rollers according to an example of this disclosure.

Specifically, as illustrated in FIG. 4, the pair of sheet holding rollers 31 having the driving roller 31*a* and the driven roller 31*b* is driven to rotate by the first driving motor 61 that functions as a first driving unit, so as to convey the recording medium P while holding the recording medium P between the driving roller 31*a* and the driven roller 31*b*.

To be more specific, the first driving motor 61 is fixedly mounted on a frame of the sheet conveying device 30 of the image forming apparatus 1. The first driving motor 61 includes a motor shaft and a driving gear 61*a* that is mounted on the motor shaft. The driving gear 61*a* meshes with a gear unit 105*a* of a frame side rotary shaft 105 and rotates the frame side rotary shaft 105 in a direction indicated by arrow in FIG. 4. The gear unit 105*a* of the frame side rotary shaft 105 is rotationally supported to an uprising part 104*b* of a base 104 of the frame and is formed to have a substantially long facewidth in the width direction thereof. As the frame side rotary shaft 105 is driven and rotated, a rotational driving force applied by the rotation of the frame side rotary shaft 105 is transmitted to a rotary shaft of the driving roller 31*a* via a coupling 106. This transmission rotates the rotary shaft of the driving roller 31*a*. Accordingly, the driven roller 31*b* is rotated with the driving roller 31*a*.

The coupling 106 is disposed between the rotary shaft of the driving roller 31*a* and the frame side rotary shaft 105 rotationally supported by the base 104 of the frame of the sheet conveying device 30. The coupling 106 is a shaft coupling such as a constant velocity (universal) joint and a universal joint. With the coupling 106, when a second driving motor 107 is driven, the pair of sheet holding rollers 31 rotates together with a support 72. With this configuration, even if a shaft angle of the rotary shaft of the driving roller 31*a* and the frame side rotary shaft 105 is changed, a speed of rotation does not change, and therefore the rotational driving force is transmitted successfully.

The support 72 is a movable body having a substantially rectangular shape. The pair of sheet holding rollers 31 is rotationally supported by the support 72 and is movably supported in the width direction thereof. Specifically, both ends of the rotary shaft of each of the driving roller 31*a* and the driven roller 31*b* in the width direction are rotationally supported to the support 72 via respective bearings fixedly mounted on the support 72. Further, the driving roller 31*a* and the driven roller 31*b* are supported by the support 72 to be movable in the width direction (an extending direction of the rotary shafts) of the driving roller 31*a* and the driven roller 31*b*. Specifically, a sufficient gap is provided between a supporting part 72*b* disposed at one end of the support 72 and a gear 72*a*, so that the respective rotary shafts of the driving roller 31*a* and the driven roller 31*b* does not interfere with the gear 72*a* even if the driving roller 31*a* and the driven roller 31*b* slide to the one end in the width direction.

Further, the support 72 is rotationally supported about the shaft 104*a* to the base 104 that functions as part of the frame of the sheet conveying device 30 of the image forming apparatus 1. Further, the second driving motor (a rotary motor) 107 that functions as a second driving unit is fixedly mounted on one end in the width direction of the base 104. The second driving motor 107 has a motor shaft 107*a* on which a gear is mounted. The gear mounted on the motor shaft 107*a* meshes with the gear 72*a* that is disposed at one end in the width direction of the support 72. With this structure, as the second driving motor 107 drives to rotate in a forward direction or in a backward direction, the pair of sheet holding rollers 31 rotates about the shaft 104*a* to the oblique side in the sheet conveying direction W together with the support 72 as illustrated in FIG. 3A. The second driving motor 107 that functions as a second driving unit is driven to rotate the support 72 to the oblique side in the sheet conveying direction W together with the pair of sheet holding rollers 31 based on results detected by the respective CISs, which are the first CIS 100, the second CIS 101, and the third CIS 102.

It is to be noted that an encoder 120 is mounted on the motor shaft 107*a* of the second driving motor 107, so that degree and direction of rotation of the pair of sheet holding rollers 31 to the oblique side in the sheet conveying direction with respect to a reference position are detected indirectly. Accordingly, the pair of sheet holding rollers 31 can perform skew correction based on the results detected by the respective CISs.

It is to be noted that, in the present example, the pair of sheet holding rollers 31 rotates together with the support 72 about a center position in the width direction there. However, the configuration according to this disclosure is not limited thereto. For example, the configuration in which the pair of sheet holding rollers 31 rotates together with the support 72 about an end part in the width direction thereof can be applied to this disclosure.

A rack gear 109 is disposed at the other end in the width direction of the frame side rotary shaft 105 that is rotatably supported by the base 104 and meshes with a pinion gear that is mounted on a motor shaft 108*a* of a third driving motor (a shift motor) 108 that functions as a third driving unit. The rack gear 109 is rotationally disposed relative to the frame side rotary shaft 105 and is supported by the frame, so as to slide without rotating together with the frame side rotary shaft 105 in the width direction S along a guide rail that is formed on the frame of the sheet conveying device 30. Similar to the first driving motor 61 and the second driving motor 107, the third driving motor 108 is fixed to the frame of the sheet conveying device 30 of the image forming apparatus 1.

By contrast, a link 110 is disposed between the coupling 106 and a supporting part disposed at the other end of the support 72. The link 110 rotatably connects the driving roller 31*a* and the driven roller 31*b* so that the driving roller 31*a* and the driven roller 31*b* move together with each other in the width direction S. Specifically, the link 110 is held between retaining rings 111 disposed at respective gutters formed on the rotary shaft of the driving roller 31*a* and the rotary shaft of the driven roller 31*b*. As the driving roller 31*a* moves in the width direction, the driven roller 31*b* is moved together with the driving roller 31*a* in the width direction S by the same distance as the driving roller 31*a*.

With this configuration, the pair of sheet holding rollers 31 moves in the width direction S along with rotation of the third driving motor 108 in the forward and backward directions. The third driving motor 108 that functions as a third driving unit causes the pair of sheet holding rollers 31 to move together with the frame side rotary shaft 105 in the width direction based on the results detected by the respective CISs, which are the first CIS 100, the second CIS 101, and the third CIS 102, as described below.

It is to be noted that an encoder 130 is mounted on the motor shaft 108*a* of the third driving motor 108, so that degree and direction of rotation of the pair of sheet holding rollers 31 in the width direction with respect to the reference position are detected indirectly. Accordingly, the pair of sheet holding rollers 31 can perform the lateral shift correction based on the results detected by the respective CISs.

The third pair of sheet conveying rollers 44 is located at a position upstream from the pair of sheet holding rollers 31 in the sheet conveying direction. The third pair of sheet conveying rollers 44 is a pair of conveying rollers that can rotate and convey the recording medium P while holding the recording medium P therebetween. Further, rollers of the third pair of sheet conveying rollers 44 can separate to switch a sheet holding state in which the third pair of sheet conveying rollers 44 holds the recording medium P therebetween and a sheet releasing state in which the third pair of sheet conveying rollers 44 does not hold the recording medium P therebetween.

In the present example, the pair of sheet holding rollers 31 is disposed upstream from the transfer roller 7 in the sheet conveying path and is a pair of conveying rollers that also functions as a pair of registration rollers. By rotating while holding the recording medium P therebetween, the pair of sheet holding rollers 31 conveys the recording medium P (after the lateral shift correction and the skew correction) to the image forming part 4.

The first driving motor 61 that rotates the driving roller 31*a* of the pair of sheet holding rollers 31 functions as a driving motor with variable number of rotations to change a speed of conveyance of the recording medium P. Then, when a sheet detecting sensor that is a photosensor such as the second CIS 101 detects the timing of arrival of the recording medium P at the pair of sheet holding rollers 31, that is, when the recording medium P is conveyed to the pair of sheet holding rollers 31 and the pair of sheet holding rollers 31 detects a state in which the recording medium P is held between the driving roller 31*a* and the driven roller 31*b*, the pair of sheet holding rollers 31 performs a desired lateral shift correction and skew correction. Further, the speed of conveyance of the recording medium P conveyed by the pair of sheet holding rollers 31 is changed based on detection results, i.e., the detected timing, obtained by the sheet detecting sensor. Specifically, in order to synchronize the timing at which the pair of sheet holding rollers 31 conveys the recording medium P to the transfer roller 7 and the timing at which the toner image formed on the surface of the photoconductor drum 5 reaches the transfer roller 7, the speed of conveyance of the recording medium P conveyed by the pair of sheet holding rollers 31 is varied, that is, the timing to convey the recording medium P is conveyed toward the image forming part 4 is adjusted. By so doing, the pair of sheet holding rollers 31 can convey the recording medium P to the image forming part 4 disposed downstream therefrom in the sheet conveying direction while performing the lateral shift correction and the skew correction of the recording medium P without stopping the conveyance of the recording medium P.

It is to be noted that, immediately after a leading edge Pb that is a leading part of the recording medium P in the sheet conveying direction has reached the image forming part 4, the speed of conveyance of the recording medium P conveyed by the pair of sheet holding rollers 31 is adjusted, so as not to cause a linear velocity difference with the photoconductor drum 5 to result in distortion of the toner image to be transferred onto the recording medium P, in other words, so as to cause the linear velocity difference with the photoconductor drum 5 to be 1.

Next, a description is given of a series of operation flow showing conveyance of the recording medium P, with reference to FIGS. 3 and 5A through 12. Specifically, the operation flow shows how the recording medium P is conveyed to the sheet conveying device 30, adjusted by the lateral shift correction and the skew correction, and conveyed further to the image forming part 4 disposed at the downstream side in the sheet conveying direction. FIGS. 5A, 6A, 7A, 8A, and 9A are top views illustrating the sheet conveying device 30 and adjacent units. FIGS. 5B, 6B, 7B, 8B, and 9B are side views illustrating the sheet conveying device 30 and the adjacent units.

The recording medium P fed from a selected one of the first sheet feeding unit 12, the second sheet feeding unit 13, and the third sheet feeding unit 14 is conveyed by the third pair of sheet conveying rollers 44 to the further downstream side, as illustrated in FIG. 3. The recording medium P passes the first CIS 100, and then the leading edge Pb thereof reaches the second CIS 101, as illustrated in FIG. 5.

Upon arrival of the leading edge Pb of the recording medium P to the second CIS 101, the lateral shift amount $\alpha$ in the width direction of the recording medium P and the inclination amount $\beta$ to the oblique side in the sheet conveying direction are detected. Hereinafter, this operation is referred to as a primary detection.

Figure 10:
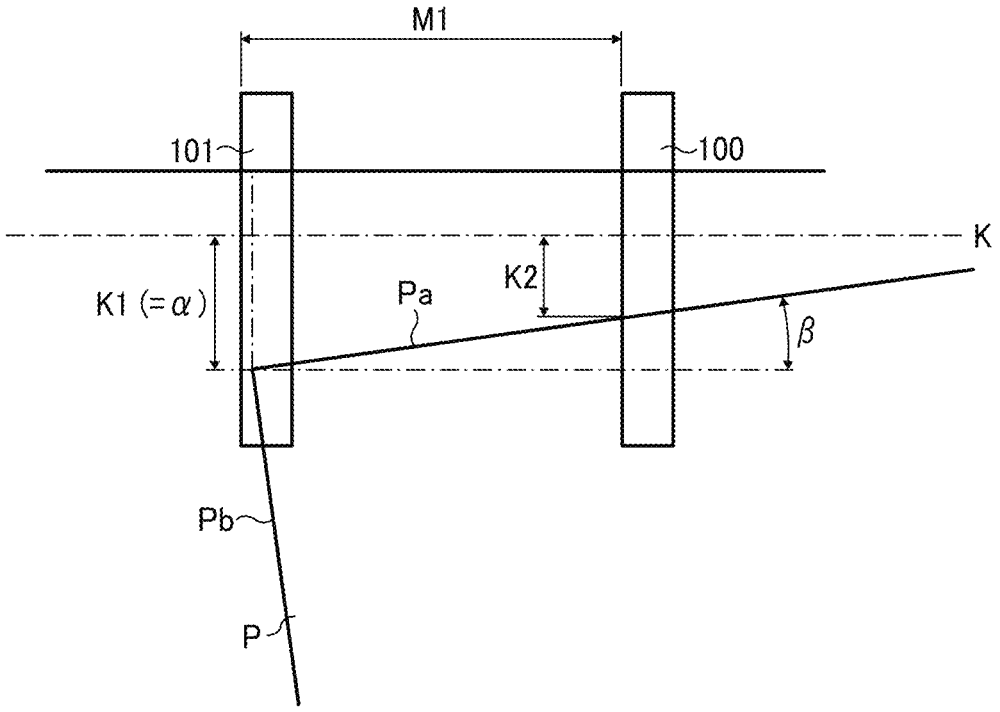
FIG. 10 is a schematic diagram illustrating the sheet conveying device with parameters used to calculate a positional shift of a recording medium.

Specifically, the first CIS 100, the second CIS 101, and the third CIS 102 can detect a position (the side edge Pa) of the recording medium P in the width direction by using multiple line sensors disposed along the width direction of the recording medium P, and therefore the amount (distance) of positional shift of the recording medium P in the width direction. Specifically, as illustrated in FIG. 10, a distance K1 shifted from a parallel line K with respect to the sheet conveying direction of the recording medium P corresponds to the lateral shift amount $\alpha$ of the recording medium P in the width direction. The distance K1 is detected by the second CIS 101. The parallel line K represents an ideal position in the width direction of the recording medium P and is, hereinafter, referred to as a "reference line K".

Further, since the positional relation of the first CIS 100, the second CIS 101, and the third CIS 102 is previously determined, the inclination angle $\beta$ with respect to the recording medium P can be calculated based on a difference of respective positions of the edge in the width direction of the recording medium P detected by the first CIS 100 and the second CIS 101.

Specifically, at the point when the leading edge Pb of the recording medium P arrives the second CIS 101, both a distance K1 and a distance K2 from the reference line K are detected by the first CIS 100 and the second CIS 101, respectively. Then, since a distance M1 between the first CIS 100 and the second CIS 101 is previously determined, the inclination angle $\beta$ with respect to the sheet conveying direction of the recording medium P can be obtained by an equation, $\tan \beta = (K1 - K2)/M1$.

Figure 11:
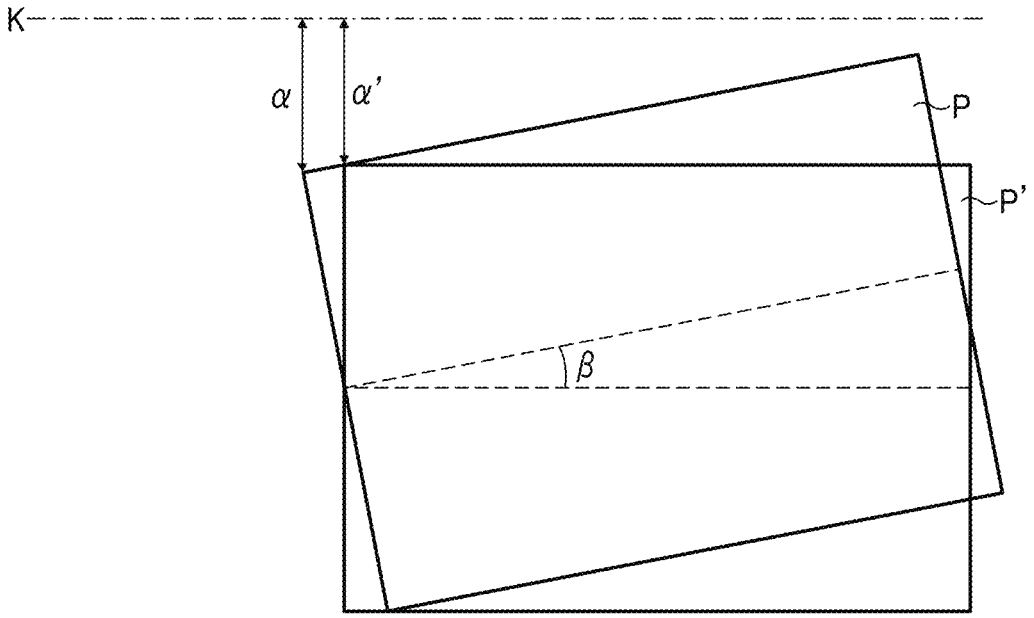
FIG. 11 is a schematic diagram illustrating an amount of correction of the recording medium in a width direction.

Based on the lateral shift amount $\alpha$ and the inclination amount $\beta$ in the width direction of the recording medium P obtained as described above, the pair of sheet holding rollers 31 performs the lateral shift correction and the skew correction of the recording medium P, which is hereinafter referred to as a "primary correction" or a "primary movement". Further, hereinafter, the lateral shift and the inclination in the width direction of the recording medium P are also referred to simply as "positional shifts" and the lateral shift amount $\alpha$ and the inclination amount $\beta$ (the inclination angle $\beta$) in the width direction of the recording medium P are also referred to simply as "positional shift amounts". An amount of skew correction equals to the angle of inclination that is the inclination amount $\rho$. Further, an amount of correction in the width direction is calculated based on the lateral shift amount $\alpha$ in the width direction and the inclination amount $\beta$ of the recording medium P. For example, as illustrated in FIG. 11, after the inclination angle $\beta$ is corrected, the posture of the recording medium P changes to the recording medium P' and the lateral shift amount $\alpha$ in the width direction changes a lateral shift amount $\alpha'$. The calculated lateral shift amount $\alpha'$ is also a lateral correction amount $\alpha'$ in the width direction to be corrected by the pair of sheet holding rollers 31. However, the lateral correction amount $\alpha'$ varies depending on a reference position of correction of the inclination angle $\beta$.

Figure 12:
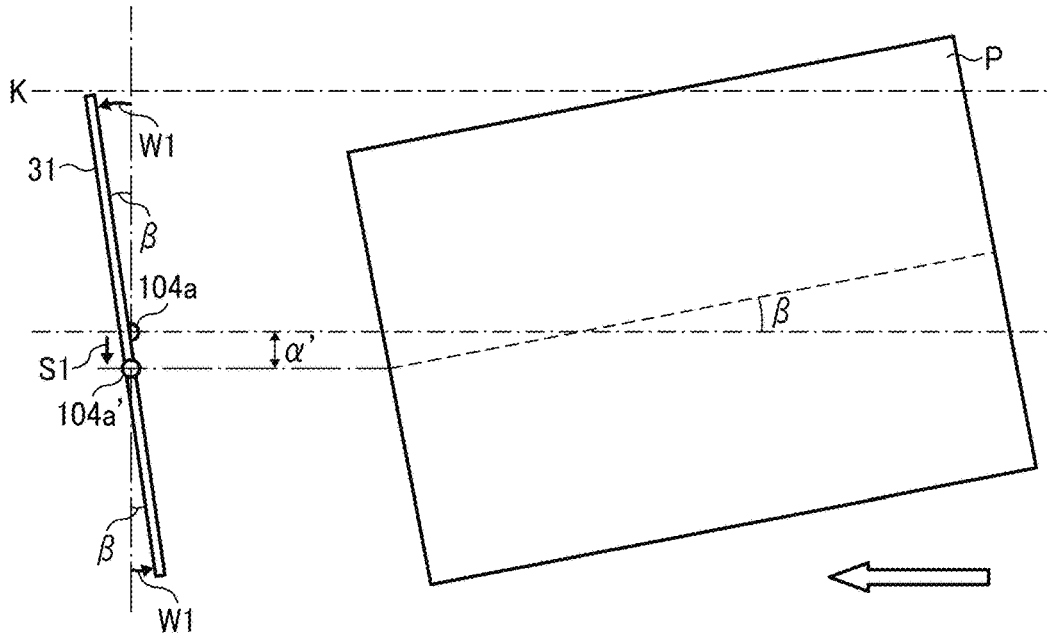
FIG. 12 is a schematic diagram illustrating the pair of sheet holding rollers that is ready (for a sheet receiving operation in a state) to receive the recording medium.

The pair of sheet holding rollers 31 is disposed at a reference position illustrated in FIG. 3A prior to the primary detection. Until the recording medium P is conveyed to the pair of sheet holding rollers 31, the pair of sheet holding rollers 31 moves in an opposite direction to the direction of the primary correction by the amount obtained by the primary correction. Specifically, as illustrated in FIG. 12, before holding the recording medium P between the driving roller 31*a* and the driven roller 31*b*, the pair of sheet holding rollers 31 rotates about the shaft 104*a* in a direction W1 by the inclination amount $\beta$ and moves in a direction S1 by the lateral shift amount $\alpha'$. By so doing, the shaft 104*a* moves to a shaft 104*a'*.

The above-described series of operations is hereinafter referred to as a sheet receiving operation of the pair of sheet holding rollers 31. Due to the sheet receiving operation, the pair of sheet holding rollers 31 is moved to the opposite direction to a direction moved by correction, so that the pair of sheet holding rollers 31 after the primary correction can be returned to the reference position. Therefore, after completion of the position of the recording medium P, the pair of sheet holding rollers 31 is located closer to the reference position. However, due to a below-described secondary correction, the pair of sheet holding rollers 31 does not usually return to the reference position. Consequently, the recording medium P can be conveyed to the transfer roller 7 that is disposed in the downstream side in a state in which the pair of sheet holding rollers 31 is located facing the sheet conveying direction of the recording medium P. Further, the posture of the pair of sheet holding rollers 31 after the position adjustment does not change significantly depending on the amount of positional shift of the recording medium P, the pair of sheet holding rollers 31 can convey the recording medium P to the transfer roller 7 disposed downstream therefrom in a more stable posture.

Figure 5A:
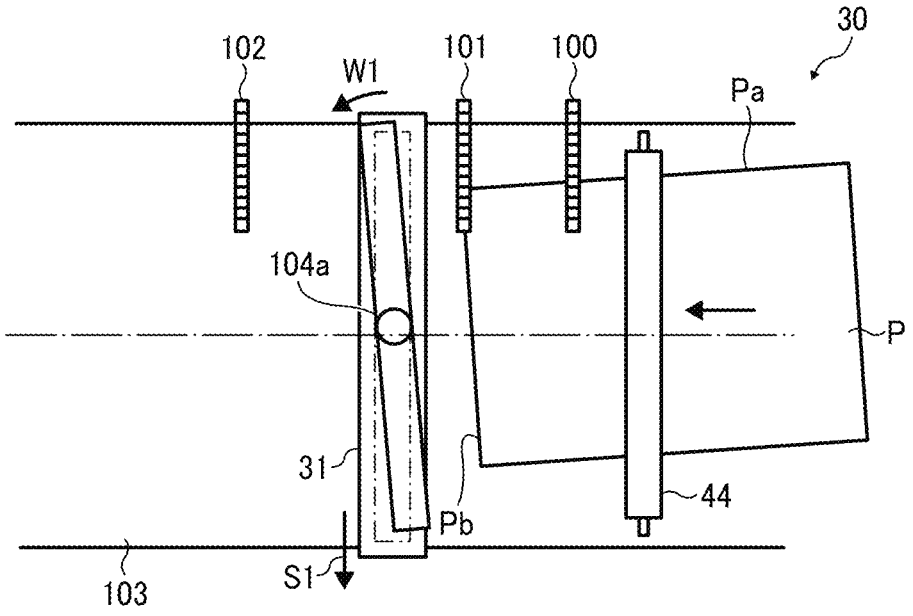
FIG. 5A is a top view illustrating the sheet conveying device and the units of FIG. 2.
Figure 5B:
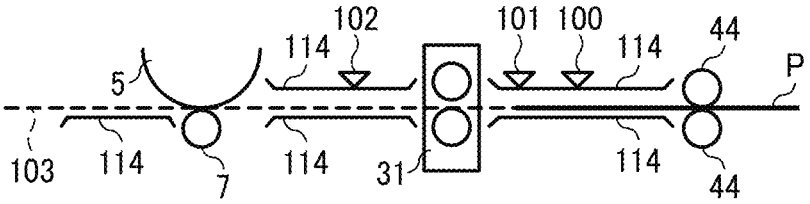
FIG. 5B is a side view illustrating the sheet conveying device and the units of FIG. 2.

The pair of sheet holding rollers 31 performs the above-described sheet receiving operation after the primary detection until the pair of sheet holding rollers 31 holds the recording medium P between the driving roller 31*a* and the driven roller 31*b*, as illustrated in FIGS. 5A and 5B.

Figure 6A:
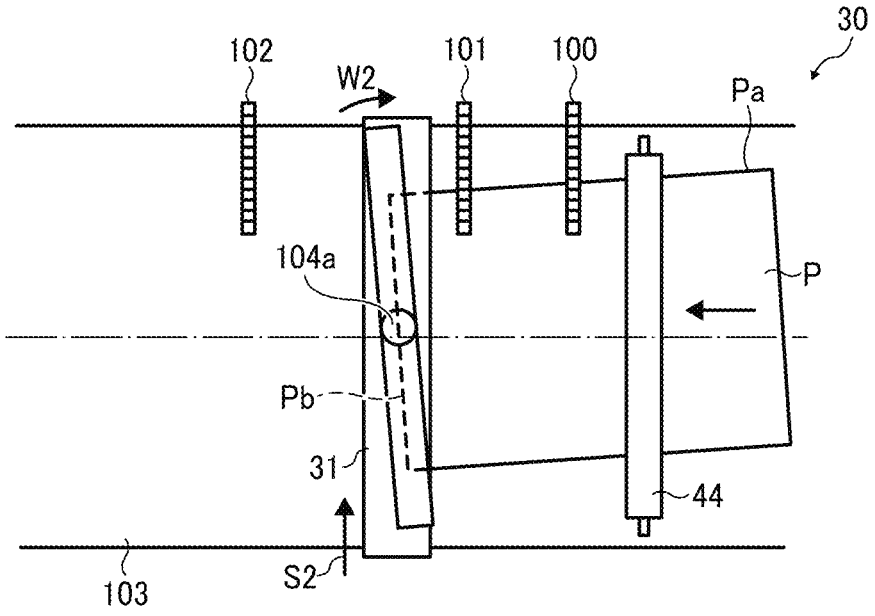
FIG. 6A is a top view illustrating the sheet conveying device and the units of FIG. 2.
Figure 6B:
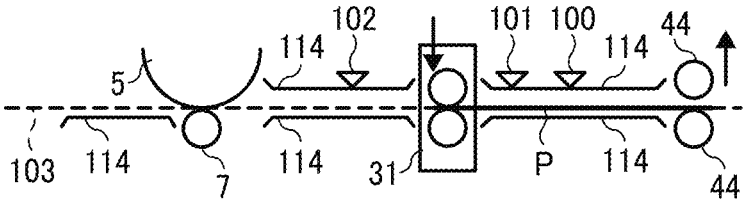
FIG. 6B is a side view illustrating the sheet conveying device and the units of FIG. 2.

Then, when the leading edge Pb of the recording medium P reaches the pair of sheet holding rollers 31, the pair of sheet holding rollers 31 holds the recording medium P, as illustrated in FIGS. 6A and 6B. At this time, as illustrated in FIG. 6B, the third pair of sheet conveying rollers 44 is separated from the straight sheet conveying path 103 defined by the straight conveying guide plates 114 and therefore the recording medium P is released from the third pair of sheet conveying rollers 44.

As illustrated in FIG. 6A, upon the start of the primary correction, the pair of sheet holding rollers 31 holds and conveys the recording medium P. At this time, based on the positional shift of the recording medium P obtained by the primary detection, the pair of sheet holding rollers 31 corrects the positional shift to the oblique side in the sheet conveying direction of the recording medium P by rotating about the shaft 104*a* in a direction W2 indicated by arrow in FIG. 6A and the positional shift in the width direction of the recording medium P by moving the recording medium P in parallel in a direction S2.

Figure 7A:
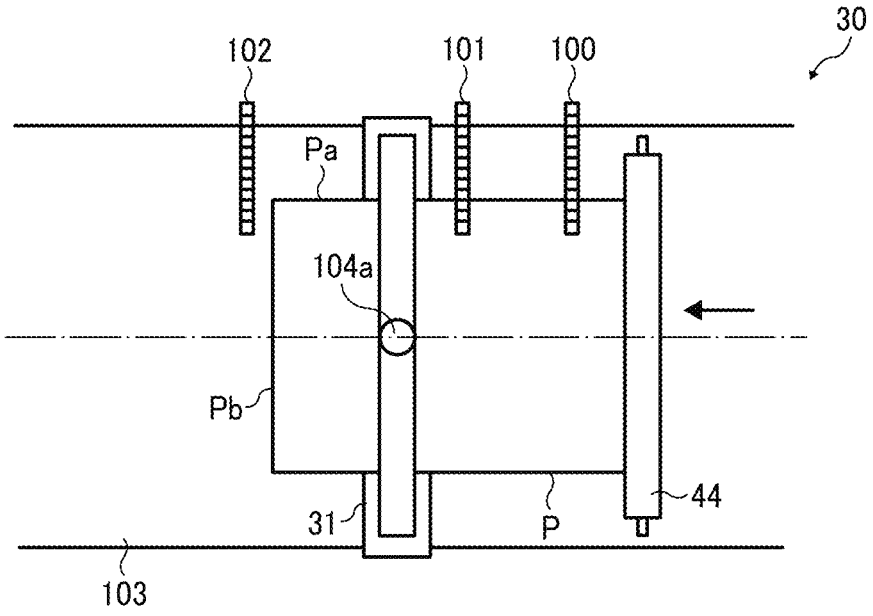
FIG. 7A is a top view illustrating the sheet conveying device and the units of FIG. 2.
Figure 7B:
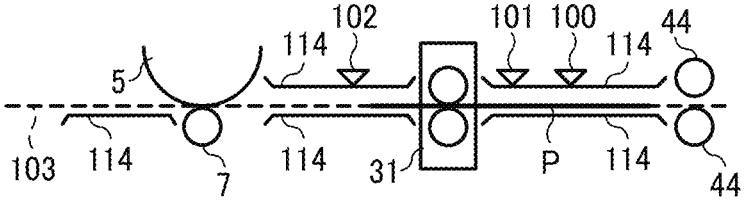
FIG. 7B is a side view illustrating the sheet conveying device and the units of FIG. 2.

Accordingly, the primary correction by the pair of sheet holding rollers 31 is completed, and the positional shifts of the recording medium P is corrected, as illustrated in FIGS. 7A and 7B.

Figure 13:
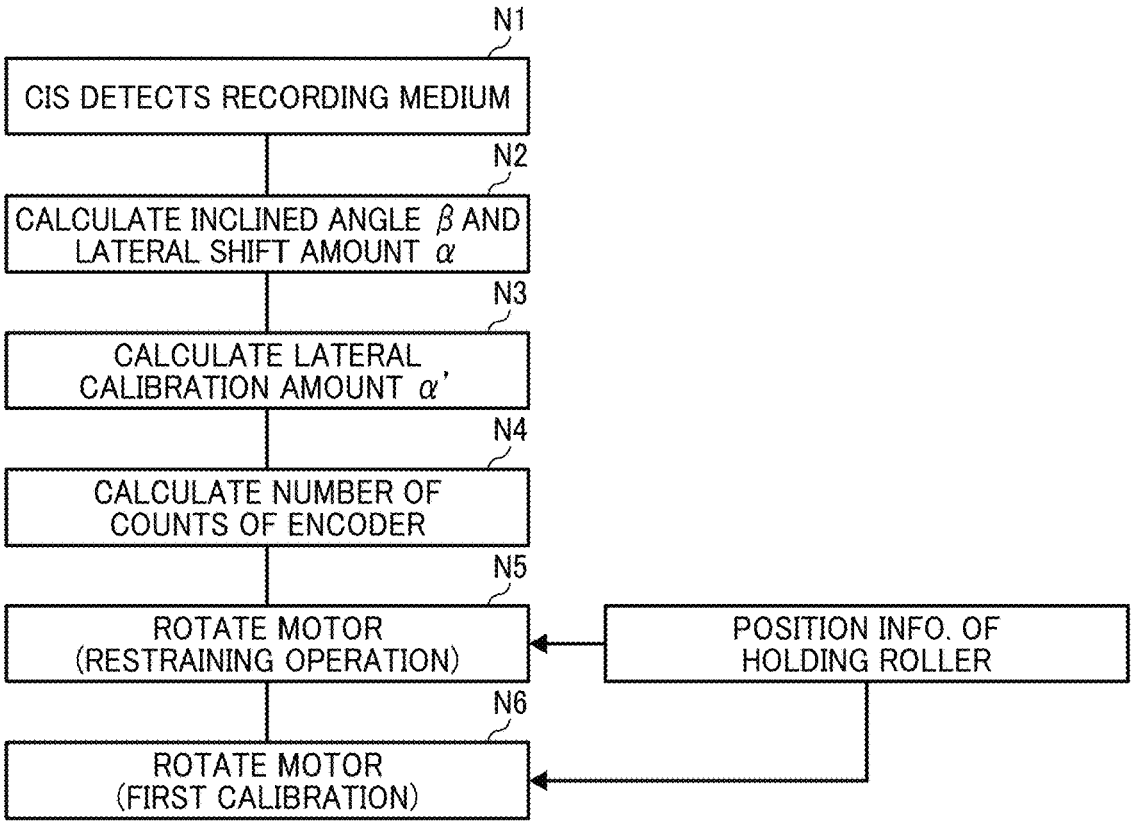
FIG. 13 is a flowchart showing control of an operation flow from detection of the recording medium to a primary correction.
Figure 14:
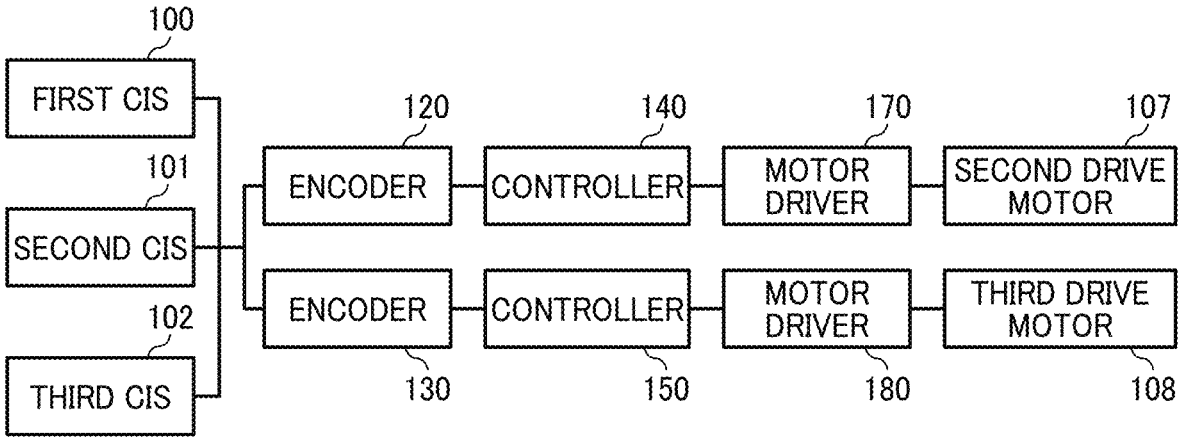
FIG. 14 is a block diagram illustrating controllers to drive the pair of sheet holding rollers.

FIG. 13 is a flowchart showing control of an operation flow from detection of the recording medium P to a primary correction. FIG. 14 is a block diagram illustrating controllers to drive the pair of sheet holding rollers 31.

As illustrated in FIG. 13, in the primary detection, the first CIS 100 and the second CIS 101 detect the recording medium Pin step N1. Then, the lateral shift amount $\alpha$ and the inclination amount $\beta$ are detected in step N2. Based on the results of the primary detection, the lateral correction amount $\alpha'$ in the width direction is calculated in step N3, so that primary correction amounts, which are the inclination amount $\beta$ and the lateral correction amount $\alpha'$, are determined.

Based on the primary correction amounts, the number of counts of each of encoders, i.e., the encoders 120 and 130 illustrated in FIG. 14, is calculated in step N4.

The calculated numbers of counts of the encoders 120 and 130 are input to the controllers 140 and 150 to drive the pair of sheet holding rollers 31. According to the inputted numbers of count of the encoders 120 and 130, respective motor drivers 170 and 180 drive the second driving motor 107 and the third driving motor 108. By moving the support 72 and turning the rack gear 109 illustrated in FIG. 4, the sheet receiving operation starts in step N5.

After the pair of sheet holding rollers 31 holds the recording medium P therebetween, the driving of the second driving motor 107 and the third driving motor 108 causes the pair of sheet holding rollers 31 to rotate or move in parallel in the width direction, so that the primary correction is performed in step N6. In the sheet receiving operation and the primary correction, encoders 120 and 130 feedback the position information of the pair of sheet holding rollers 31, so that the pair of sheet holding rollers 31 moves by given amounts of movement.

In the primary correction according to the present example, the productivity of the image forming apparatus 1 can be significantly enhanced, when compared with an operation in which the lateral shift correction and the skew correction are performed separately while the recording medium P is stopped.

As described above, the configuration according to the present example provides the primary correction to conduct a positional adjustment of the recording medium P. However, a single correcting operation such as the primary correction may not obtain the sufficient positional precision to the recording medium P.

Figure 15:
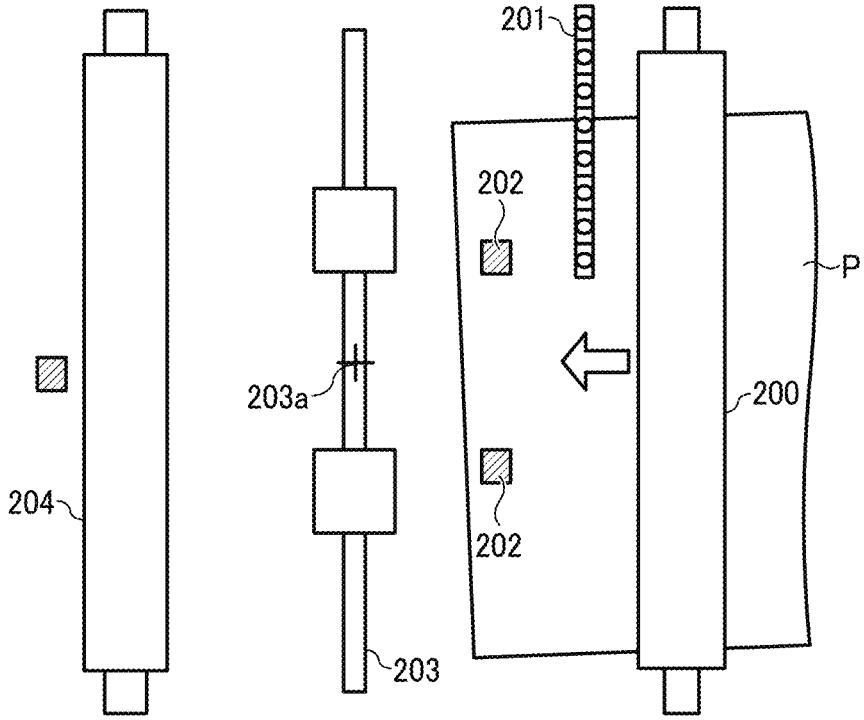
FIG. 15 is a schematic diagram illustrating a sheet conveying operation of a comparative sheet conveying device.

FIG. 15 is a schematic diagram illustrating a sheet conveying operation of a comparative sheet conveying device.

As illustrated in FIG. 15, a CIS 201 detects a lateral shift or deviation of a recording medium P that is conveyed by a pair of conveying rollers 200 in the width direction and a pair of skew detection sensors 202 detects an inclination (skew) of the recording medium P inclined in the sheet conveying direction. A pair of sheet holding rollers 203 is rotated about a shaft 203*a* thereof and moved (shifted) in the width direction simultaneously with the rotation, so that the positional shifts of the recording medium in these directions are corrected. The recording medium P after correction of the positional shifts is further conveyed by a pair of timing rollers 204 in a downstream direction for a transferring process.

Specifically, as illustrated in FIG. 15, the primary correction of the recording medium P is performed based on the amounts of positional shifts of the recording medium P obtained in the primary detection. However, after completion of the primary detection, the recording medium P is conveyed while being held between the pair of sheet holding rollers 203. At this time, a force is applied from the pair of sheet holding rollers 203 to the recording medium P, and therefore the position of the recording medium P may shift again. Further, when the pair of sheet holding rollers 203 further adjusts the position of the recording medium P and conveys the recording medium P to the downstream side, the position of the recording medium P can shift. In addition, any correction error can occur in the primary correction.

Accordingly, there may be a positional shift or positional shifts of the recording medium P that cannot be corrected by the primary correction alone.

In order to address this inconvenience, the sheet conveying device 30 according to the present example of this disclosure performs the secondary correction after the primary correction. The secondary correction is another positional adjustment to the recording medium P conducted after the primary correction.

A description is given of details of the secondary correction.

It is to be noted that the secondary correction is also referred to as the "primary movement" occasionally.

As illustrated in FIG. 8, upon arrival of the leading edge Pb of the recording medium P to the third CIS 102, the third CIS 102 and the second CIS 101 detect the inclination amount of the recording medium P to the oblique side in the sheet conveying direction and lateral shift amount in the width direction of the recording medium P again. Hereinafter, a series of these operations is referred to as a second detection.

The positional shift amounts of the recording medium P by the second detection are obtained by the same method as the primary detection by using two CISs, one of which is disposed upstream from the recording medium in the sheet conveying direction and the other of which is disposed downstream therefrom. Specifically, the second CIS 101 and the third CIS 102 detect the side edge Pa in the width direction of the recording medium P, and then detect the respective positional shift amounts. Based on the detection results and the positional relation of the second CIS 101 and the third CIS 102, the above-described inclination amount of the recording medium P can be calculated. To be more specific, instead of the first CIS 100 and the second CIS 101 in the primary detection, the second CIS 101 and the third CIS 102 are used in the secondary detection to detect the positional shift amount of the recording medium P. Further, the secondary detection is performed at the same timing as the primary detection, i.e., at the timing the recording medium P reaches a downstream side CIS, which is the third CIS 102 in the secondary transfer.

Figure 8A:
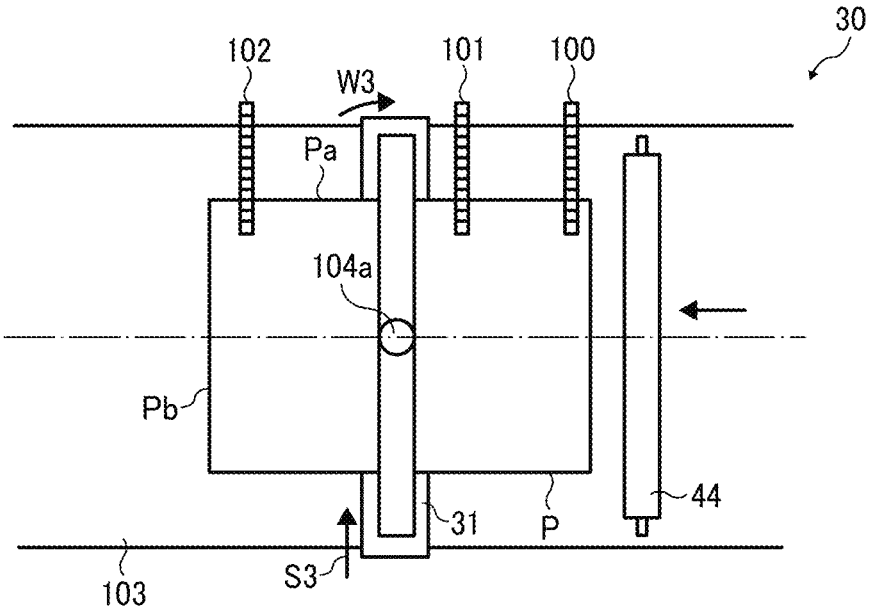
FIG. 8A is a top view illustrating the sheet conveying device and the units of FIG. 2.
Figure 8B:
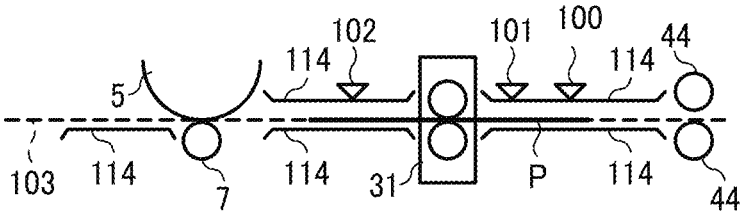
FIG. 8B is a side view illustrating the sheet conveying device and the units of FIG. 2.

Then, based on the positional shift amount of the recording medium P detected by the secondary detection, the pair of sheet holding rollers 31 is moved in parallel and rotated to perform the lateral shift correction and the skew correction, which is the same operation as the primary correction. Hereinafter, the series of these operations is referred to as a secondary correction. As illustrated in FIG. 8A, in the secondary correction, while conveying the recording medium P, the pair of sheet holding rollers 31 moves in a direction indicated by arrow S3 and rotates about the shaft 104*a* in a direction indicated by arrow W3.

Figure 16:
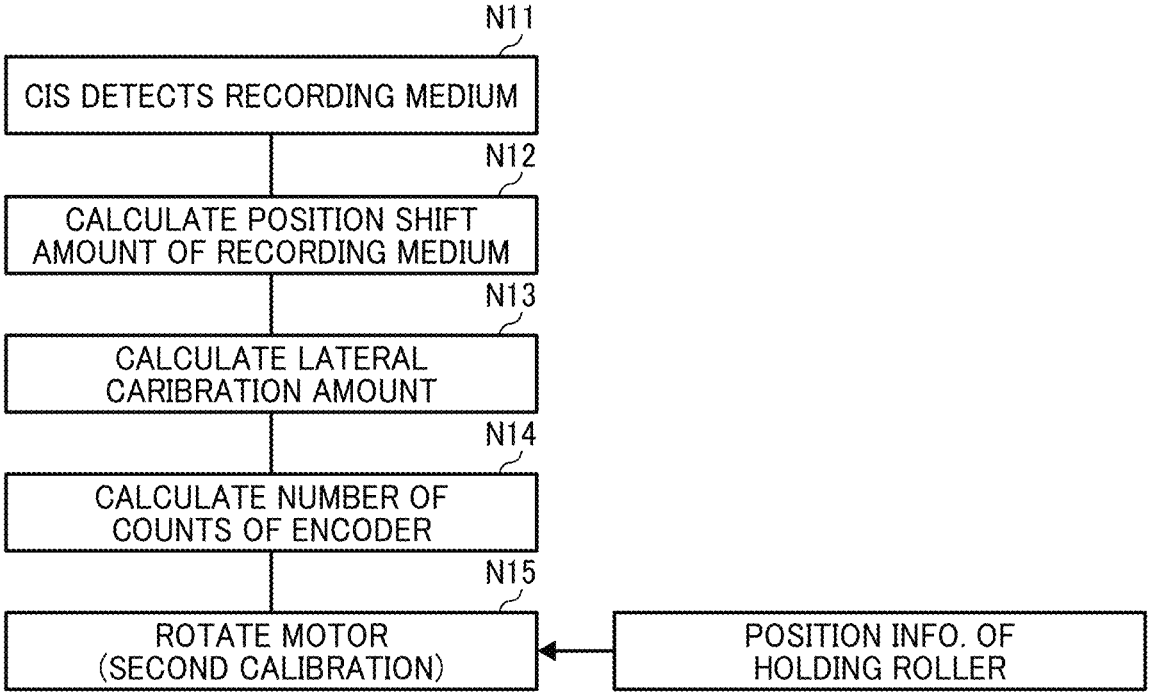
FIG. 16 is a flowchart showing control of an operation flow of a secondary correction.

The flowchart of the control of the above-described secondary correction is shown in FIG. 16.

In the secondary correction, the second CIS 101 and the third CIS 102 detect the recording medium Pin step N11. Then, in the same method as the primary correction, the lateral shift amount of the recording medium P is calculated in step N12. Then, based on the calculated lateral shift amount, the correction amount in the width direction is calculated in step N13. Then, the numbers of counts of the encoders 120 and 130 are calculated in step N14. According to the calculated numbers of counts of the encoders 120 and 130, the motor drivers 170 and 180 drive the second driving motor 107 and the third driving motor 108, respectively, to perform the secondary correction in step N15.

In the secondary correction, the position information of the recording medium P from moment to moment is detected by the second CIS 101 and the third CIS 102 since the start of the secondary correction. Based on the position information of the recording medium P, the positional shift amounts of the recording medium P are calculated and are fed back to the controllers 140 and 150, so that the correction amounts of positional shifts of the recording medium P (i.e., the numbers of counts of the encoders 120 and 130) are adjusted from moment to moment. By performing this feedback control, the lateral shift of the recording medium P and correction errors occurred in the secondary correction can be adjusted, and therefore more precise correction can be performed. However, the secondary correction can be performed based on the calculated correction amounts obtained upon arrival of the leading edge Pb of the recording medium P to the third CIS 102.

As described above, the primary detection and the second detection of the sheet conveying device 30 according to an example of this disclosure share the same method in which two CISs, that is, an upstream side CIS and a downstream side CIS in the sheet conveying direction of the recording medium P detect the lateral shift amount of the recording medium P. Therefore, the detection timing of the recording medium P, which is when the leading edge Pb thereof reaches the downstream side CIS, is identical to each other.

Further, both the primary correction and the secondary correction use the same reference line K as the identical standard in calculation of the lateral shift amount of the recording medium P in the width direction. In addition, both the primary correction and the secondary correction use a difference of lateral shift amounts $\alpha$ from the reference line K in the width direction, detected by the upstream side CIS and the downstream side CIS, to calculate the inclination amount $\beta$ of the recording medium P from the sheet conveying direction, which are the distances K1 and K2 in FIG. 10, and obtain the inclination amount $\beta$ from the parallel line, i.e., the reference line K with respect to the width direction of the recording medium P.

Figure 17:
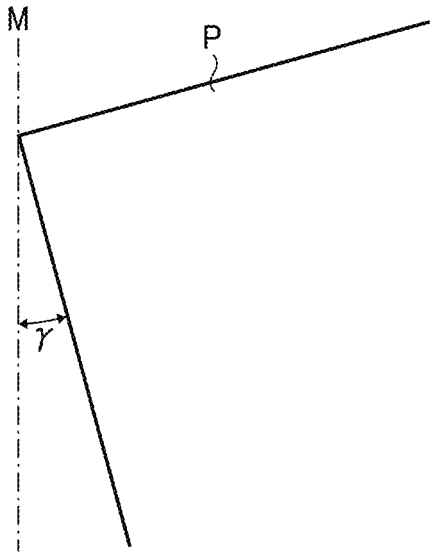
FIG. 17 is a schematic diagram illustrating an amount of inclination of the recording medium with respect to a parallel line to a width direction of the recording medium.

As described above, the present example of this disclosure uses the method of obtaining the inclination amount of the recording medium P from the sheet conveying direction based on the reference line K that is parallel to the sheet conveying direction of the recording medium P. However, the method of obtaining the inclination amount of the recording medium P is not limited thereto. For example, as illustrated in FIG. 17, a method of obtaining an inclination angle (an inclination amount) $\gamma$ of the recording medium P based on a reference line M that is parallel to the width direction of the recording medium P can be applied.

Figure 18:
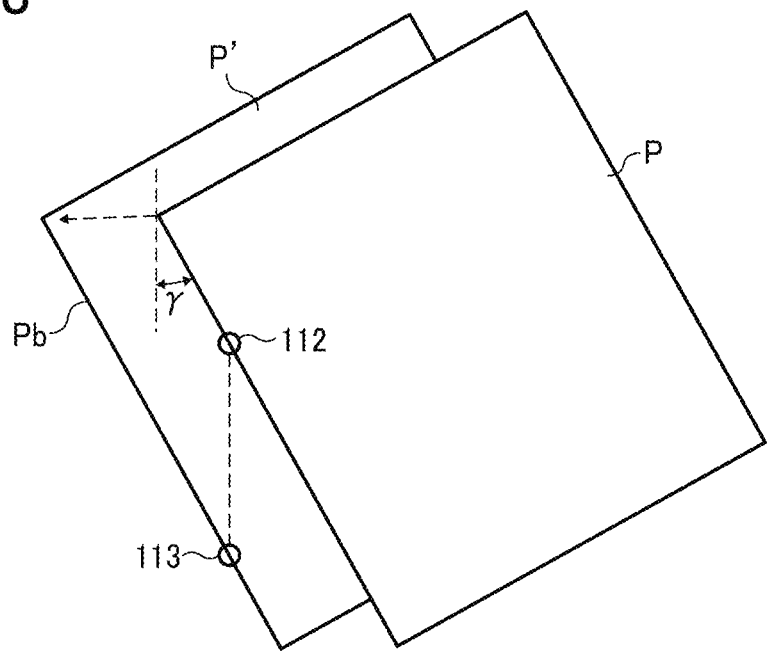
FIG. 18 is a schematic diagram illustrating how the amount of inclination of the recording medium is calculated.

For example, as illustrated in FIG. 18, as the method of obtaining the inclination angle $\gamma$ of the recording medium P based on the reference line M with respect to the width direction of the recording medium, two sensors 112 and 113 disposed spaced apart in the width direction at the same position in the sheet conveying direction of the recording medium P are used to obtain the inclination angle $\gamma$ based on a time difference of detecting the leading edge Pb of the recording medium P. Specifically, when the recording medium P is slanted to the sheet conveying direction as illustrated in FIG. 18, the sensor 112 detects the leading edge Pb of the recording medium P upon arrival of the recording medium P. Then, upon arrival of the recording medium P to the position of the recording medium P' illustrated in FIG. 18, the sensor 113 detects the leading edge Pb thereof. Based on the time difference of detection of the sensors 112 and 113 and the speed of conveyance of the recording medium P, the inclination angle $\gamma$ based on the reference line M with respect to the width direction of the recording medium P can be calculated. In this case, the inclination angle $\gamma$ is an inclination amount with respect to the width direction of the recording medium P.

Both of the above-described methods can obtain the same result in a case in which the recording medium P is rectangular. However, the shape of the recording medium P is not strictly rectangular in general due to distortion on the shape caused by various dimensions, pressure applied to the recording medium P in conveyance, temperature and humidity environment, and so forth.

Figure 19:
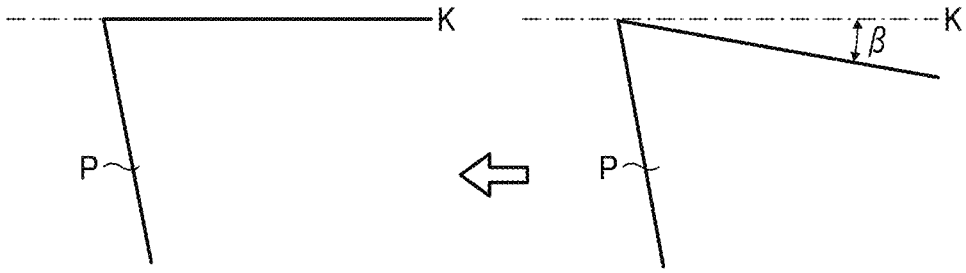
FIG. 19 is a schematic diagram illustrating how the amount of inclination of the recording medium is corrected.
Figure 20:
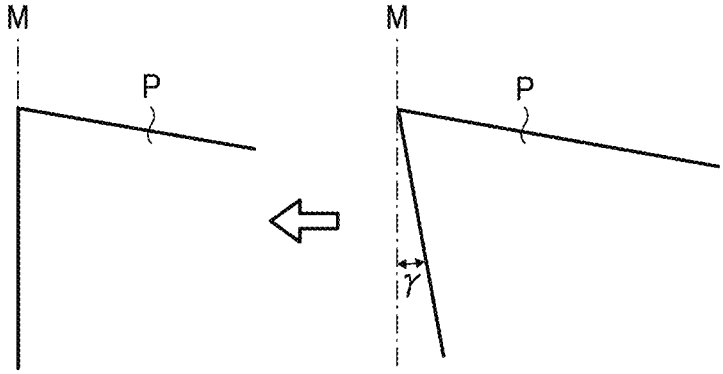
FIG. 20 is a schematic diagram illustrating how the amount of inclination of the recording medium is corrected.

Due to the above-described reasons, the position of the recording medium P is different between the recording medium P after the positional adjustment based on the reference line K with respect to the sheet conveying direction (as illustrated on the left side in FIG. 19) and the recording medium P after the positional adjustment based on the reference line M with respect to the width direction of the recording medium P (as illustrated on the left side in FIG. 20). The different positions of the recording medium P are the results of positional adjustment based on different correction amounts by the pair of sheet holding rollers 31.

Therefore, if a standard of correction in the primary correction is different from a standard of correction in the secondary correction, for example, if the primary correction is performed by the method described with FIG. 19 and the secondary correction is performed by the method described with FIG. 20, since different standards are employed in the primary correction and the secondary correction, a difference of correction amount obtained in the secondary correction based on the reference line M is added to the secondary correction based the reference line K, and therefore the correction amount is increased in the secondary correction.

Further, the secondary correction is to be performed between arrival of the leading edge Pb of the recording medium P to the third CIS 102 and completion of separation of the recording medium P from the pair of sheet holding rollers 31. If the correction amount in the secondary correction is increased as described above, it is likely that the secondary correction cannot be completed before separation of the recording medium P from the pair of sheet holding rollers 31.

By contrast, the sheet conveying device 30 according to the present example, since the identical reference position for obtaining the positional shift amounts of the recording medium P is employed to the primary correction and the secondary correction as described above, the correction amount in the secondary correction can be reduced, and therefore the time taken for the secondary correction can also be reduced. Consequently, it is easier to complete the secondary correction before the recording medium P separates from the pair of sheet holding rollers 31.

In the secondary correction described above, the positional corrections of the recording medium P are performed not only based on the positional shift amounts of the recording medium P detected at a given position (for example, the position where the leading edge Pb of the recording medium P reaches the third CIS 102) but also based on the feedback control to feedback the positional shift amount of the recording medium P continuously detected while being conveyed and adjust the correction amount by the pair of sheet holding rollers 31. Specifically, after the leading edge Pb of the recording medium P has arrived to the third CIS 102, the second CIS 101 and the third CIS 102 detect the positional shift amounts of the recording medium P from moment to moment. Then, the positional shift amounts are fed back to the pair of sheet holding rollers 31, so that a target value of the correction amount is adjusted. With this operation, the correction amount can be adjusted each time by considering the lateral shift amount of the recording medium P and correction errors occurred in the process of the secondary correction, and therefore more precise correction can be performed.

It is to be noted that the method of positional correction is not limited thereto. For example, the feedback control can be performed by feeding back the positional shift amount of the recording medium P detected from moment to moment by the first CIS 100 and the second CIS 101, obtained between the primary correction and the secondary correction, that is, after the correction based on the positional shift amount detected by the primary detection is performed and before the secondary correction is performed upon arrival of the recording medium P to the third CIS 102.

Alternatively, the positional adjustment of the recording medium P can be performed by a proportional-integral-derivative controller (a PID controller) that controls by optimizing multiple parameters according to deviation of the target value (an ideal position of the recording medium P) and the current value (the current position of the recording medium P).

Figure 9A:
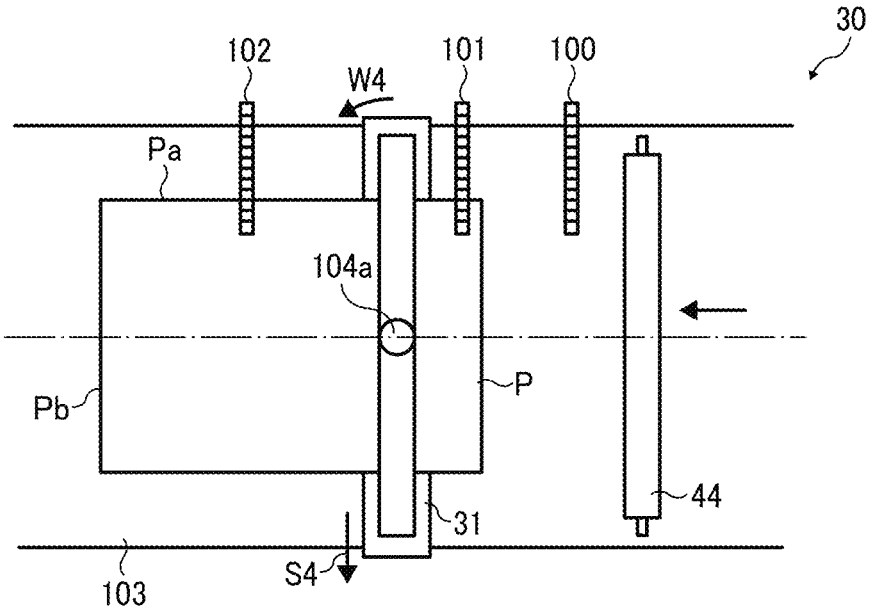
FIG. 9A is a top view illustrating the sheet conveying device and the units of FIG. 2.
Figure 9B:
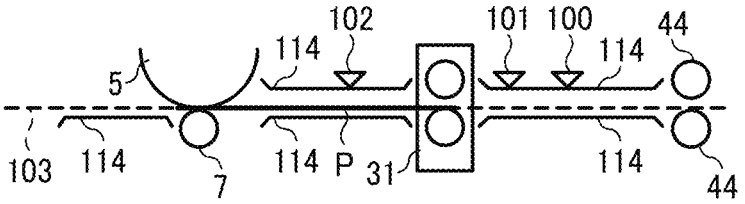
FIG. 9B is a side view illustrating the sheet conveying device and the units of FIG. 2.

After completion of positional adjustment of the recording medium P and arrival of the recording medium P to the transfer roller 7, as illustrated in FIGS. 9A and 9B, the pair of sheet holding rollers 31 separates from the recording medium P. Then, the pair of sheet holding rollers 31 returns to the reference position again to prepare for a subsequent positional adjustment and conveyance of the recording medium P. Specifically, as illustrated in FIG. 9A, the pair of sheet holding rollers 31 returns to the reference position by moving to a direction indicated by arrow S4 and rotating about the shaft 104*a* in a direction indicated by arrow W4.

In the above-described examples of this disclosure, the image forming apparatus 1 as illustrated in FIG. 1 is employed. However, the image forming apparatus applicable to this disclosure is not limited thereto. For example, the image forming apparatus according to this disclosure can be a monochromatic or color image forming apparatus, a printer, a facsimile machine, and a multifunction printer having two or more functions of copying, printing, and facsimile.

The sheet conveying device 30 according to the above-described examples of this disclosure causes the pair of sheet holding rollers 31 to correct both the lateral shift amount in the width direction of the recording medium P and the inclination amount to the oblique side in the sheet conveying direction of the recording medium P. However, the sheet conveying device applicable to this disclosure is not limited thereto. For example, a sheet conveying device that corrects one of the lateral shift amount and the inclination amount of the recording medium P can also be applied to this disclosure.

Further, the skew correction of the recording medium P in the primary correction and the secondary correction can be calculated based on the reference line M with respect to the width direction of the recording medium P.

The above-described examples of this disclosure describe the configuration of a sheet conveying device to perform the inclination (skew) correction and the lateral shift correction of the recording medium P. However, the configuration of the sheet conveying device is not limited thereto. For example, a sheet conveying device in which an inclination (skew) correction and a lateral shift correction of an original document can also be applied to this disclosure.

Now, a description is given of the sheet conveying device 30 according to another example of this disclosure, with reference to FIGS. 4 and 21 through 28F. Specifically, a configuration, functions, and operations of the sheet conveying device 30 from the merging point X to the transfer roller 7 are described.

Figure 21:
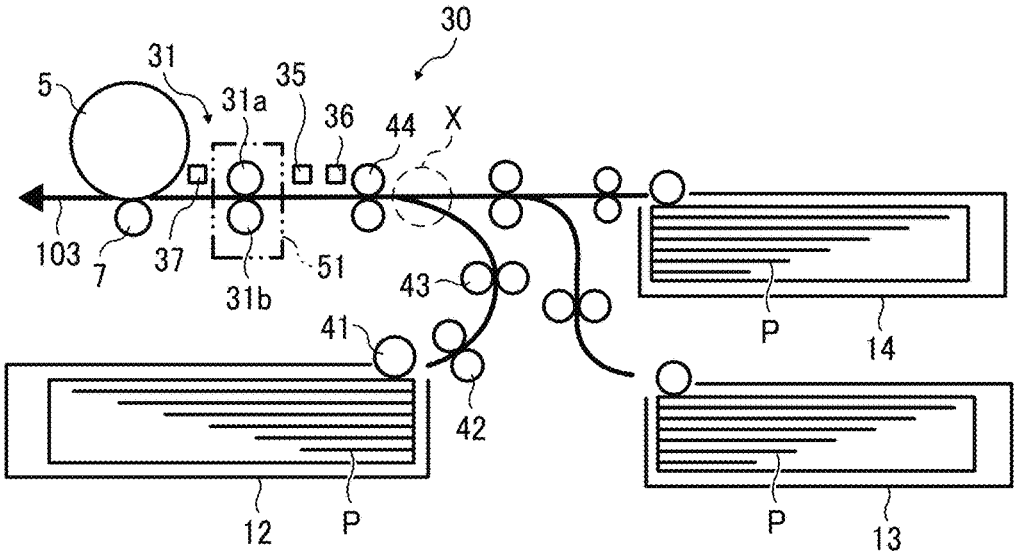
FIG. 21 is a schematic diagram illustrating a sheet conveying device according to an example of this disclosure.

It is to be noted that the configuration of the sheet conveying device 30 illustrated in FIG. 21 is basically identical to the configuration of the sheet conveying device 30 illustrated in FIG. 2, except that the sheet conveying device 30 of FIG. 21 according to the present example includes a first pair of skew detecting sensors 35, a CIS 36, and a second pair of skew detecting sensors 37 while the sheet conveying device 30 of FIG. 2 includes the first CIS 100, the second CIS 101, and the third CIS 102. Accordingly, detailed descriptions of the configuration and functions of the sheet conveying device 30 illustrated in FIG. 21 identical to the configuration of the sheet conveying device 30 illustrated in FIG. 2 are omitted or summarized.

Similarly to the sheet conveying device 30 of FIG. 2, in the sheet conveying device 30 according to the present example, the uppermost recording medium P passes the merging point X and then the straight sheet conveying path, which corresponds to the straight sheet conveying path 103 in the previously described example. The straight sheet conveying path is defined by straight conveying guide plates, which correspond to the straight conveying guide plates 114 in the previously described example. The pair of sheet holding rollers 31, which is provided to the matching unit 51, corrects skew or inclination of the recording medium P in the sheet conveying direction and lateral shift of the recording medium P in the width direction. The recording medium P is then conveyed toward the transfer roller 7 in synchronization with movement of the toner image formed on the surface of the photoconductor drum 5 for positioning. Detailed positioning operations are described below.

Figure 22:
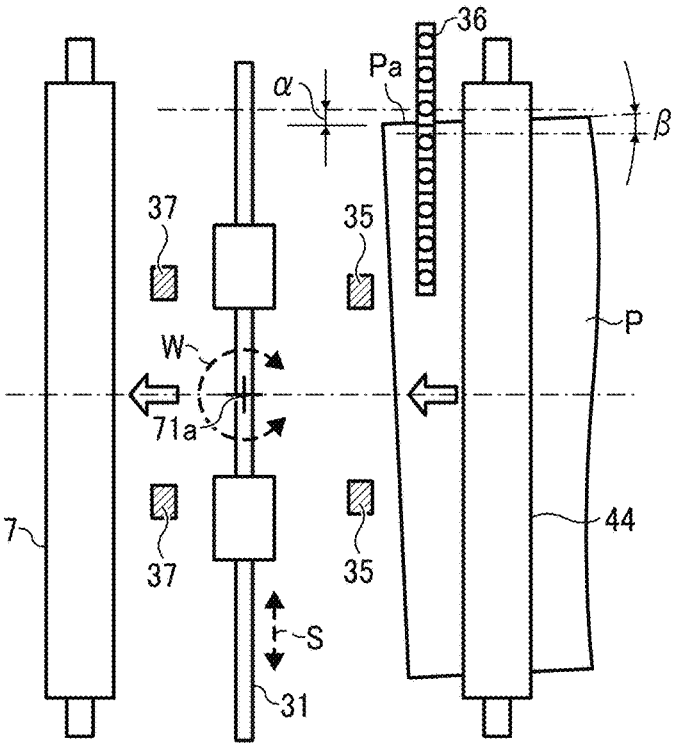
FIG. 22 is a top view illustrating a part of the sheet conveying device of FIG. 21.

As illustrated in FIG. 22, the third pair of sheet conveying rollers 44, the CIS 36 that functions as a second detector, the first pair of skew detecting sensors 35 that functions as a first detector, the pair of sheet holding rollers 31 in the matching unit 51 and functions as a position adjuster, and the second pair of skew detecting sensors 37 that functions as a third detector are disposed in this order to a downstream side in the sheet conveying direction.

Figure 29A:
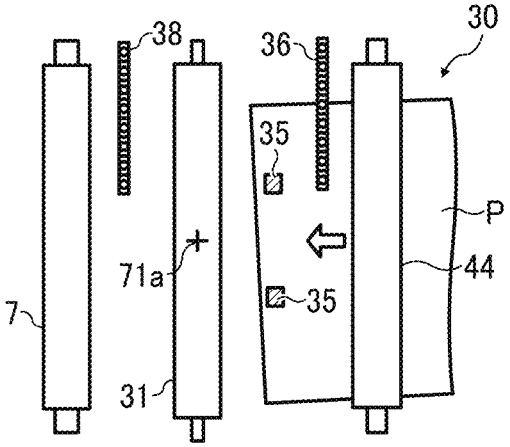
FIG. 29A is a top view illustrating part of operations of the sheet conveying device.
Figure 29B:
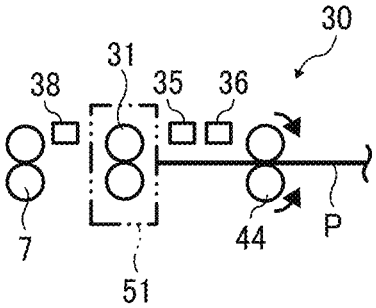
FIG. 29B is a side view illustrating part of operations of the sheet conveying device.

Similarly to the previously described example, the pair of sheet holding rollers 31 in the present example has multiple rollers axially aligned along the width direction thereof. However, the structure of a pair of sheet holding rollers is not limited thereto. For example, a pair of sheet holding rollers that includes not multiple rollers axially aligned in the width direction but a single roller that extends over the whole width thereof can be applied to this disclosure, as illustrated in FIGS. 29A and 29B.

In addition, the pair of sheet holding rollers 31 rotates about the shaft 104*a* to the oblique side in the sheet conveying direction W and moves in the width direction S.

Referring back to FIG. 4, the pair of sheet holding rollers 31 having the driving roller 31*a* and the driven roller 31*b* is driven to rotate by the first driving motor 61 that functions as a first driving unit, so as to convey the recording medium P while holding the recording medium P between the driving roller 31*a* and the driven roller 31*b*.

To be more specific, the first driving motor 61 is fixedly mounted on a frame of the sheet conveying device 30 of the image forming apparatus 1. The first driving motor 61 includes a motor shaft and a driving gear 61*a* that is mounted on the motor shaft. The driving gear 61*a* meshes with a gear unit 76*a* of a frame side rotary shaft 76 and rotates the frame side rotary shaft 76 in a direction indicated by arrow in FIG. 4. The gear unit 76*a* of the frame side rotary shaft 76 is rotationally supported to an uprising part 71*b* of a base 71 of the frame and is formed to have a substantially long face-width in the width direction thereof. As the frame side rotary shaft 76 is driven and rotated, a rotational driving force applied by the rotation of the frame side rotary shaft 76 is transmitted to a rotary shaft of the driving roller 31*a* via a coupling 75. This transmission rotates the rotary shaft of the driving roller 31*a*. Accordingly, the driven roller 31*b* is rotated with the driving roller 31*a*.

The coupling 75 is disposed between the rotary shaft of the driving roller 31*a* and the frame side rotary shaft 76 rotationally supported by the base 71 of the frame of the sheet conveying device 30. The coupling 75 is a shaft coupling such as a constant velocity (universal) joint and a universal joint. With the coupling 75, when a second driving motor 62 is driven, the pair of sheet holding rollers 31 rotates together with a support 72. With this configuration, even if a shaft angle of the rotary shaft of the driving roller 31*a* and the frame side rotary shaft 76 is changed, a speed of rotation does not change, and therefore the rotational driving force is transmitted successfully.

The support 72 is a movable body having a substantially rectangular shape. The pair of sheet holding rollers 31 is rotationally supported by the support 72 and is movably supported in the width direction thereof. Specifically, both ends of the rotary shaft of each of the driving roller 31*a* and the driven roller 31*b* in the width direction are rotationally supported to the support 72 via respective bearings fixedly mounted on the support 72. Further, the driving roller 31*a* and the driven roller 31*b* are supported by the support 72 to be movable in the width direction (an extending direction of the rotary shafts) of the driving roller 31*a* and the driven roller 31*b*. Specifically, a sufficient gap is provided between a supporting part 72*b* disposed at one end of the support 72 and a gear 72*a*, so that the respective rotary shafts of the driving roller 31*a* and the driven roller 31*b* does not interfere with the gear 72*a* even if the driving roller 31*a* and the driven roller 31*b* slide to the one end in the width direction.

Further, the support 72 is rotationally supported about the shaft 71*a* to the base 71 that functions as part of the frame of the sheet conveying device 30 of the image forming apparatus 1. Further, the second driving motor (the rotary motor) 62 that functions as a second driving unit is fixedly mounted on one end in the width direction of the base 71. The second driving motor 62 has a motor shaft 62*a* on which a gear is mounted. The gear mounted on the motor shaft 62*a* meshes with the gear 72*a* that is disposed at one end in the width direction of the support 72. With this structure, as the second driving motor 62 drives to rotate in a forward direction or in a backward direction, the pair of sheet holding rollers 31 rotates about the shaft 71*a* in the direction W together with the support 72 as illustrated in FIG. 22. The second driving motor 62 that functions as a second driving unit is driven to rotate the support 72 in the oblique direction together with the pair of sheet holding rollers 31 based on results detected by the first pair of skew detecting sensors 35 and the second pair of skew detecting sensors 37.

It is to be noted that an encoder 320 is mounted on the motor shaft 62*a* of the second driving motor 62, so that degree and direction of rotation of the pair of sheet holding rollers 31 in the oblique direction with respect to a reference position are detected indirectly. Accordingly, the pair of sheet holding rollers 31 can perform skew correction based on the results detected by the first pair of skew detecting sensors 35 and the second pair of skew detecting sensors 37.

It is to be noted that, in the present example, the pair of sheet holding rollers 31 rotates together with the support 72 about a center position in the width direction there. However, the configuration according to this disclosure is not limited thereto. For example, the configuration in which the pair of sheet holding rollers 31 rotates together with the support 72 about an end part in the width direction thereof can be applied to this disclosure A rack gear 78 is disposed at the other end in the width direction of the frame side rotary shaft 76 that is rotatably supported by the base 71 and meshes with a pinion gear that is mounted on a motor shaft 63*a* of a third driving motor (a shift motor) 63 that functions as a third driving unit. The rack gear 78 is rotationally disposed relative to the frame side rotary shaft 76 and is supported by the frame, so as to slide without rotating together with the frame side rotary shaft 76 in the width direction S along a guide rail that is formed on the frame of the sheet conveying device 30. Similar to the first driving motor 61 and the second driving motor 62, the third driving motor 108 is fixed to the frame of the sheet conveying device 30 of the image forming apparatus 1.

By contrast, a link 73 is disposed between the coupling 75 and a supporting part disposed at the other end of the support 72. The link 73 rotatably connects the driving roller 31*a* and the driven roller 31*b* so that the driving roller 31*a* and the driven roller 31*b* move together with each other in the width direction S. Specifically, the link 73 is held between retaining rings 80 disposed at respective gutters formed on the rotary shaft of the driving roller 31*a* and the rotary shaft of the driven roller 31*b*. As the driving roller 31*a* moves in the width direction, the driven roller 31*b* is moved together with the driving roller 31*a* in the width direction S by the same distance as the driving roller 31*a*.

With this configuration, the pair of sheet holding rollers 31 moves in the width direction S along with rotation of the third driving motor 63 in the forward and backward directions. The third driving motor 63 that functions as a third driving unit causes the pair of sheet holding rollers 31 to move together with the frame motor side rotary shaft 76 in the width direction based on the results detected by the CIS 36 that functions as a second detector and a third detector disposed upstream from the pair of sheet holding rollers 31 in the sheet conveying direction.

It is to be noted that an encoder 330 is mounted on the motor shaft 63*a* of the third driving motor 63, so that degree and direction of rotation of the pair of sheet holding rollers 31 in the width direction with respect to the reference position are detected indirectly. Accordingly, the pair of sheet holding rollers 31 can perform the lateral shift correction based on the results detected by the CIS 36.

The pair of sheet holding rollers 31 rotates together with the support 72 to the oblique side in the sheet conveying direction while holding the recording medium P therebetween based on the results detected by the first pair of skew detecting sensors 35 or the second pair of skew detecting sensors 37, so that the inclination amount β of the recording medium P is corrected. Specifically, the pair of sheet holding rollers 31 moves the recording medium P traveling in the sheet conveying path obliquely in the sheet conveying direction to perform the skew correction of the recording medium P.

Further, the pair of sheet holding rollers 31 moves in the width direction while holding the recording medium P therebetween based on the results detected by the CIS 36, so that the lateral shift amount of the recording medium P in the width direction is corrected. Specifically, the pair of sheet holding rollers 31 moves the recording medium P traveling in the sheet conveying path in the width direction to perform the lateral shift correction of the recording medium P.

The third pair of sheet conveying rollers 44 is located at a position upstream from the pair of sheet holding rollers 31 in the sheet conveying direction. The third pair of sheet conveying rollers 44 is a pair of conveying rollers that can rotate and convey the recording medium P while holding the recording medium P therebetween. Further, rollers of the third pair of sheet conveying rollers 44 can separate to switch the sheet holding state in which the third pair of sheet conveying rollers 44 holds the recording medium P therebetween and the sheet releasing state in which the third pair of sheet conveying rollers 44 does not hold the recording medium P therebetween. When the recording medium P reaches the pair of sheet holding rollers 31 to be held and conveyed by the pair of sheet holding rollers 31, the third pair of sheet conveying rollers 44 holding the recording medium P is switched from the sheet holding state to the sheet releasing state to release the recording medium P.

In the present example, the pair of sheet holding rollers 31 is disposed upstream from the transfer roller 7 in the sheet conveying path and is a pair of conveying rollers that also functions as a pair of registration rollers. By rotating while holding the recording medium P therebetween, the pair of sheet holding rollers 31 conveys the recording medium P (after the lateral shift correction and the skew correction) to the image forming part 4.

The first driving motor 61 that rotates the driving roller 31*a* of the pair of sheet holding rollers 31 functions as a driving motor with variable number of rotations to change a speed of conveyance of the recording medium P. Then, when a sheet detecting sensor that is a photosensor such as the CIS 36 detects the timing of arrival of the recording medium P at the pair of sheet holding rollers 31, that is, when the recording medium P is conveyed to the pair of sheet holding rollers 31 and the pair of sheet holding rollers 31 detects a state in which the recording medium P is held between the driving roller 31*a* and the driven roller 31*b*, the pair of sheet holding rollers 31 performs a desired lateral shift correction and skew correction. Further, the speed of conveyance of the recording medium P conveyed by the pair of sheet holding rollers 31 is changed based on detection results, i.e., the detected timing, obtained by the sheet detecting sensor. Specifically, in order to synchronize the timing at which the pair of sheet holding rollers 31 conveys the recording medium P to the transfer roller 7 and the timing at which the toner image formed on the surface of the photoconductor drum 5 reaches the transfer roller 7, the speed of conveyance of the recording medium P conveyed by the pair of sheet holding rollers 31 is varied, that is, the timing to convey the recording medium P is conveyed toward the image forming part 4 is adjusted. By so doing, the pair of sheet holding rollers 31 can convey the recording medium P to the image forming part 4 disposed downstream therefrom in the sheet conveying direction while performing the lateral shift correction and the skew correction of the recording medium P without stopping the conveyance of the recording medium P.

It is to be noted that, immediately after the leading edge Pb of the recording medium P in the sheet conveying direction has reached the image forming part 4, the speed of conveyance of the recording medium P conveyed by the pair of sheet holding rollers 31 is adjusted, so as not to cause a linear velocity difference with the photoconductor drum 5 to result in distortion of the toner image to be transferred onto the recording medium P, in other words, so as to cause the linear velocity difference with the photoconductor drum 5 to be 1.

The first pair of skew detecting sensors 35 (the first skew detection sensor) that functions as the first detector is provided to detect the inclination amount (skew amount) β of the recording medium P in the sheet conveying path to the oblique side in the sheet conveying direction.

Specifically, as illustrated in FIG. 22, the first pair of skew detecting sensors 35 is disposed upstream from the pair of sheet holding rollers 31 along the sheet conveying path in the sheet conveying direction and downstream from the third pair of sheet conveying rollers 44 along the sheet conveying path in the sheet conveying direction. The first pair of skew detecting sensors 35 includes two photosensors (i.e., a light emitting element such as LED and a light receiving element such as a photodiode) disposed equally spaced apart from a lateral center position in the width direction. The first pair of skew detecting sensors 35 detects the inclination (skew) amount β of the recording medium P by detecting a shift or deviation of the timing at which the leading edge of the recording medium P passes thereby. In the present example, the pair of sheet holding rollers 31 corrects the inclination (skew) of the recording medium P while holding the recording medium P therebetween based on the results detected by the first pair of skew detecting sensors 35.

To be more specific, as illustrated in FIG. 22, when the first pair of skew detecting sensors 35 detects that the recording medium P is inclined by the angle β to a forward direction with respect to a normal position (no skew) indicated by a dashed line, a rotary controller 340 determines the inclination (skew) amount β as the correction amount and caused the pair of sheet holding rollers 31 to perform a rotary control, that is, to rotate, together with the support 72 and while holding the recording medium P, by the angle β in a reverse direction (which is an opposite direction of rotation and is a clockwise direction in FIG. 22).

As illustrated in FIG. 22, the CIS 36 that functions as a second detector is disposed at an upstream side of the sheet conveying path from the pair of sheet holding rollers 31 and at a downstream side thereof from the third pair of sheet conveying rollers 44. The CIS 36 includes multiple photosensors (i.e., light emitting elements such as LEDs and light receiving elements such as photodiodes) aligned along the width direction. The CIS 36 detects the lateral shift amount α by detecting the side edge Pa at one end in the width direction of the recording medium P. Specifically, the CIS 36 detects the lateral shift amount α in the width direction of the recording medium P that is conveyed through the sheet conveying path provided in the sheet conveying device 30. Then, based on the results detected by the CIS 36, the pair of sheet holding rollers 31 corrects the lateral shift correction to the recording medium P.

It is to be noted that the sheet conveying device 30 according to the present example of this disclosure has the above-described configuration in which the CIS 36 is disposed at one end in the width direction of the recording medium P to detect the side edge Pa at one end in the width direction of the recording medium P, as illustrated in FIG. 22. However, the configuration of the sheet conveying device 30 is not limited thereto. For example, a configuration in which the CIS 36 is disposed over the entire length in the width direction to detect both side edges in the width direction of the recording medium P can be applied to this disclosure.

Then, the pair of sheet holding rollers 31 (the support 72) is moved in the width direction based on the results detected by the CIS 36 (the second detector) while the pair of sheet holding rollers 31 is holding and conveying the recording medium P, so that the lateral shift in the width direction of the recording medium P conveyed in the sheet conveying path is corrected.

To be more specific, as illustrated in FIG. 22, when the CIS 36 detects that the recording medium P is shifted by the distance a to one end side (a lower end side in FIG. 22) thereof in the width direction with respect to a normal position (no lateral shift) indicated by a dashed line in FIG. 22, a controller 350 determines the lateral shift amount α as the correction amount and caused the pair of sheet holding rollers 31 to perform a shift control, that is, to move, together with the support 72 and while holding the recording medium P, by the distance a to the other end side (an upper end side in FIG. 22) thereof.

Thus, in the present example, the pair of sheet holding rollers 31 corrects the inclination amount β of the recording medium P to the oblique side in the sheet conveying direction by rotating to the oblique side in the sheet conveying direction based on the results detected by the first pair of skew detecting sensors 35 (the first detector) while holding the recording medium P without stopping conveyance of the recording medium. At the same time, the pair of sheet holding rollers 31 corrects the lateral shift amount α in the width direction of the recording medium P by moving in the width direction based on the results detected by the CIS 36 (the second detector). Specifically, in the configuration according to the present example, the first pair of skew detecting sensors 35 detects the inclination (skew) amount of the recording medium P under the state in which the pair of sheet holding rollers 31 is ready to convey the recording medium P. Based on the results detected by the first pair of skew detecting sensors 35, the lateral shift correction of the recording medium P is performed. At the substantially same time, the CIS 36 detects the lateral shift amount of the recording medium P. Based on the results detected by the CIS 36, the lateral shift correction of the recording medium P is performed. Hereinafter, the series of correcting operations is referred to as the "primary correction" or the "primary movement", which has the identical function to the primary correction or the primary movement described in the previously descried examples.

In the primary correction according to the present example, the productivity of the image forming apparatus 1 can be significantly enhanced, when compared with an operation in which the lateral shift correction and the skew correction are performed separately while the recording medium P is stopped. Further, when the inclination (skew) correction and the lateral shift correction are performed, the pair of sheet holding rollers 31 does not generate a linear velocity difference between multiple rollers disposed in the width direction of the recording medium P. Therefore, even when a thin paper or a recording medium P having a low coefficient of friction is conveyed between the pair of sheet holding rollers 31, the recording medium P does not cause any deflection or slippage.

A detailed description is given of the primary correction according to the present example.

As described above, the primary correction according to the present example is performed to correct the positional shift amounts α and β of the recording medium P by calculating positional shift amounts α and β of the recording medium P with sensors (i.e., the first pair of skew detecting sensors 35 and the CIS 36), holding the recording medium P between the pair of sheet holding rollers 31 that is changed (shifted, moved, and rotated) from the reference position corresponding to the positional shift amounts α and β of the recording medium P, and returning the pair of sheet holding rollers 31 to the reference position.

At this time, the positional shift amounts α and β are calculated geometrically based on a transit time difference t1 detected by the first pair of skew detecting sensors 35 (the transit time difference t1 is a time difference detected by two photosensors or a pair of reflection sensors spaced apart in the width direction), a shift amount Z detected by the CIS 36 (the shift amount Z is a shift amount at the reference position of the CIS 36 at the time passing the first pair of skew detecting sensors 35), the length in the width direction of the recording medium P, the layout of the first pair of skew detecting sensors 35 and the CIS 36, and so forth.

Further, the pair of sheet holding rollers 31 changed (shifted, moved, and rotated) from the reference position according to the positional shift amounts α and β shifts so that the center of rotation (the shaft 71*a*) substantially matches the center in the width direction of the recording medium P.

Figure 23A:
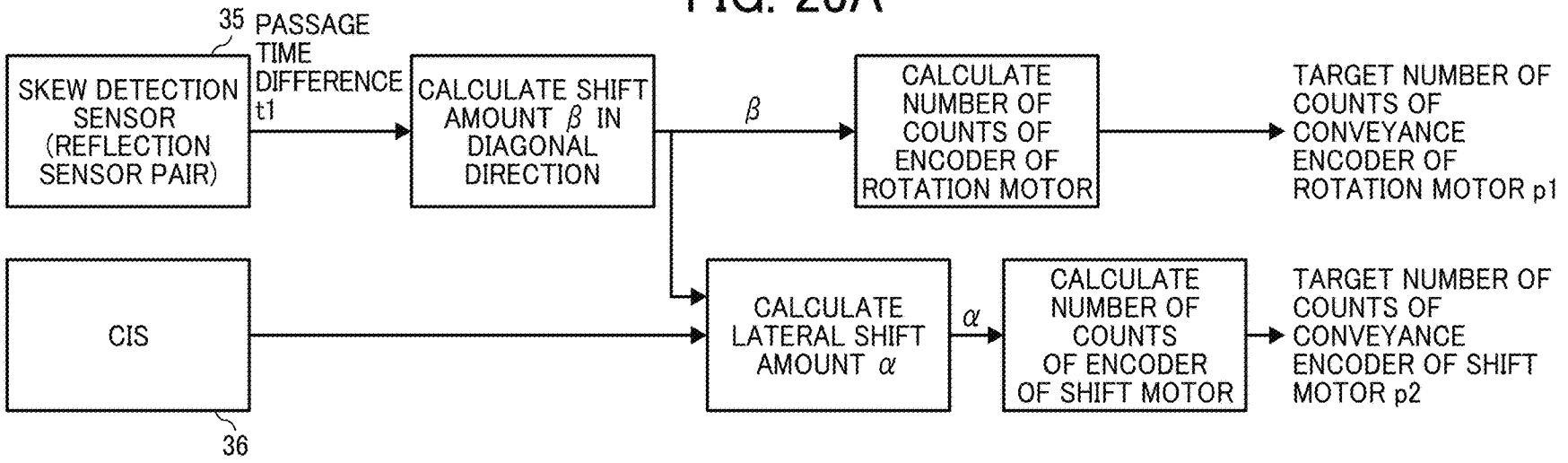
FIG. 23A is a flowchart showing control for the primary correction.

Specifically, as illustrated in FIG. 23A, the calculator (the rotary controller 340) calculates the inclination amount β to the oblique side in the sheet conveying direction based on results detected by the first pair of skew detecting sensors 35 that functions as a first skew detector, and further calculates the number of counts p1 of an encoder (a rotary motor encoder) 320 of the second driving motor 62 based on the inclination amount β. The number of counts p1 is stored as "the number of counts p1 of a target sheet conveying encoder" of the second driving motor 62 (a rotary motor).

Figure 24:
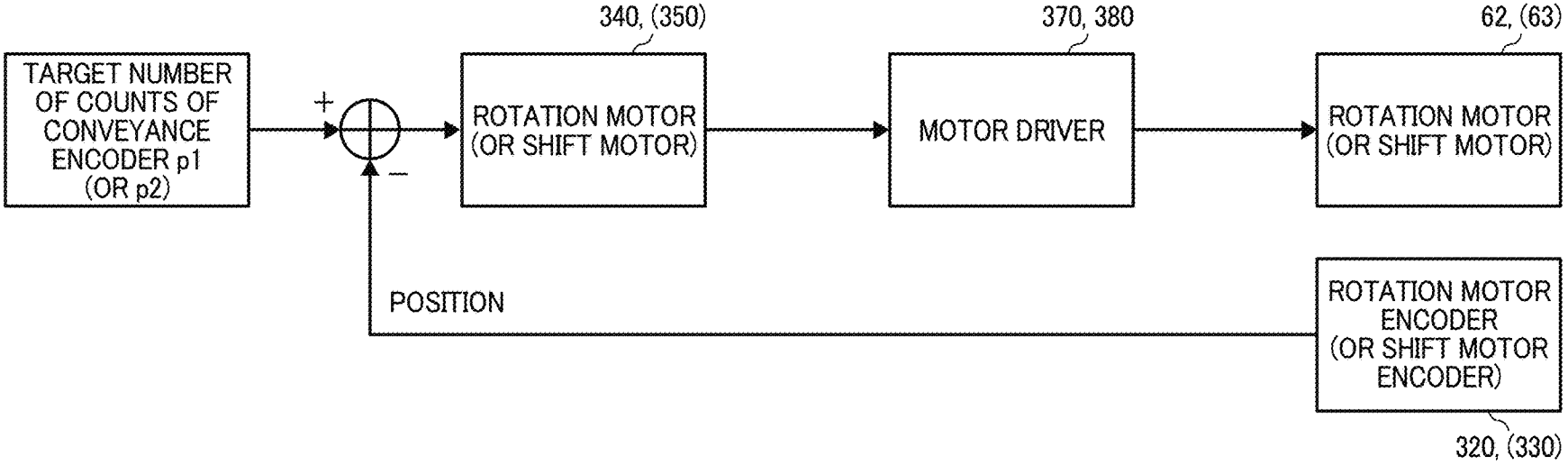
FIG. 24 is a flowchart showing control subsequent to the control of FIGS. 23A and 23B.

As illustrated in FIG. 24, while detecting the rotation position by the rotary motor encoder 320 (while performing the feedback control) based on the number of counts p1 of the target sheet conveying encoder calculated as illustrated in FIG. 23A, the controller 340 (the rotary controller 340) controls a motor driver 370, and then the second driving motor 62 (the rotary motor) is driven to rotate.

Further, as illustrated in FIG. 23A, a calculator (a controller 350) calculates the lateral shift amount α in the width direction of the recording medium P based on the results detected by the CIS 36 and the results of calculation of the inclination amount β to the oblique side to the sheet conveying direction, and then calculates the number of counts p2 of an encoder 330 (the number of counts p2 of the shift motor encoder 330) of the third driving motor 63 based on the lateral shift amount α. Then, the number of counts p2 is stored as "the number of counts p2 of a target sheet conveying encoder" of the third driving motor 63 (a shift motor).

As illustrated in FIG. 24, while detecting the shift position by the shift motor encoder 330 (while performing the feedback control) based on the number of counts p2 of the target sheet conveying encoder calculated as illustrated in FIG. 23A, the controller 350 (the shift controller 350) controls a motor driver 380, and then the third driving motor 63 (the shift motor) is driven to rotate. Therefore, the motor driver 380 is controlled to drive the third driving motor 63 (the shift motor).

It is to be noted that, for calculation of "the number of counts of a target sheet conveying encoder", a correction amount (a conveying amount) per count (pulse) is previously obtained by calculating with the set value and stored in the calculator.

In the present example of this disclosure, in order to correct the inclination amount β of the recording medium P to the oblique side in the sheet conveying direction based on the results detected by the first pair of skew detecting sensors 35 that functions as the first detector, the pair of sheet holding rollers 31 rotates from the reference position, which is a position corresponding to a normal position that has no positional shift to the oblique side in the sheet conveying direction, before holding the recording medium P between the pair of sheet holding rollers 31. After holding the recording medium P therebetween, the pair of sheet holding rollers 31 rotates to return to the reference position. At the same time, in order to correct the lateral shift amount α in the width direction of the recording medium P based on the results detected by the CIS 36 that functions as a second detector, the pair of sheet holding rollers 31 moves in the width direction from the reference position, which is a position corresponding to a normal position that has no positional shift in the width direction, before holding the recording medium P between the pair of sheet holding rollers 31. After holding the recording medium P therebetween, the pair of sheet holding rollers 31 moves in the width direction to return to the reference position. The above-described series of operations is referred to as the primary correction or the primary movement.

Then, after the pair of sheet holding rollers 31 detects positional shift amounts in the width direction and the oblique direction of the recording medium P, the second pair of skew detecting sensors 37 that functions as a third detector detects the positional shift amounts in the width direction and the oblique direction of the recording medium P. Then, the positional shift amounts in the width direction and the oblique direction of the recording medium P are further corrected based on the detection results. The above-described series of operations is hereinafter referred to as a "recorrection". It is to be noted that the recorrection is also referred to as a "secondary correction" or a "secondary movement" and has the identical function to the secondary correction or the secondary movement described in the previously descried examples.

Specifically, the second pair of skew detecting sensors 37 that includes two photosensors is disposed at respective positions spaced apart from each other in the width direction on a downstream side from the pair of sheet holding rollers 31 in the sheet conveying direction and an upstream side from the transfer roller 7 that functions as a downstream side sheet conveying roller in the sheet conveying direction. The second pair of skew detecting sensors 37 has a substantially identical configuration to the first pair of skew detecting sensors 35, except that the positions thereof are different from each other.

The second pair of skew detecting sensors 37 and the CIS 36 that functions as a second detector form a third detector to perform the recorrection (the fine adjustment, the secondary correction) for the lateral shift correction and the inclination (skew) correction of the recording medium P.

The pair of sheet holding rollers 31 rotates from the above-described reference position while holding the recording medium P therebetween so that the inclination amount β of the recording medium P to the oblique side in the sheet conveying direction is further corrected based on the results detected by the second pair of skew detecting sensors 37. At the same time, the pair of sheet holding rollers 31 moves from the above-described reference position while holding the recording medium P therebetween so that the lateral shift amount α of the recording medium P in the width direction is further corrected based on the results detected by the CIS 36.

Specifically, the second pair of skew detecting sensors 37 detects the inclination amount (the skew amount) of the recording medium P after the lateral shift correction to the oblique side in the sheet conveying direction at a position downstream from the pair of sheet holding rollers 31 while being held between and conveyed by the pair of sheet holding rollers 31. Similar to the first pair of skew detecting sensors 35, the second pair of skew detecting sensors 37 detects the inclination (skew) amount β of the recording medium P by detecting a difference of timings at which the leading edge of the recording medium P passes two photosensors disposed at respective positions spaced apart from each other in the width direction. Then, similar to the skew correction based on the results detected by the first pair of skew detecting sensors 35, the pair of sheet holding rollers 31 performs the skew correction based on the results detected by the second pair of skew detecting sensors 37 while holding and conveying the recording medium P.

Further, the CIS 36 functions as a second detector and a third detector. Specifically, the CIS 36 detects the lateral shift amount α in the width direction of the recording medium P at an upstream position from the pair of sheet holding rollers 31 after the lateral shift correction of the recording medium P has been conducted by the pair of sheet holding rollers 31 while the recording medium P is being held and conveyed by the pair of sheet holding rollers 31. Similar to the detection performed as a second detector, the CIS 36 as a third detector detects the lateral shift amount α of the recording medium P by detecting the side edge (the edge portion) Pa at one end in the width direction of the recording medium P. Then, similar to the above-described lateral shift correction performed based on the result detected by the CIS 36 as the second detector, the CIS 36 performs the lateral shift correction based on the results detected as the third detector while the pair of sheet holding rollers 31 is holding and conveying the recording medium P.

Thus, the lateral shift correction and the skew correction are firstly performed by the pair of sheet holding rollers 31 while the pair of sheet holding rollers 31 is holding and conveying the recording medium P therebetween, based on the results detected before the pair of sheet holding rollers 31 holds the recording medium P therebetween. Then, the lateral shift correction and the skew correction are secondly performed while the pair of sheet holding rollers 31 is holding and conveying the recording medium P therebetween, based on the results detected by the third detector. These corrections can prevent occurrence of lateral shift and skew of the recording medium P due to physical shock generated when the recording medium P enters into the nip region of the pair of sheet holding rollers 31 and when eccentricity of one or two rollers of the pair of sheet holding rollers 31 and assembly defect thereof are generated.

By contrast, in the present example of this disclosure, the lateral shift correction and the skew correction are performed once based on the results detected before the recording medium P is held by the pair of sheet holding rollers 31. Then, the lateral shift correction and the skew correction are performed again based on the results detected by the third detector while the recording medium P is held by the pair of sheet holding rollers 31. Therefore, the above-described occurrence of lateral shift and skew of the recording medium P can be restricted. Consequently, the lateral shift correction and the skew correction are performed more precisely.

Figure 23B:
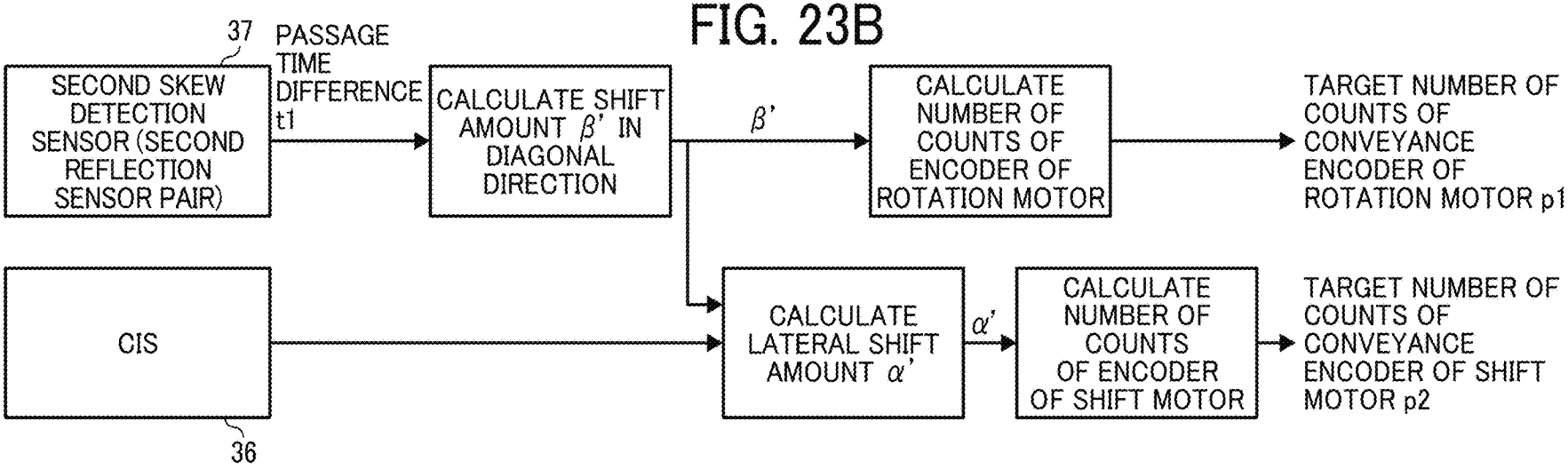
FIG. 23B is a flowchart showing control for the primary correction.

Further, as illustrated in FIG. 23B, the calculator (the controller 340) calculates the inclination amount β' to the oblique side in the sheet conveying direction based on the results detected by the second pair of skew detecting sensors 37, and then calculates the number of counts p1 of the encoder 320 of the second driving motor 62 (the number of counts of the rotary motor encoder 320) based on the inclination amount β'. Then, the number of counts p1 is stored as "the number of counts p1 of a target sheet conveying encoder" of the second driving motor 62 (the rotary motor).

Then, as illustrated in FIG. 24, while detecting the rotation position by the rotary motor encoder 320 (while performing the feedback control) based on the number of counts p1 of the target sheet conveying encoder calculated as illustrated in FIG. 23B, the controller 340 (the rotary controller 340) controls the motor driver 370, and then the second driving motor 62 (the rotary motor) is driven to rotate.

Further, as illustrated in FIG. 23B, the calculator (the controller 350) calculates the lateral shift amount α' in the width direction of the recording medium P based on the results detected by the CIS 36 and the results of calculation of the inclination amount β' to the oblique side to the sheet conveying direction, and then calculates the number of counts p2 of the encoder 330 (the number of counts p2 of the shift motor encoder 330) of the third driving motor 63 based on the lateral shift amount α'. Then, the number of counts p2 is stored as "the number of counts p2 of a target sheet conveying encoder" of the third driving motor 63 (a shift motor).

Then, as illustrated in FIG. 24, while detecting the shift position by the shift motor encoder 330 (while performing the feedback control) based on the number of counts p2 of the target sheet conveying encoder calculated as illustrated in FIG. 23B, the controller 350 (the shift controller 350) controls the motor driver 380, and then the third driving motor 63 (the shift motor) is driven to rotate.

In the present example, as described above, it is preferable that the pair of sheet holding rollers 31 is moved in the width direction from the reference position while the recording medium P is being held by the pair of sheet holding rollers 31 when the CIS 36 functions as the third detector. By so doing, the lateral shift amount α in the width direction of the recording medium P can be further corrected by the feedback control based on the results continuously detected by the CIS 36. Specifically, it is preferable that the CIS 36 continuously detects the lateral shift of the recording medium P until the recording medium P reaches the transfer roller 7 (the transfer nip region) and, based on the results detected by the CIS 36, the well responsive recorrection (the secondary correction) of the lateral shift of the recording medium P is continued so that the side edge Pa at one end in the width direction of the recording medium P matches a normal position, which is a position that has no lateral shift in the width direction.

By performing the above-described control, the lateral shift correction can be performed more precisely.

Figure 25:
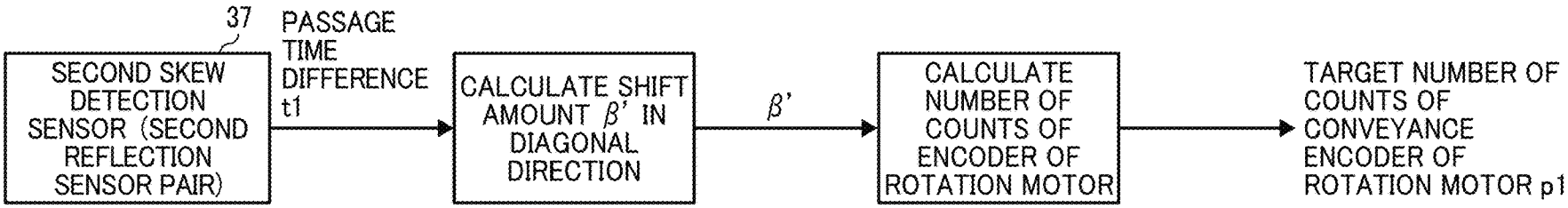
FIG. 25 is a flowchart showing rotation operations for recorrection.

Specifically, as illustrated in FIG. 25, the calculator (the controller 340) calculates the inclination amount β' of the recording medium P to the oblique side in the sheet conveying direction based on the results detected by the second pair of skew detection sensors 37. Then, based on the calculated inclination amount β', the calculator (the controller 340) further calculates the number of counts p1 of the encoder 320 (the number of counts of the rotary motor encoder 320) of the second driving motor 62. Then, the number of counts p1 is stored as "the number of counts p1 of a target sheet conveying encoder" of the second driving motor 62 (the rotary motor).

Figure 26A:
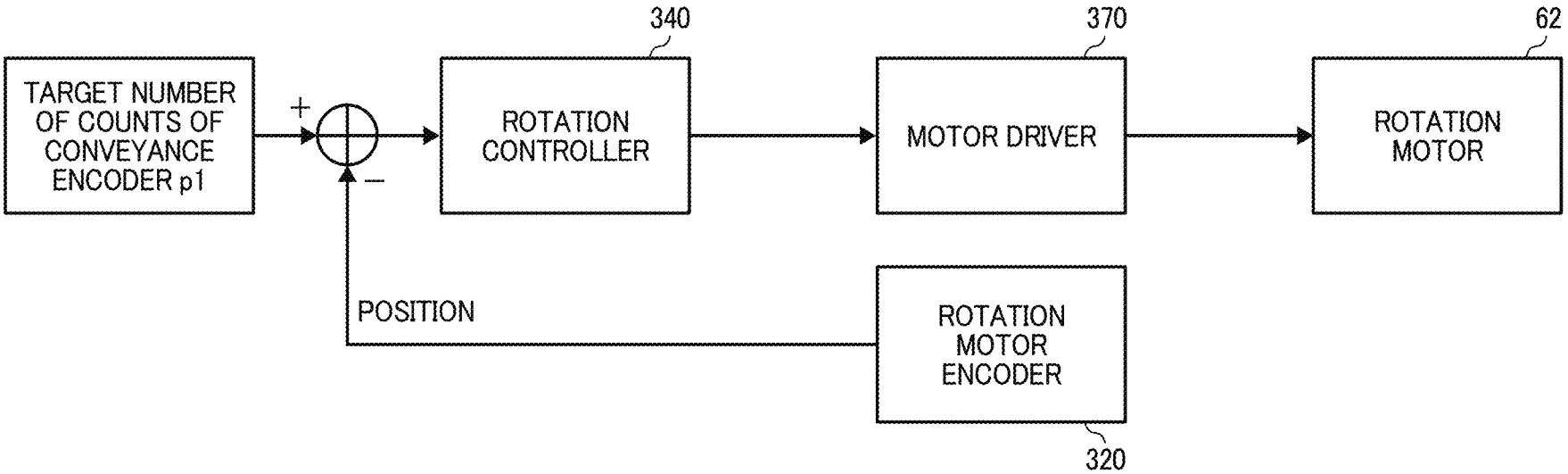
FIG. 26A is a flowchart showing rotation operations subsequent to the control of FIG. 25.

Further, as illustrated in FIG. 26A, while detecting the rotation position by the rotary motor encoder 320 (while performing the feedback control) based on the number of counts p1 of the target sheet conveying encoder calculated in FIG. 25, the controller 340 (the rotary controller 340) controls the motor driver 370, and then the second driving motor 62 (the rotary motor) is driven to rotate.

Figure 26B:
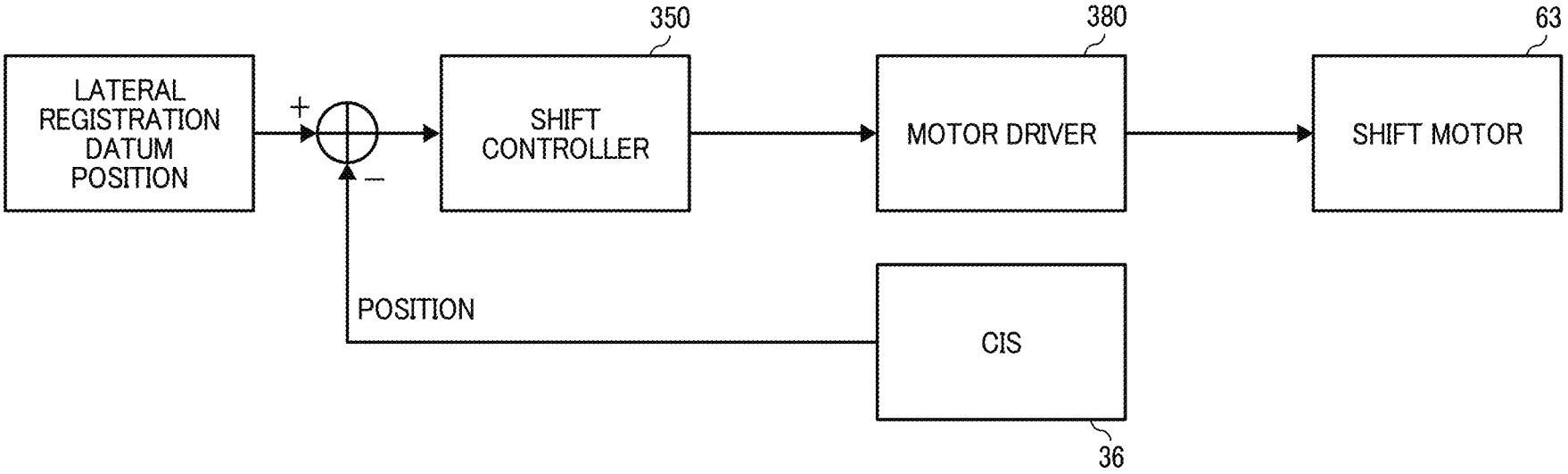
FIG. 26B is a flowchart showing shift control in FIG. 26A.

Further, the calculator (the controller 350) continuously calculates the lateral shift amount α' in the width direction of the recording medium P based on the results detected by the CIS 36, and then performs the feedback control so that the lateral shift amount α' becomes zero. Specifically, as illustrated in FIG. 26B, while detecting the shift position by the CIS 36 (while performing the feedback control) with respect to the reference position for the lateral shift, the controller 350 (the shift controller 350) controls the motor driver 380, and then the third driving motor 63 (the shift motor) is driven to rotate.

Next, a description is given of an operation of the sheet conveying device 30 having the above-described configuration, with reference to FIGS. 27A through 27F and 28A through 28F.

It is to be noted that FIGS. 27A, 27C, 27E, 28A, and 28C are top views illustrating the operations of the sheet conveying device 30 and FIGS. 27B, 27D, 27F, 28B, and 28D are side views corresponding to the operations of the sheet conveying device 30 illustrated in FIGS. 27A, 27C, 27E, 28A, and 28C, respectively.

Figure 27A:
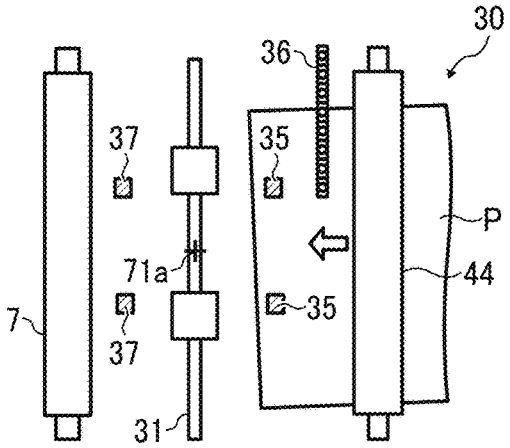
FIG. 27A is a top view illustrating operations of the sheet conveying device.
Figure 27B:
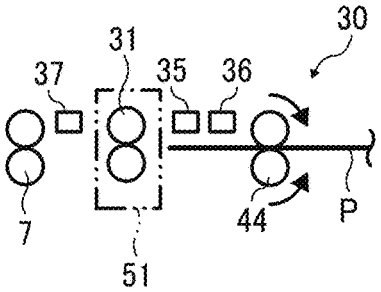
FIG. 27B is a side view illustrating operations of the sheet conveying device.

First, as illustrated in FIGS. 27A and 27B, the recording medium P fed from the sheet feeding part 12 is held and conveyed by the third pair of sheet conveying rollers 44 toward the pair of sheet holding rollers 31 in a direction indicated by white arrow. At this time, the position of the pair of sheet holding rollers 31 in the rotation direction is located in the first reference position, which is a normal position corresponding to the recording medium P that has no skew, and the position thereof in the width direction is located in the second reference position, which is a normal position corresponding to the recording medium P that has no lateral shift.

Then, upon arrival of the recording medium P to the CIS 36 (the second detector), the CIS 36 detects the lateral shift amount α in the width direction of the recording medium P. Further, upon arrival of the recording medium P to the first pair of skew detecting sensors 35 (the first detector), the first pair of skew detecting sensors 35 detects the skew amount β of the recording medium P.

It is to be noted that, when the CIS 36 detects the positional shift amounts of the recording medium P directly, the recording medium P is skewed and slanted. Therefore, the lateral shift amount α in the width direction of the recording medium P having no skew is detected by the calculator (the controller 340) based on the results later detected by the first pair of skew detecting sensors 35, a distance from the CIS 36 to the first pair of skew detecting sensors 35, and so forth.

Figure 27C:
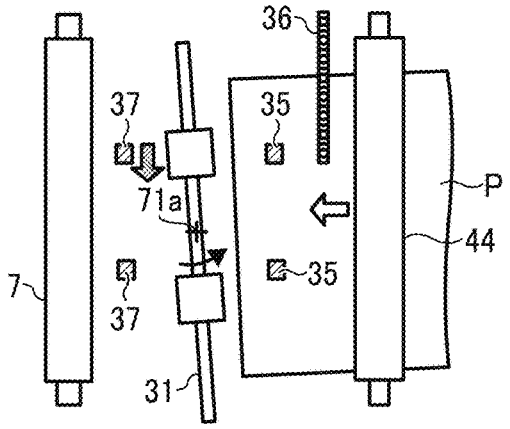
FIG. 27C is a top view illustrating operations of the sheet conveying device.
Figure 27D:
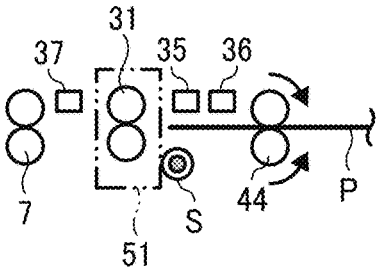
FIG. 27D is a side view illustrating operations of the sheet conveying device.

Then, as illustrated in FIGS. 27C and 27D, the pair of sheet holding rollers 31 together with the support 72 rotates by the inclination amount (angle) β about the shaft 71*a* from the first reference position to the same side in the sheet conveying direction, corresponding to the skew amount detected by the first pair of skew detecting sensors 35, and shifts by the lateral shift amount (distance) a from the second reference position in the width direction, corresponding to the lateral shift amount α detected by the CIS 36.

Figure 27E:
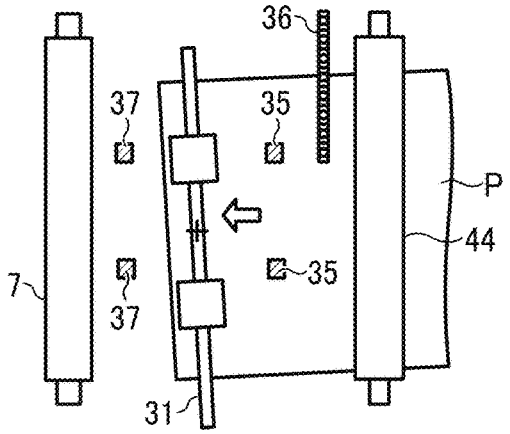
FIG. 27E is a top view illustrating operations of the sheet conveying device.
Figure 27F:
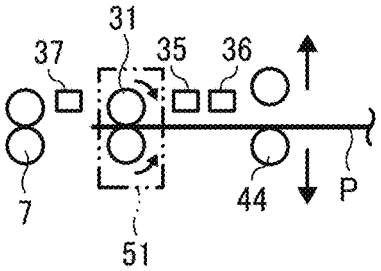
FIG. 27F is a side view illustrating operations of the sheet conveying device.

Then, as illustrated in FIGS. 27E and 27F, (driving and) rotation of the pair of sheet holding rollers 31 in a direction indicated by arrow in the drawings immediately before the leading edge of the recording medium P reaches the pair of sheet holding rollers 31. When the recording medium P is held and conveyed by the pair of sheet holding rollers 31, the sheet conveying path is open and rollers of the third pair of sheet conveying rollers 44 separate in a direction in which the pair of sheet holding rollers 31 does not hold the recording medium P (in a direction indicated by solid line).

It is to be noted that the timing that the leading edge of the recording medium P reaches the pair of sheet holding rollers 31 can also be obtained by the calculators (the controllers 340 and/or 350) based on the timing at which the first pair of skew detecting sensors 35 and the CIS 36 detect the leading edge of the recording medium P, the speed of conveyance of the recording medium P, distances from the first pair of skew detecting sensors 35 and the CIS 36 to the pair of sheet holding rollers 31, and so forth.

Figure 28A:
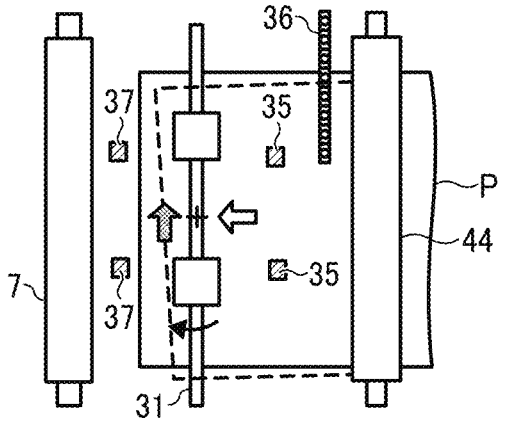
FIG. 28A is a top view illustrating operations of the sheet conveying device subsequent to the operations of FIGS. 27A through 27F.
Figure 28B:
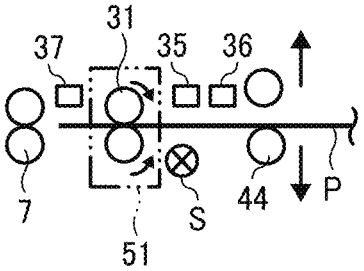
FIG. 28B is a side view illustrating operations of the sheet conveying device subsequent to the operations of FIGS. 27A through 27F.

Then, as illustrated in FIGS. 28A and 28B, the pair of sheet holding rollers 31 rotates about the shaft 71*a* to return to the first reference position while holding and conveying the recording medium P so as to offset the skew amount β detected by the first pair of skew detecting sensors 35 and moves in the width direction of the recording medium P to return to the second reference position so as to offset the lateral shift amount α detected by the CIS 36.

Figure 28C:
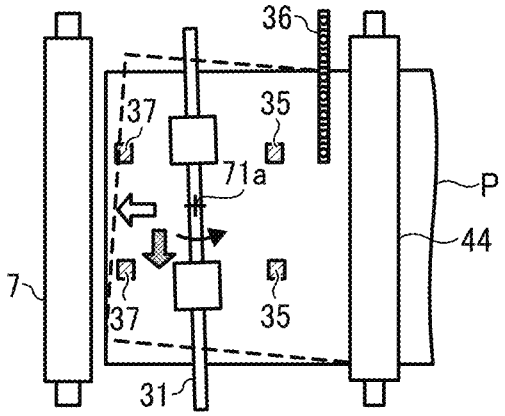
FIG. 28C is a top view illustrating operations of the sheet conveying device subsequent to the operations of FIGS. 27A through 27F.
Figure 28D:
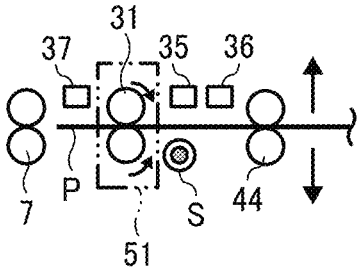
FIG. 28D is a side view illustrating operations of the sheet conveying device subsequent to the operations of FIGS. 27A through 27F.

Then, as illustrated in FIGS. 28C and 28D, when the corrected recording medium P reaches the second pair of skew detecting sensors 37 (the third detector), the second pair of skew detecting sensors 37 detects the skew amount β' of the recording medium P. Further, the CIS 36 that functions as the third detector continuously detects the lateral shift amount α' in the width direction of the corrected recording medium P. Then, the pair of sheet holding rollers 31 together with the support 72 rotates about the shaft 71*a* from the first reference position by the inclination amount (angle) β' detected by the second pair of skew detecting sensors 37 in a different inclination direction (an opposite direction) corresponding to the skew amount β' and moves from the second reference position by the lateral shift amount (distance) α' to a different side (an opposite side) in the width direction of the recording medium P corresponding to the lateral shift amount α' continuously detected by the CIS 36.

Thus, the recording medium P is conveyed toward the transfer roller 7 in the image forming part 4 while the skew correction and the lateral shift correction are being performed. At this time, the number of rotation of the pair of sheet holding rollers 31 (the speed of conveyance of the recording medium P until the recording medium P arrives the transfer roller 7) is varied so as to synchronize with movement of the toner image formed on the surface of the photoconductor drum 5.

Figure 28E:
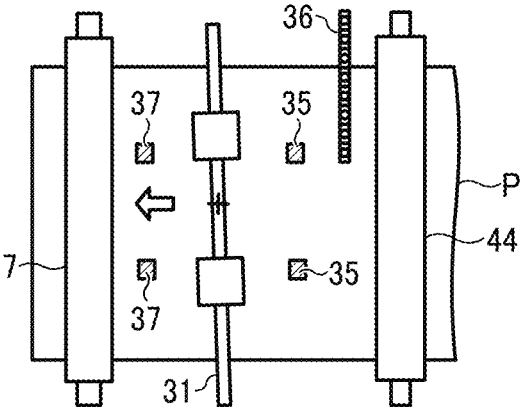
FIG. 28E is a top view illustrating operations of the sheet conveying device subsequent to the operations of FIGS. 27A through 27F.
Figure 28F:
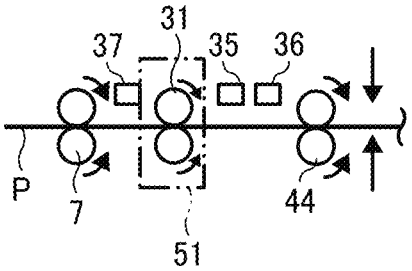
FIG. 28F is a side view illustrating operations of the sheet conveying device subsequent to the operations of FIGS. 27A through 27F.

Then, as illustrated in FIGS. 28E and 28F, the recording medium P is conveyed toward the transfer roller 7 (the image transfer unit) and the toner image is transferred onto the recording medium P at a desired position. Thereafter, the third pair of sheet conveying rollers 44 that are separated from each other is brought back into a contact state as illustrated in FIG. 27B, so as to assist the pair of sheet holding rollers 31 to convey the recording medium P and prepare for a subsequent conveyance operation.

Then, upon passage of the trailing edge of the recording medium P through the pair of sheet holding rollers 31, the pair of sheet holding rollers 31 is returned to the first and second reference positions for preparation of the inclination (skew) correction and the lateral shift correction of a subsequent recording medium P.

In the present example, the second pair of skew detecting sensors 37 is disposed downstream from the pair of sheet holding rollers 31 in the sheet conveying direction, and the second pair of skew detecting sensors 37 and the CIS 36 function as a third detector.

Alternatively, as illustrated in FIGS. 29A and 28B, the CIS 38 is disposed downstream from the pair of sheet holding rollers 31 in the sheet conveying direction, and the CIS 38 and the CIS 36 can function as a third detector.

It is to be noted that FIGS. 29A and 28B correspond to FIGS. 27A and 27B.

In the configuration illustrated in FIGS. 29A and 28B, similarly to the above-described example, the pair of sheet holding rollers 31 corrects the positional shift amounts of the recording medium P in the width direction and to the oblique side in the sheet conveying direction. Then, the third detector detects the positional shift amounts of the corrected recording medium P in the width direction and to the oblique side in the sheet conveying direction. Based on the results detected by the third detector, the positional shift amounts of the recording medium P in the width direction and to the oblique side in the sheet conveying direction is further corrected.

Specifically, the CIS 38 includes multiple photosensors arranged in the width direction. The CIS 38 is disposed downstream from the pair of sheet holding rollers 31 in the sheet conveying direction and upstream from the transfer roller 7 as a downstream sheet conveying roller in the sheet conveying direction. The CIS 38 has a substantially identical configuration to the CIS 36, except the CIS 36 and the CIS 38 are disposed at different positions. The CIS 38 and the CIS 36 that also functions as the second detector function as the third detector to perform recorrection (fine adjustment, the secondary correction) to the lateral shift correction and the skew correction of the recording medium P.

Then, the pair of sheet holding rollers 31 rotates from the above-described reference position while holding the recording medium P so as to further correct the inclination amount β of the recording medium P to the oblique side in the sheet conveying direction based on the results detected by the CIS 36 and the CIS 38 and moves in the width direction from the above-described reference position while the recording medium P is being held by the pair of sheet holding rollers 31 so as to further correct the lateral shift amount α in the width direction of the recording medium P based on the results detected by the CIS 36.

Specifically, the CIS 38 detects the side edge Pa on the leading edge side of the recording medium P and the CIS 36 detects the side edge Pa on the trailing edge side of the recording medium P. By so doing, the inclination (skew) amount β of the recording medium P is detected based on the respective distances of the CIS 36 and the CIS 38 in the sheet conveying direction. Then, similarly to the above-described skew correction based on the results detected by the first pair of skew detecting sensors 35, the pair of sheet holding rollers 31 performs the skew correction based on the detected inclination (skew) amount β while the pair of sheet holding rollers 31 is holding the recording medium P therebetween.

Further, the CIS 36 functions as both the second detector and the third detector. The CIS 36 is disposed upstream from the pair of sheet holding rollers 31 in the sheet conveying direction and detects the lateral shift amount α in the width direction of the recording medium P after the lateral shift of the recording medium P has been corrected, while the pair of sheet holding rollers 31 is holding the recording medium P therebetween. Similarly to the operation as the second detector, the CIS 36 when functioning as the third detector detects the lateral shift amount by detecting the side edge Pa at one end in the width direction of the recording medium P. Then, similarly to the lateral shift correction based on the results detected by the CIS 36 when functioning as the second detector, the lateral shift correction is performed to the recording medium P based on the results detected by the CIS 36 as the third detector, while the pair of sheet holding rollers 31 is holding the recording medium P therebetween.

As described above, except that the CIS 36 and the CIS 38 are used to detect the skew amount after the skew correction, this configuration of the sheet conveying device 30 can perform the skew correction substantially similarly to the operations described with reference to FIGS. 27A through 27F and 28A through 28F, and can achieve the substantially similar effect to the previously described example of this disclosure.

Figure 30:
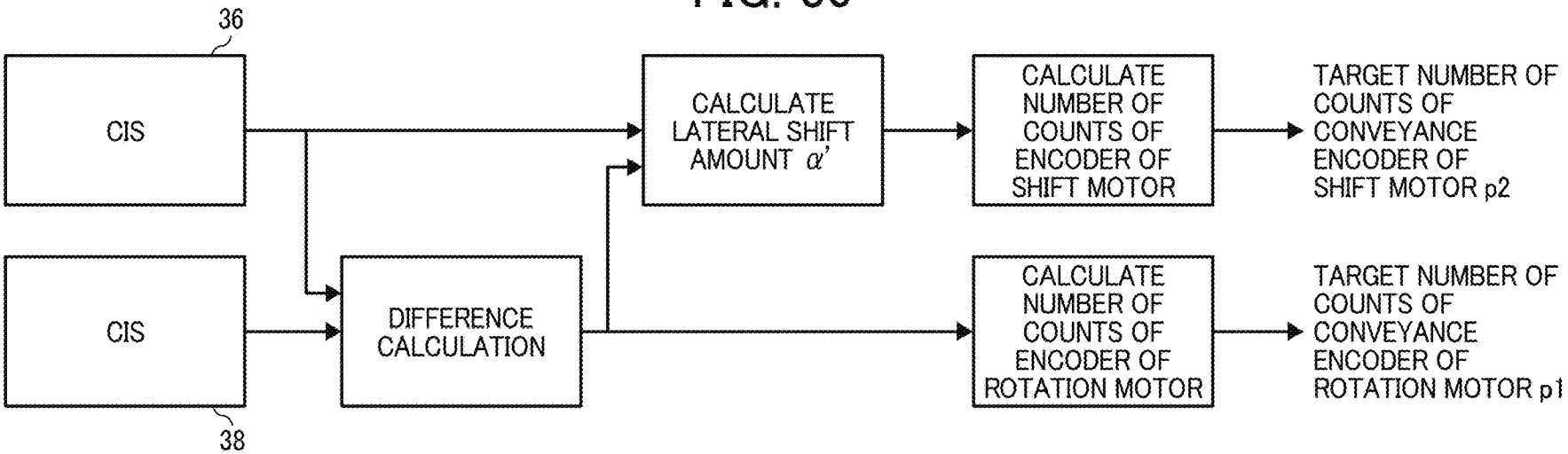
FIG. 30 is a flowchart showing control for recorrection performed in the sheet conveying device of FIGS. 29A and 29B.

Specifically, as illustrated in FIG. 30, the calculator (the controller 340) calculates the inclination amount β' of the recording medium P to the oblique side in the sheet conveying direction based on a difference between the results detected by the CIS 36 and the results detected by the CIS 38. The calculator (the controller 340) then calculates the number of counts p1 of the encoder 320 (the number of counts of the rotary motor encoder 320) of the second driving motor 62 based on the calculated inclination amount β'. Then, the number of counts p1 is stored as "the number of counts p1 of a target sheet conveying encoder" of the second driving motor 62 (the rotary motor).

As described in FIG. 24, the controller 340 (the rotary controller 340) controls the motor driver 370 based on the number of counts p1 of the target sheet conveying encoder calculated in the configuration illustrated in FIG. 30, while detecting the rotation position by the rotary motor encoder 320 (while performing the feedback control). Then, the second driving motor 62 (the rotary motor) is driven to rotate.

Further, as illustrated in FIG. 30, the calculator (the controller 350) calculates the lateral shift amount α' in the width direction of the recording medium P based on the results detected by the CIS 36 and the above-described difference. Thereafter, the number of counts p2 of the encoder 330 (the number of counts of the shift motor encoder 330) of the third driving motor 63 is calculated based on the lateral shift amount α'. Then, the number of counts p2 is stored as "the number of counts p2 of a target sheet conveying encoder" of the third driving motor 63 (a shift motor).

Further, as illustrated in FIG. 24, while detecting the shift position by the shift motor encoder 330 (while performing the feedback control) based on the number of counts p2 of the target sheet conveying encoder calculated as illustrated in FIG. 30, the controller 350 (the shift controller 350) controls the motor driver 380, and then the third driving motor 63 (the shift motor) is driven to rotate.

It is to be noted that, for calculation of "the number of counts of a target sheet conveying encoder", a correction amount (a conveying amount) per count (pulse) is previously obtained by calculating based on the set value and stored in the calculator.

It is to be noted that, as illustrated in FIGS. 29A and 29B, the pair of sheet holding rollers 31 can be controlled to move from the reference position in the width direction while holding the recording medium P, so that the lateral shift amount α in the width direction of the recording medium P can be further detected by the feedback control based on the results continuously detected by the CIS 36 (or the CIS 38).

Figure 31:
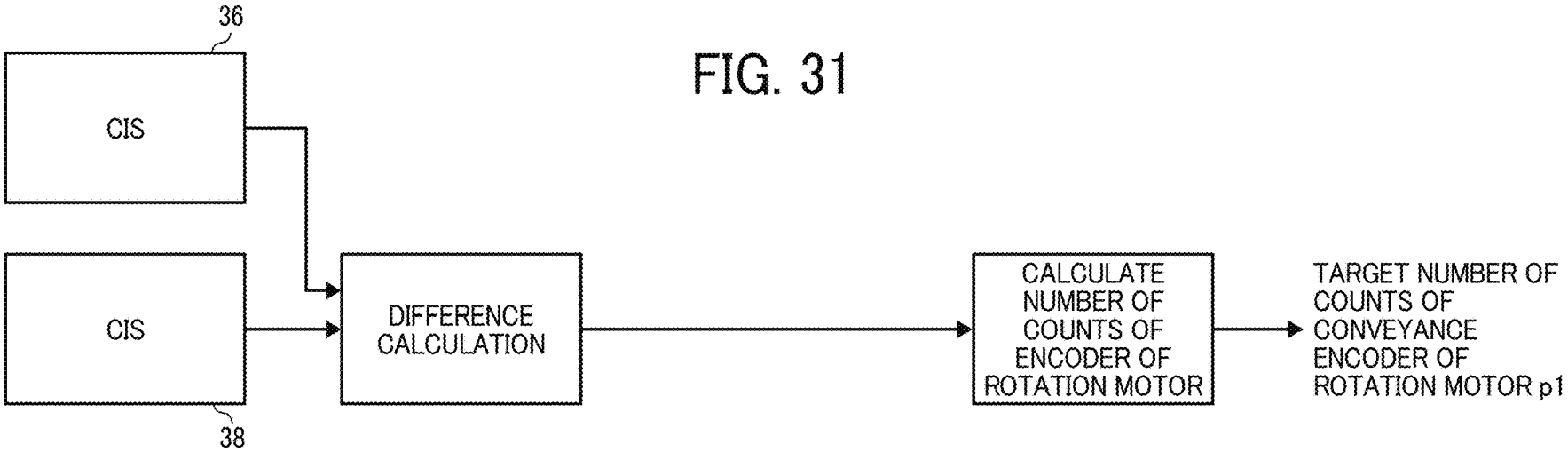
FIG. 31 is a flowchart showing another control for recorrection performed in the sheet conveying device of FIGS. 29A and 29B.

Specifically, as illustrated in FIG. 31, the controller 340 calculates the inclination amount β' of the recording medium P to the oblique side in the sheet conveying direction based on a difference between the results detected by the CIS 36 and the results detected by the CIS 38. Thereafter, the number of counts p1 of the encoder 320 (the number of counts of the rotary motor encoder 320) of the second driving motor 62 is calculated based on the calculated inclination amount β'. Then, the number of counts p1 is stored as "the number of counts p1 of a target sheet conveying encoder" of the second driving motor 62 (the rotary motor).

Then, as illustrated in FIG. 26A, while detecting the rotation position by the rotary motor encoder 320 (while performing the feedback control) based on the number of counts p1 of the target sheet conveying encoder calculated in FIG. 31, the controller 340 (the rotary controller 340) controls the motor driver 370, and then the second driving motor 62 (the rotary motor) is driven to rotate.

Further, the calculator (the controller 350) continuously calculates the lateral shift amount α' in the width direction of the recording medium P based on the results detected by the CIS 36 (or the CIS 38), and then performs the feedback control so that the lateral shift amount α' becomes zero. Specifically, as illustrated in FIG. 26B, while detecting the shift position by the CIS 36 (or the CIS 38) with respect to the reference position for the lateral shift (while performing the feedback control), the controller 350 (the shift controller 350) controls the motor driver 380, and then the third driving motor 63 (the shift motor) is driven to rotate.

Further, the pair of sheet holding rollers 31 can be controlled to rotate from the reference position while holding the recording medium P, so that the inclination amount β of the recording medium P to the oblique side in the sheet conveying direction can be further corrected by the feed back control based on the results continuously detected by the CIS 36 and the CIS 38.

Figure 32:
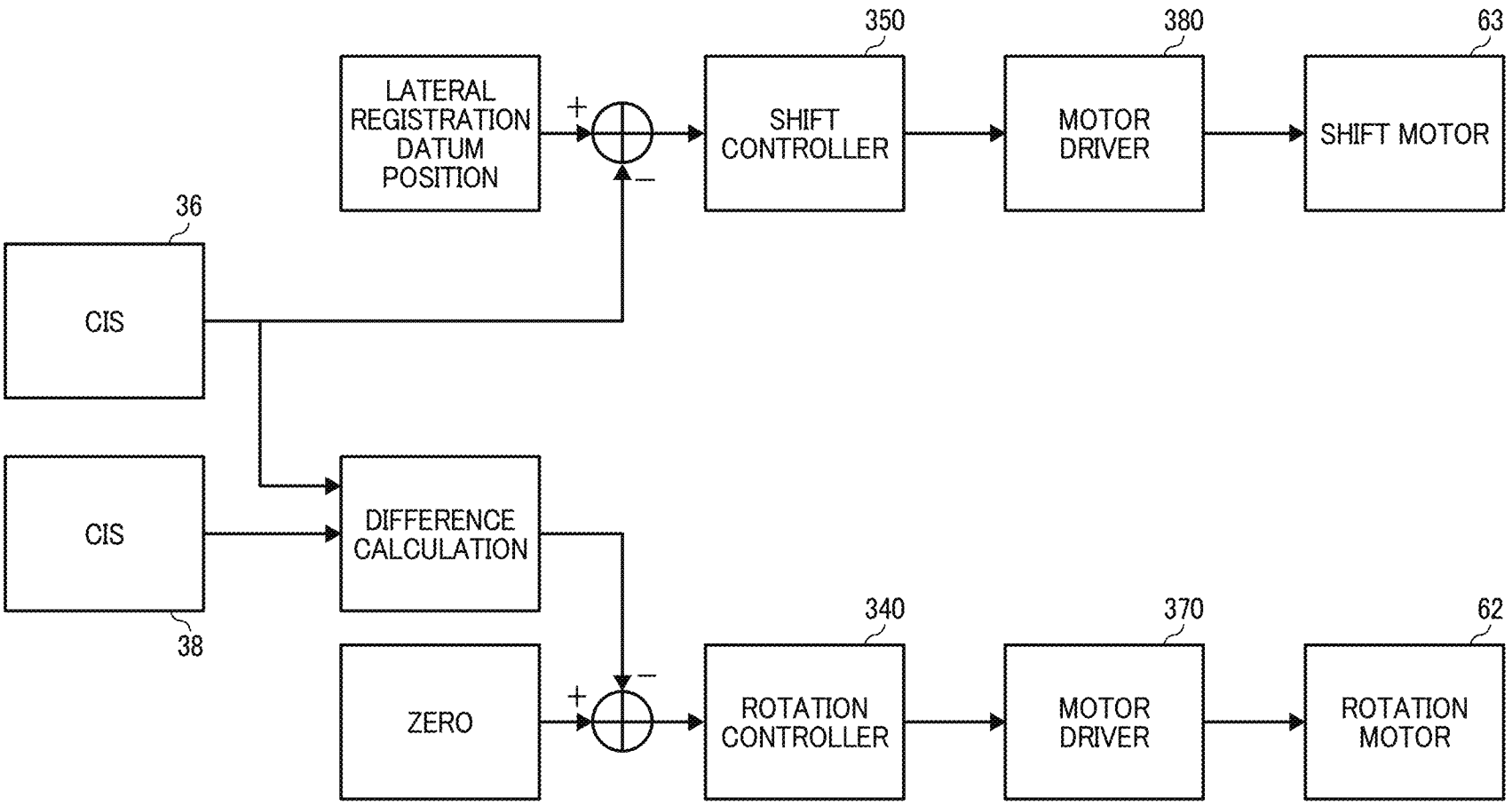
FIG. 32 is a flowchart showing yet another control for recorrection performed in the sheet conveying device of FIGS. 29A and 29B.

Specifically, as illustrated in FIG. 32, the calculator (the controller 340) continuously calculates the inclination amount β' of the recording medium P to the oblique side in the sheet conveying direction based on a difference between the results detected by the CIS 36 and the CIS 38, and then performs the feedback control so that the inclination amount β' becomes zero. Specifically, while detecting the rotation position by the CIS 36 and the CIS 38 (while performing the feedback control) with respect to a reference position having zero inclination amount β' (no oblique shift in the sheet conveying direction), the controller 340 (the rotary controller 340) controls the motor driver 370, and then the second driving motor 62 (the rotary motor) is driven to rotate.

Further, as illustrated in FIG. 32, the calculator (the controller 350) continuously calculates the lateral shift amount α' in the width direction of the recording medium P based on the results detected by the CIS 36, and then performs the feedback control so that the lateral shift amount α' becomes zero. Specifically, while detecting the shift position by the CIS 36 with respect to the reference position for the lateral shift (while performing the feedback control), the controller 350 (the shift controller 350) controls the motor driver 380, and then the third driving motor 63 (the shift motor) is driven to rotate.

As described above, in the present example, the pair of sheet holding rollers 31 rotates from the reference position before holding the recording medium P and returns to the reference position after holding the recording medium P so that the inclination amount β of the recording medium P to the oblique side in the sheet conveying direction is corrected based on the results detected by the first pair of skew detecting sensors 35 (the first detector). At the same time, the pair of sheet holding rollers 31 moves from the reference position in the width direction before holding the recording medium P and returns to the reference position after holding the recording medium P so that the lateral shift amount α in the width direction of the recording medium P is corrected based on the results detected by the CIS 36 (the second detector). Then, the CIS 36 and the second pair of skew detecting sensors 37 (the third detector) detect the positional shift amounts of the recording medium P in the width direction and to the oblique side in the sheet conveying direction after the pair of sheet holding rollers 31 has corrected the positional shift amounts of the recording medium P in the width direction and to the oblique side in the sheet conveying direction. Based on the results detected by the third detector, the positional shift amounts of the recording medium P in the width direction and to the oblique side in the sheet conveying direction are further corrected.

With the above-described operation, the skew correction and the lateral shift correction of the recording medium P can be performed more precisely without causing positional shift of the recording medium P in the width direction and to the oblique side in the sheet conveying direction after the pair of sheet holding rollers 31 has performed the skew correction and the lateral shift correction of the recording medium P and degrading the productivity of the sheet conveying device 30 included in the image forming apparatus 1.

Next, a description is given of another configuration of the sheet conveying device 30 according to an example of this disclosure, with reference to FIGS. 33 through 36F.

Figure 33:
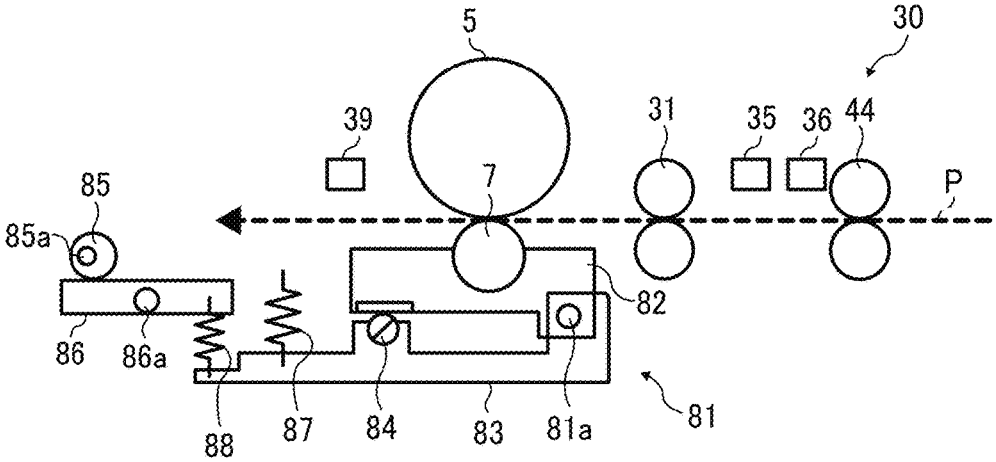
FIG. 33 is a schematic diagram illustrating the sheet conveying device according to another example of this disclosure.

FIG. 33 is a schematic diagram illustrating the sheet conveying device 30 according to the present example. FIGS. 35A through 35F and 36A through 36F are schematic diagrams illustrating operations performed by the sheet conveying device 30 according to the present example. The operations illustrated in FIGS. 35A through 35F and 36A through 36F correspond to the operations illustrated in FIGS. 27A through 27F and 28A through 28F.

The sheet conveying device 30 according to the present example basically has an identical configuration to the sheet conveying device 30 according to the previously described example of this disclosure, except that a third detector is disposed downstream from the transfer roller 7 in the sheet conveying direction to detect the inclination (skew) amount of the recording medium P that is conveyed to the downstream side of the image forming part 4 in the sheet conveying direction. With this configuration, a contact pressure applied by the transfer roller 7 to the photoconductor drum 5 is changed based on the skew amount detected by the third detector before the skew of the recording medium P is corrected again.

Similar to the configuration of the sheet conveying device 30 according to the previously described example, the sheet conveying device 30 according to the present example includes the third pair of sheet conveying rollers 44, the CIS 36 that functions as a second detector, the first pair of skew detecting sensors 35 that functions as a first detector, and the pair of sheet holding rollers 31 (the pair of lateral shift and skew correction rollers) that is provided to the matching unit 51 and functions as a pair of registration rollers in this order along the straight sheet conveying path 103 of the recording medium P, which is a sheet conveying path from the merging point X to the transfer roller 7.

Different from the sheet conveying device 30 according to the previously described example, the sheet conveying device according to the present example further includes a CIS 39. The CIS 39 is disposed downstream from the transfer nip region formed between the photoconductor drum 5 and the transfer roller 7 and functions as a third detector together with the CIS 36. The third detector formed by the CIS 36 and the CIS 39 detects the inclination amount (skew amount) β of the recording medium P to the oblique side in the sheet conveying direction when the recording medium P is conveyed to the downstream side of the sheet conveying path with respect to the transfer roller 7 of the image forming part 4 in the sheet conveying direction.

Specifically, the CIS 39 includes multiple photosensors aligned along the width direction of the recording medium P and is disposed downstream of the sheet conveying path from the transfer roller 7 of the image forming part 4 in the sheet conveying direction. The CIS 39 has a substantially identical configuration to the CIS 36, except the CIS 36 and the CIS 39 are disposed at different positions. The CIS 39 and the CIS 36 that also functions as the second detector function as the third detector to perform recorrection (fine adjustment, the secondary correction) to the skew correction of the recording medium P. Specifically, the CIS 39 detects the side edge Pa on the leading edge side of the recording medium P, and simultaneously, the CIS 36 detects the side edge Pa on the trailing edge side of the recording medium P. Then, based on the distances from the CIS 36 and the CIS 39 in the sheet conveying direction, the inclination (skew) amount β of the recording medium P is detected.

Further, the sheet conveying device 30 according to the present example of this disclosure further includes a pressure adjusting device 81. The pressure adjusting device 81 functions as a pressure adjuster to change a contact pressure (a pressing force) applied by the transfer roller 7 to the photoconductor drum 5 that functions as an image bearer.

Specifically, as illustrated in FIG. 33, the pressure adjusting device 81 that functions as a pressure varying device includes a support frame 82, a first arm 83, a pressing part 84, a cam 85, a second arm 86, a first tension spring 87, and a second tension spring 88.

The support frame 82 rotatably support the transfer roller 7 with respect to the apparatus body of the image forming apparatus 1 and rotates about a support shaft 81*a* that rotatably supports the support frame 82. The support shaft 81*a* also rotatably supports the first arm 83.

The pressing part 84 is provided to the center of the first arm 83 to contact and press the support frame 82.

One end of the first tension spring 87 and one end of the second tension spring 88 are aligned next to each other at one end of the first arm 83. The other end of the first tension spring 87 is connected to the apparatus body of the image forming apparatus 1.

The second tension spring 88 has a spring force smaller than that of the first tension spring 87 and the other end thereof is connected to the one end of the second arm 86.

The second arm 86 is rotatably supported about the support shaft 86*a* with respect to the apparatus body of the image forming apparatus 1.

The cam 85 is in contact with the other end of the second arm 86. The cam 85 is connected to a driving motor so as to rotate about the rotary shaft 85*a*.

With the above-described configuration, the second arm 86 rotates about the support shaft 86*a* due to rotation of the cam 85 with the direction and angle of rotation thereof controlled by an encoder. By so doing, the spring force of the second tension spring 88 is adjusted (increased or decreased). Accordingly, the first arm 83 rotates vertically about the support shaft 81*a*. With this operation, a pressing force (and a point of effort) of the pressing part 84 to press the support frame 82 changes, and therefore the contact pressure of the transfer roller 7 to the photoconductor drum 5 is adjusted to an arbitrary value.

This pressure adjusting device 81 includes these two springs 87 and 88 having different spring forces to actively adjust (increase or decrease) the length of the second tension spring 88 having a smaller spring force, so that the contact pressure of the transfer roller 7 is changed. Therefore, relatively highly precise adjustment of the contact pressure can be performed.

It is to be noted that the sheet conveying device 30 according to the present example employs a cam mechanism to rotate the second arm 86 about a support shaft 86*a*. However, the configuration of the sheet conveying device 30 is not limited thereto. For example, the sheet conveying device 30 can employ a gear mechanism to rotate the second arm 86 about the support shaft 86*a*.

Then, in the present example, the pressure adjusting device 81 that functions as a pressure adjuster changes and adjusts the contact pressure of the transfer roller 7 to the photoconductor drum 5 while the recording medium P is being held by the transfer roller 7 and the photoconductor drum 5, so that the inclination amount β of the recording medium P to the oblique side in the sheet conveying direction is further corrected based on the results detected by the third detector, i.e., the CIS 36 and the CIS 39.

Specifically, if the third detector, i.e., the CIS 36 and the CIS 39, detects that the skew amount of the recording medium P that is conveyed from the transfer nip is large, when compared to a case in which the third detector detects that the skew amount of the recording medium P is small, the pressure adjusting device is controlled to adjust the contact pressure of the transfer roller 7 to be smaller.

Figure 34:
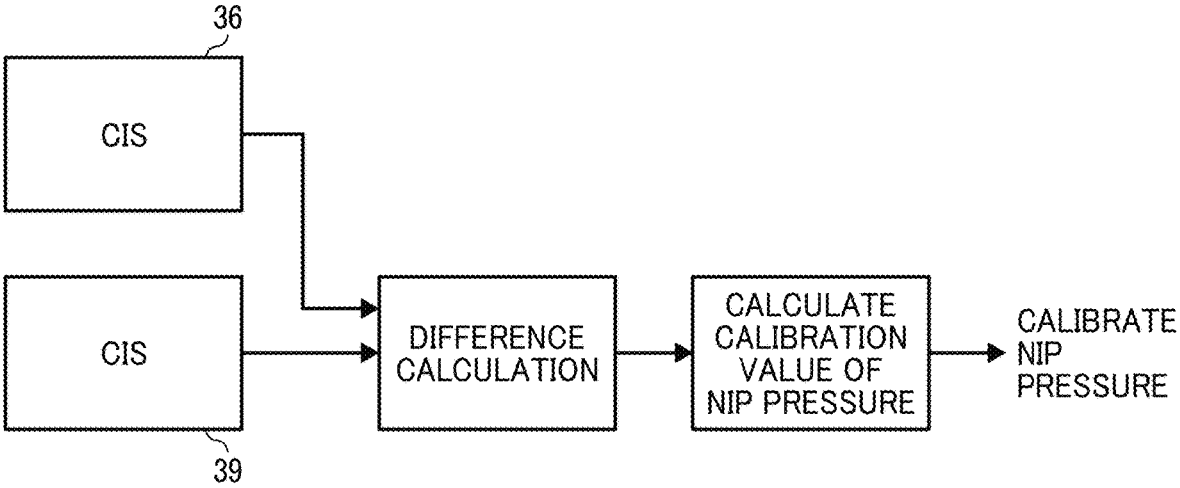
FIG. 34 is a flowchart showing control for recorrection performed in the sheet conveying direction of FIG. 33.

Specifically, as illustrated in FIG. 34, the calculator (the controller) calculates the correction value of the nip pressure applied in the transfer nip region of the transfer roller 7 of the image forming part 4 based on a difference between the results detected by the CIS 36 and the results detected by the CIS 39. Then, the pressure adjusting device 81 corrects the nip pressure of the transfer roller 7 of the image forming part 4.

It is to be noted that the relation of a difference between the results detected by the CIS 36 and the CIS 39 and a correction value of the nip pressure of the transfer roller 7 is previously obtained by a test or tests and the obtained correction value is stored in the calculator (the controller).

This control is performed to address occurrence of skew of the recording medium P when eccentricity of either or both of the transfer roller 7 and the photoconductor drum 5 is generated. In a case in which any eccentricity of either or both of the transfer roller 7 and the photoconductor drum 5 is generated, the contact pressure (the contact force) of the transfer roller 7 and the photoconductor drum 5 is reduced, thereby reducing the skew amount.

By contrast, in the present example, the lateral shift correction and the skew correction are once performed based on the results detected before the recording medium P is held by the pair of sheet holding rollers 31 while the pair of sheet holding rollers 31 is holding and conveying the recording medium P. Thereafter, the third detector detects the skew amount of the recording medium P that is conveyed and passed the image forming part 4. Based on the results detected by the third detector, the contact pressure applied by the transfer roller 7 is adjusted while the recording medium P is being conveyed, so as to conduct the skew correction again. Therefore, the chances of occurrence of eccentricity of either or both of the transfer roller 7 and the photoconductor drum 5 is restricted, thereby performing the skew correction more precisely.

In the present example, the pair of sheet holding rollers 31 rotates from the reference position before holding the recording medium P and returns to the reference position after holding the recording medium P so that the inclination amount β of the recording medium P to the oblique side in the sheet conveying direction is corrected based on the results detected by the first pair of skew detecting sensors 35 (the first detector). Thereafter, the pair of sheet holding rollers 31 moves from the reference position to the oblique side in the sheet conveying direction while holding the recording medium P so that the inclination amount β of the recording medium P to the oblique side in the sheet conveying direction is further corrected by the feedback control based on the results detected by the CIS 36 (the second detector) while the recording medium P is detected by the third detector that is the CIS 36 and the CIS 39 (while the recording medium P reaches the CIS 39).

Specifically, the CIS 36 continuously detects the lateral shift of the recording medium P that is held and conveyed by the pair of sheet holding rollers 31 until the recording medium P reaches the CIS 39. Then, the skew amount of the recording medium P is obtained based on the results detected by the CIS 36, detection intervals, and the speed of conveyance of the recording medium P. Then, based on the detected results of the skew amount of the recording medium P, the well responsive recorrection (the secondary correction) of the skew of the recording medium P is continued so that the recording medium P matches the normal position, which is a position that has no skew to the oblique side in the sheet conveying direction. After the recording medium P has reached the CIS 39, the operation is switched to the skew correction based on the results detected by the third detector including the CIS 36 and the CIS 39.

According to the above-described control, the skew correction of the recording medium P is continuously performed. Therefore, the skew correction can be performed more precisely.

Next, a description is given of an operation of the sheet conveying device 30 having the above-described configuration, with reference to FIGS. 35A through 35F and 36A through 36F.

It is to be noted that FIGS. 35A, 35C, and 35E and FIGS. 36A and 36C are top views illustrating the operations of the sheet conveying device 30 and FIGS. 35B, 35D, 35F, 36A, and 36C are side views corresponding to the operations of the sheet conveying device 30 illustrated in FIGS. 35A, 35C, 35E, 36A, 36C, respectively.

Figure 35A:
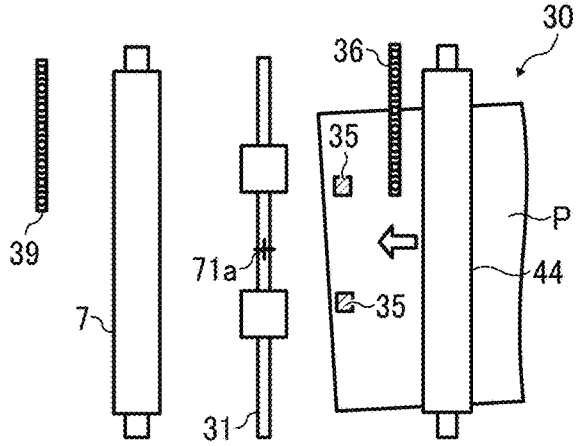
FIG. 35A is a top view illustrating operations of the sheet conveying device of FIG. 33.
Figure 35B:
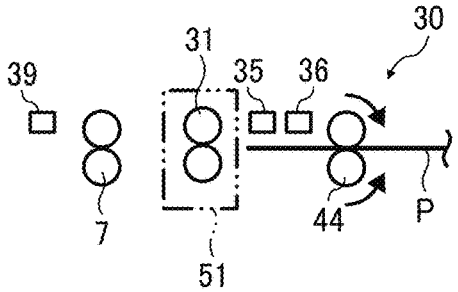
FIG. 35B is a side view illustrating operations of the sheet conveying device of FIG. 33.

First, as illustrated in FIGS. 35A and 35B, the recording medium P fed from the sheet feeding part 12 is held and conveyed by the third pair of sheet conveying rollers 44 toward the pair of sheet holding rollers 31 in a direction indicated by white arrow. At this time, the position of the pair of sheet holding rollers 31 in the rotation direction is located in the first reference position, which is a normal position corresponding to the recording medium P that has no skew, and the position thereof in the width direction is located in the second reference position, which is a normal position corresponding to the recording medium P that has no lateral shift.

Then, upon arrival of the recording medium P to the CIS 36 (the second detector), the CIS 36 detects the lateral shift amount α in the width direction of the recording medium P. Further, upon arrival of the recording medium P to the first pair of skew detecting sensors 35 (the first detector), the first pair of skew detecting sensors 35 detects the skew amount β of the recording medium P.

Figure 35C:
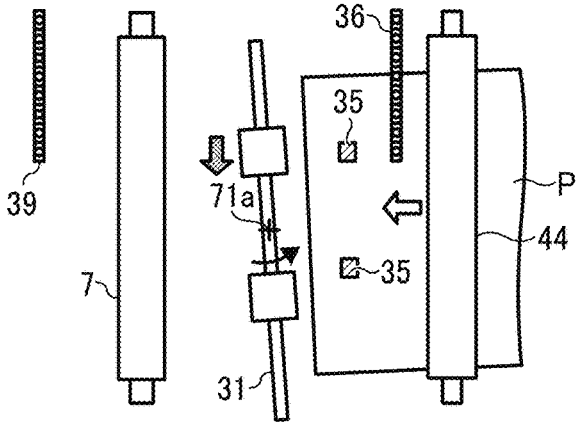
FIG. 35C is a top view illustrating operations of the sheet conveying device of FIG. 33.
Figure 35D:
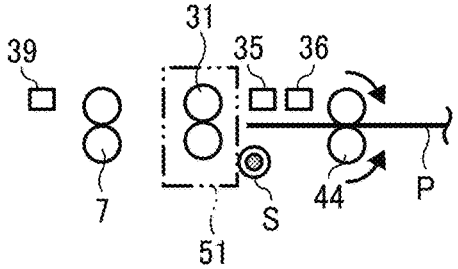
FIG. 35D is a side view illustrating operations of the sheet conveying device of FIG. 33.

Then, as illustrated in FIGS. 35C and 35D, the pair of sheet holding rollers 31 together with the support 72 rotates by the inclination amount (angle) β about the shaft 71*a* from the first reference position to the same oblique side in the sheet conveying direction, corresponding to the skew amount β detected by the first pair of skew detecting sensors 35, and shifts by the lateral shift amount (distance) a from the second reference position in the width direction, corresponding to the lateral shift amount α detected by the CIS 36.

Figure 35E:
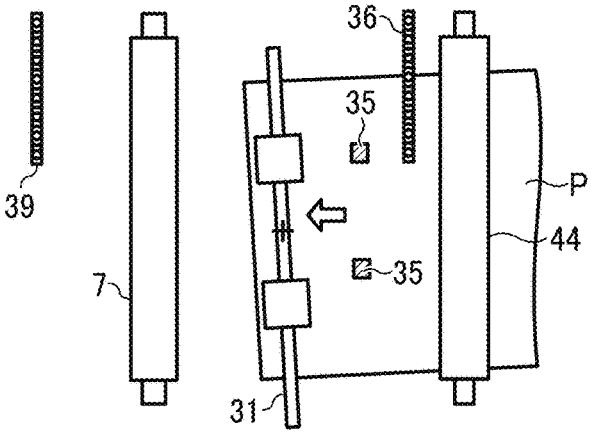
FIG. 35E is a top view illustrating operations of the sheet conveying device of FIG. 33.
Figure 35F:
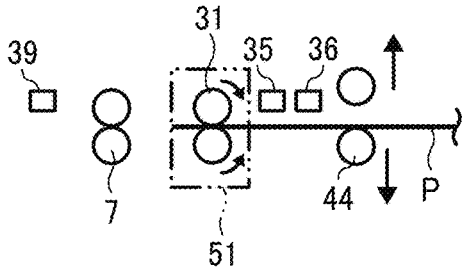
FIG. 35F is a side view illustrating operations of the sheet conveying device of FIG. 33.

Then, as illustrated in FIGS. 35E and 35F, (driving and) rotation of the pair of sheet holding rollers 31 in a direction indicated by arrow in the drawings is started immediately before the leading edge of the recording medium P reaches the pair of sheet holding rollers 31. When the recording medium P is held and conveyed by the pair of sheet holding rollers 31, the sheet conveying path is open and rollers of the third pair of sheet conveying rollers 44 separate in a direction in which the pair of sheet holding rollers 31 does not hold the recording medium P (in a direction indicated by solid line).

Figure 36A:
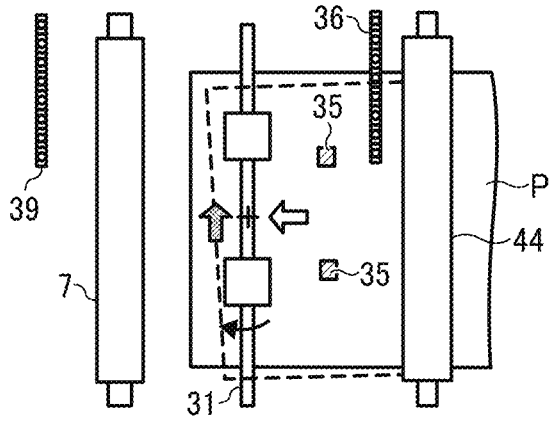
FIG. 36A is a top view illustrating operations of the sheet conveying device subsequent to the operations of FIGS. 35A through 35F.
Figure 36B:
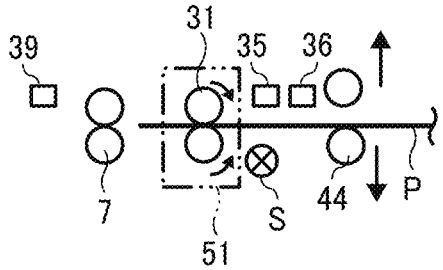
FIG. 36B is a side view illustrating operations of the sheet conveying device subsequent to the operations of FIGS. 35A through 35F.

Then, as illustrated in FIGS. 36A and 36B, the pair of sheet holding rollers 31 rotates about the shaft 71*a* with respect to the sheet conveying direction while holding and conveying the recording medium P to return to the first reference position, so that the skew amount β detected by the first pair of skew detecting sensors 35 is offset. And, at the same time, the pair of sheet holding rollers 31 moves in the width direction while holding and conveying the recording medium P to return to the second reference position, so that the lateral shift amount α detected by the CIS 36.

Then, the recording medium P is conveyed toward the transfer roller 7 of the image forming part 4. At this time, the number of rotations of the pair of sheet holding rollers 31, i.e., the speed of conveyance of the recording medium P until the recording medium P reaches the transfer roller 7, is changed and adjusted so as to synchronize with movement of the image formed on the photoconductor drum 5. By so doing, the recording medium P is conveyed to the transfer roller 7, where the image on the photoconductor drum 5 is transferred onto a desired position on the recording medium P.

Figure 36C:
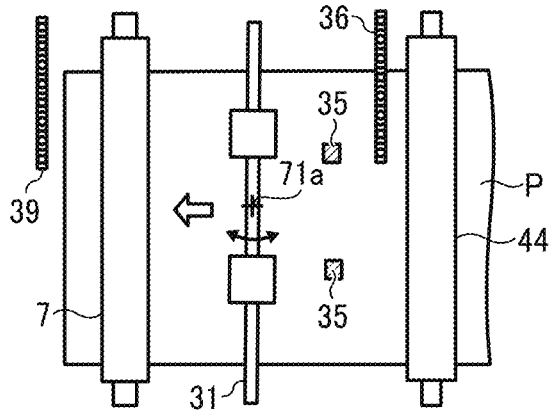
FIG. 36C is a top view illustrating operations of the sheet conveying device subsequent to the operations of FIGS. 35A through 35F.
Figure 36D:
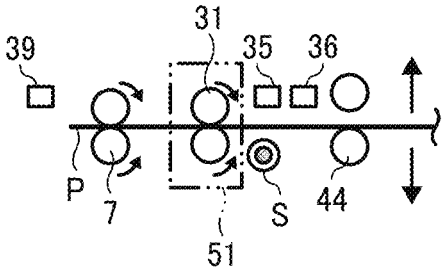
FIG. 36D is a side view illustrating operations of the sheet conveying device subsequent to the operations of FIGS. 35A through 35F.

Here, as illustrated in FIGS. 36C and 36D, the CIS 36 detects the skew amount β' of the recording medium P after corrected in the operation illustrated in FIGS. 36A and 36B until the recording medium P reaches the CIS 39 functioning as the third detector by the previously described operations. Then, the pair of sheet holding rollers 31 rotates together with the support 72 from the first reference position by the inclination angle β' about the shaft 71*a* to a different (opposite) oblique side in the sheet conveying direction to match the skew amount β' detected by the CIS 36.

Figure 36E:
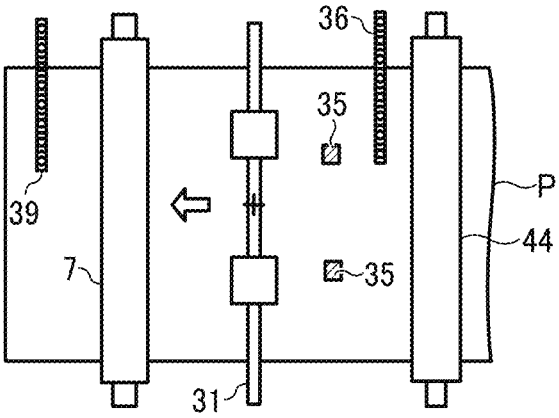
FIG. 36E is a top view illustrating operations of the sheet conveying device subsequent to the operations of FIGS. 35A through 35F.
Figure 36F:
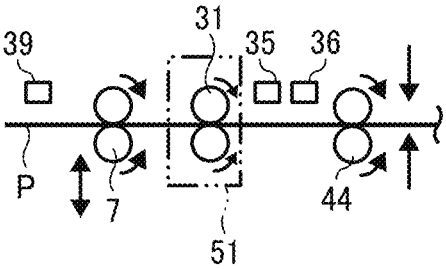
FIG. 36F is a side view illustrating operations of the sheet conveying device subsequent to the operations of FIGS. 35A through 35F.

Then, as illustrated in FIGS. 36E and 36F, upon arrival of the recording medium P conveyed from the transfer roller 7 to the CIS 39, the CIS 36 and the CIS 39 functioning as the third detector detect a skew amount β" of the recording medium P. Then, the pressure adjusting device 81 changes and adjusts the contact pressure of the transfer roller 7 to the photoconductor drum 5 according to the skew amount β" detected by the CIS 36 and the CIS 39. By so doing, the rollers of the third pair of sheet conveying rollers 44, which have been separated apart from each other as illustrated in FIG. 35B, are brought back into contact with each other. In this state, the third pair of sheet conveying rollers 44 assists the pair of sheet holding rollers 31 to convey the recording medium P and, at the same time, prepares for next conveyance of a subsequent recording medium P.

Thereafter, after the trailing edge of the recording medium P has passed the pair of sheet holding rollers 31, the pair of sheet holding rollers 31 returns to the first and second reference positions in order to prepare for next skew correction and lateral shift correction of a subsequent recording medium P.

It is to be noted that, as it is assumed that the skew amount added to the recording medium P after the recording medium P has passed the transfer roller 7 of the image forming part 4 is caused by eccentricity of the transfer roller 7 and so forth, the pressure adjusting device 81 is controlled to maintain the contact pressure of the transfer roller 7.

As described above, similarly to the previously described example, the pair of sheet holding rollers 31 in the present example rotates from the reference position to the oblique side in the sheet conveying direction before holding the recording medium P therebetween so that the inclination amount β of the recording medium P to the oblique side in the sheet conveying direction is corrected based on the results detected by the first pair of skew detecting sensors 35 (the first detector), and then rotates to return to the reference position after holding the recording medium P. At the same time, the pair of sheet holding rollers 31 moves from the reference position in the width direction before holding the recording medium P so that the lateral shift amount α in the width direction of the recording medium P is corrected based on the results detected by the CIS 36 (the second detector), and then moves in the width direction to return to the reference position after holding the recording medium P.

After the pair of sheet holding rollers 31 has corrected the positional shift amounts of the recording medium P both in the width direction and in the sheet conveying direction, the CIS 36 and the CIS 39 functioning as the third detector detect the inclination amount β of the recording medium P to the oblique side in the sheet conveying direction. Then, the inclination amount β of the recording medium P to the oblique side in the sheet conveying direction is further corrected based on the results detected by the CIS 36 and the CIS 39.

By so doing, the recording medium P after the skew and the lateral shift are corrected by the pair of sheet holding rollers 31 does not incline in the sheet conveying direction. As a result, the skew correction and the lateral shift correction of the recording medium can be performed highly precisely without decreasing the productivity of the sheet conveying device 30 included in the image forming apparatus 1.

It is to be noted that each configuration of the above-described examples employs the pair of sheet holding rollers 31 that functions as a pair of lateral shift and skew correction rollers also functions as a pair of registration rollers in the sheet conveying device 30. However, the configuration of the sheet conveying device applicable to this disclosure is not limited thereto. That is, any other configuration can be applied to the sheet conveying device according to this disclosure as long as the sheet conveying device performs the skew correction and the lateral shift correction. For example, the sheet conveying device that has a pair of registration rollers disposed downstream from the pair of sheet holding rollers 31 functioning as a pair of lateral shift and skew correction rollers can be applied to this disclosure.

Further, in the above-described examples, the sheet conveying device 30 performs the skew correction and the lateral shift correction of a transfer sheet as the recording medium P on which an image is formed. However, this disclosure is also applicable to the sheet conveying device 30 performs the skew correction and the lateral shift correction of an original document as the recording medium P.

Further, in the above-described examples, the sheet conveying device 30 is provided to the image forming apparatus 1 for creating monochrome or black and white copies. However, the sheet conveying device 30 is not limited thereto and can be provided to a color image forming apparatus.

Further, in the above-described examples, the sheet conveying device 30 is provided to the electrophotographic image forming apparatus 1. However, the sheet conveying device 30 is not limited thereto and can be provided to any other type of image forming apparatuses (for example, an inkjet image forming apparatus and an offset printing machine) as long as the sheet conveying device 30 performs the skew correction and the lateral shift correction of the recording medium P.

Further, the above-described configurations can achieve the same effect as each configuration of the sheet conveying device 30 and the image forming apparatus 1.

Further, each configuration of the above-described examples employs each of the CIS 36, the CIS 38, and the CIS 39 as the second detector or the third detector to be applied to this disclosure. However, the configuration is not limited thereto. For example, instead of these CISs 36, 38, and 39, a transparent type edge sensor can be employed as a sensor to detect the position at the end part of the recording medium P in the width direction.

As described above, it is to be noted that the "width direction" is defined as a direction perpendicular to the sheet conveying direction of the recording medium P.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a pair of rotary bodies configured to convey a sheet and to correct a skew of the sheet;

a detector configured to detect a side edge of the sheet in a width direction of the sheet, the detector including a downstream sensor downstream from the pair of rotary bodies in a conveyance direction of the sheet; and a controller configured to control the pair of rotary bodies to, perform a primary skew correction in which the pair of rotary bodies is configured to (i) rotate from a reference position around a shaft in an opposite direction, which is opposite to a predetermined direction, before the pair of rotary bodies holds the sheet, and (ii) rotate in the predetermined direction around the shaft after the pair of rotary bodies holds the sheet, and perform a secondary skew correction performed after the primary skew correction in which the pair of rotary bodies is configured to rotate around the shaft while the pair of rotary bodies conveys the sheet and after a leading edge of the sheet arrives at the downstream sensor.

2. The sheet conveying device according to claim 1, wherein the controller is configured to control the pair of rotary bodies to, perform the primary skew correction in which the pair of rotary bodies is configured to (i) rotate from the reference position around the shaft in the opposite direction based on a first detection result by the detector before the pair of rotary bodies holds the sheet, and (ii) rotate in the predetermined direction around the shaft after the pair of rotary bodies holds the sheet, and perform the secondary skew correction performed after the primary skew correction in which the pair of rotary bodies is configured to rotate around the shaft based on a second detection result by the detector while the pair of rotary bodies conveys the sheet.

3. The sheet conveying device according to claim 2, wherein the detector includes a first sensor upstream from the pair of rotary bodies in the conveyance direction of the sheet;

a second sensor downstream from the first sensor and upstream from the pair of rotary bodies in the conveyance direction of the sheet; and wherein the first direction result is obtained by the first sensor and the second sensor, and the second detection result is obtained by the second sensor and the downstream sensor.

4. The sheet conveying device according to claim 3, wherein the first sensor, the second sensor and the downstream sensor include a contact image sensor, respectively.

5. The sheet conveying device according to claim 2, wherein the pair of rotary bodies is configured to correct a shift of the sheet in the width direction, and the controller is configured to control the pair of rotary bodies to, perform a primary shift correction in which the pair of rotary bodies is configured to (i) shift from the reference position in an opposite shift direction, which is opposite to a predetermined shift direction, based on the first detection result by the detector before the pair of rotary bodies holds the sheet, and (ii) shift in the predetermined shift direction after the pair of rotary bodies holds the sheet, and perform a secondary shift correction performed after the primary shift correction in which the pair of rotary bodies is configured to shift based on the second detection result by the detector while the pair of rotary bodies conveys the sheet.

6. The sheet conveying device according to claim 5, wherein the detector includes a plurality of sensors, and each of the first detection result and the second detection result is obtained by at least one of the plurality of sensors.

7. The sheet conveying device according to claim 2, wherein the detector includes a plurality of sensors, and each of the first detection result and the second detection result is obtained by at least one of the plurality of sensors.

8. The conveying device according to claim 1, wherein the pair of rotary bodies is configured to correct a shift of the sheet in the width direction, and the controller is configured to control the pair of rotary bodies to, perform a primary shift correction in which the pair of rotary bodies is configured to (i) shift from the reference position in an opposite shift direction, which is opposite to a predetermined shift direction, before the pair of rotary bodies holds the sheet, and (ii) shift in the predetermined shift direction after the pair of rotary bodies holds the sheet, and perform a secondary shift correction performed after the primary shift correction in which the pair of rotary bodies is configured to shift while the pair of rotary bodies conveys the sheet.

9. The sheet conveying device according to claim 8, wherein the controller is configured to control the pair of rotary bodies to, perform the primary shift correction in which the pair of rotary bodies is configured to (i) shift from the reference position in the opposite shift direction based on a first detection result by the detector before the pair of rotary bodies holds the sheet, and (ii) shift in the predetermined shift direction after the pair of rotary bodies holds the sheet, and perform the secondary shift correction performed after the primary shift correction in which the pair of rotary bodies is configured to shift based on a second detection result by the detector while the pair of rotary bodies conveys the sheet.

10. The sheet conveying device according to claim 9, wherein the detector includes a plurality of sensors, and each of the first detection result and the second detection result is obtained by at least one of the plurality of sensors.

11. The sheet conveying device according to claim 1, wherein the pair of rotary bodies includes a pair of rollers.

12. An image forming apparatus comprising:

an image forming part; and the sheet conveying device according to claim 1.

13. The image forming apparatus according to claim 12, wherein the image forming part includes a transfer portion at which a toner image is transferred to the sheet conveyed from the sheet conveying device.

14. The sheet conveying device according to claim 1, wherein the shaft is perpendicular to a conveyance surface of the sheet.

15. The sheet conveying device according to claim 1, wherein a feedback control is performed by feeding back a positional shift amount of the sheet between the primary skew correction and the secondary skew correction.

16. The sheet conveying device according to claim 1, wherein the controller is configured to control the pair of rotary bodies to, perform the primary skew correction in which the pair of rotary bodies is configured to (i) rotate from the reference position around the shaft perpendicular to a conveyance surface of the sheet in the opposite direction, based on a first detection result by the detector before the pair of rotary bodies holds the sheet, and (ii) rotate in the predetermined direction around the shaft after the pair of rotary bodies holds the sheet, and perform the secondary skew correction after the primary skew correction in which the pair of rotary bodies is configured to rotate around the shaft based on a second detection result by the detector while the pair of rotary bodies holds and conveys the sheet.

17. The sheet conveying device according to claim 1, wherein the pair of rotary bodies is configured to correct the skew of the sheet by performing the primary skew correction and the secondary skew correction.

18. The sheet conveying device according to claim 1, wherein the reference position corresponds to a normal position that has no positional shift to an oblique side in the sheet conveying direction.

19. The sheet conveying device according to claim 1, wherein the reference position is a position in which a rotary shaft of each of the pair of rollers extends in a direction perpendicular to a sheet conveying direction.

20. A sheet conveying device comprising:

a detector configured to detect a side edge of a sheet in a width direction of the sheet;

a pair of rotary bodies configured to convey the sheet and to correct a shift of the sheet in the width direction; and a controller configured to control the pair of rotary bodies to, perform a primary shift correction in which the pair of rotary bodies is configured to (i) shift from a reference position in an opposite shift direction, which is opposite to a predetermined shift direction, before the pair of rotary bodies holds the sheet, and (ii) shift in the predetermined shift direction after the pair of rotary bodies holds the sheet, and perform a secondary shift correction performed after the primary shift correction in which the pair of rotary bodies is configured to shift while the pair of rotary bodies conveys the sheet.

21. The sheet conveying device according to claim 20, wherein the detector includes a first sensor upstream from the pair of rotary bodies in a conveyance direction of the sheet;

a second sensor downstream from the first sensor and upstream from the pair of rotary bodies in the conveyance direction of the sheet; and a third sensor downstream from the pair of rotary bodies in the conveyance direction of the sheet, wherein a first detection result is obtained by at least one of the first sensor and the second sensor, and a second detection result is obtained by at least one of the second sensor and the third sensor.

22. The sheet conveying device according to claim 21, wherein the first sensor, the second sensor, and the third sensor include a contact image sensor, respectively.

23. The sheet conveying device according to claim 20, wherein the pair of rotary bodies includes a pair of rollers.

24. An image forming apparatus comprising:

an image forming part; and the sheet conveying device according to claim 20.

25. The image forming apparatus according to claim 24, wherein the image forming part includes a transfer portion at which a toner image is transferred to the sheet conveyed from the sheet conveying device.

26. The sheet conveying device according to claim 20, wherein the controller is configured to control the pair of rotary bodies to, perform the primary shift correction in which the pair of rotary bodies is configured to (i) shift from the reference position in the opposite shift direction based on a first detection result by the detector before the pair of rotary bodies holds the sheet, and (ii) shift in the predetermined shift direction after the pair of rotary bodies holds the sheet, and perform the secondary shift correction performed after the primary shift correction in which the pair of rotary bodies is configured to shift based on a second detection result by the detector while the pair of rotary bodies conveys the sheet.

27. The sheet conveying device according to claim 26, wherein the detector includes a plurality of sensors, and each of the first detection result and the second detection result is obtained by at least one of the plurality of sensors.

28. The sheet conveying device according to claim 26, wherein the primary shift correction is performed based on the first detection result by the detector, and the secondary shift correction is performed based on the second detection result by the detector.

29. The sheet conveying device according to claim 28, wherein the detector comprises:

a first sensor upstream from the pair of rotary bodies in a conveyance direction of the sheet;

a second sensor downstream from the first sensor and upstream from the pair of rotary bodies in the conveyance direction of the sheet; and a third sensor downstream from the pair of rotary bodies in the conveyance direction of the sheet, wherein the first detection result is obtained by the first sensor and the second sensor, and the second detection result is obtained by the second sensor and the third sensor.

30. The sheet conveying device according to claim 28, wherein the detector includes a plurality of sensors, and each of the first detection result and the second detection result is obtained by at least one of the plurality of sensors.

31. The sheet conveying device of claim 20, wherein the controller is configured to control the pair of rotary bodies to, perform the primary shift correction in which the pair of rotary bodies is configured to (i) shift from the reference position in the opposite shift direction, which is opposite to the predetermined shift direction, based on a first detection result by the detector before the pair of rotary bodies holds the sheet, and (ii) shift in the predetermined shift direction after the pair of rotary bodies holds the sheet, and perform the secondary shift correction after the primary shift correction in which the pair of rotary bodies is configured to shift based on a second detection result by the detector while the pair of rotary bodies holds and conveys the sheet.

32. The sheet conveying device according to claim 20, wherein the pair of rotary bodies is configured to correct the shift of the sheet by performing the primary shift correction and the secondary shift correction.

33. The sheet conveying device according to claim 20, wherein the reference position corresponds to a normal position that has no positional shift in the width direction.

34. A sheet conveying device comprising:

a detector configured to detect a side edge of a sheet in a width direction of the sheet;

a pair of rotary bodies configured to convey the sheet and to correct a skew and a shift of the sheet; and a controller configured to control the pair of rotary bodies to, perform a primary correction in which the pair of rotary bodies is configured to (i) rotate from a reference position around a shaft in an opposite direction, which is opposite to a predetermined direction, and shift from the reference position in an opposite shift direction, which is opposite to a predetermined shift direction before the pair of rotary bodies holds the sheet, and (ii) rotate in the predetermined direction around the shaft and shift in the predetermined shift direction after the pair of rotary bodies holds the sheet, and perform a secondary correction performed after the primary correction in which the pair of rotary bodies is configured to rotate around the shaft and shift while the pair of rotary bodies conveys the sheet.

35. The sheet conveying device according to claim 34, wherein the shaft is perpendicular to a conveyance surface of the sheet.

36. The sheet conveying device according to claim 34, wherein the pair of rotary bodies includes a pair of rollers.

37. An image forming apparatus comprising:

an image forming part; and the sheet conveying device according to claim 34.

38. The image forming apparatus according to claim 37, wherein the image forming part includes a transfer portion at which a toner image is transferred to the sheet conveyed from the sheet conveying device.

39. The sheet conveying device according to claim 34, wherein the pair of rotary bodies is configured to correct the skew and the shift of the sheet by performing the primary correction and the secondary correction.

40. The sheet conveying device according to claim 34, wherein the reference position corresponds to a normal position that has no positional shift to an oblique side in the sheet conveying direction and has no positional shift in the width direction.

41. The sheet conveying device according to claim 34, wherein the reference position is a position in which a rotary shaft of each of the pair of rollers extends in a direction perpendicular to a sheet conveying direction.

42. A sheet conveying device comprising:

a detector configured to detect a side edge of a sheet in a width direction of the sheet;

a pair of rotary bodies configured to convey the sheet; and a controller configured to control the pair of rotary bodies to, perform a primary skew correction in which the pair of rotary bodies is configured to (i) rotate from a reference position around a shaft in an opposite direction, which is opposite to a predetermined direction, before the pair of rotary bodies holds the sheet, and (ii) rotate to the reference position in the predetermined direction around the shaft after the pair of rotary bodies holds the sheet, and perform a secondary skew correction performed after the primary skew correction in which the pair of rotary bodies is configured to rotate around the shaft from the reference position while the pair of rotary bodies conveys the sheet, wherein the pair of rotary bodies is configured to correct a skew of the sheet by performing the primary skew correction and the secondary skew correction.

43. The sheet conveying device according to claim 42, wherein the reference position corresponds to a normal position that has no positional shift to an oblique side in the sheet conveying direction.

44. The sheet conveying device according to claim 42, wherein the reference position is a position in which a rotary shaft of each of the pair of rollers extends in a direction perpendicular to a sheet conveying direction.

* * * * *